US009080314B1

(12) United States Patent
Rossi, Jr.

(10) Patent No.: US 9,080,314 B1
(45) Date of Patent: Jul. 14, 2015

(54) EXCAVATING MACHINERY WITH BUCKET FOR SCREENING AND/OR MIXING EXCAVATED MATERIAL

(71) Applicant: Robert R. Rossi, Jr., Waxhaw, NC (US)

(72) Inventor: Robert R. Rossi, Jr., Waxhaw, NC (US)

( * ) Notice: Subject to any disclaimer, the term of this patent is extended or adjusted under 35 U.S.C. 154(b) by 30 days.

(21) Appl. No.: 14/156,077

(22) Filed: Jan. 15, 2014

Related U.S. Application Data

(63) Continuation-in-part of application No. 13/790,716, filed on Mar. 8, 2013, now Pat. No. 8,893,409.

(60) Provisional application No. 61/766,986, filed on Feb. 20, 2013, provisional application No. 61/893,330, filed on Oct. 21, 2013.

(51) Int. Cl.
*E02F 3/40* (2006.01)
*B07B 1/28* (2006.01)
*B07B 1/46* (2006.01)

(52) U.S. Cl.
CPC .... *E02F 3/40* (2013.01); *B07B 1/46* (2013.01)

(58) Field of Classification Search
USPC ..... 37/444; 209/660
IPC ... E02F 3/342,3/345, 3/3417, 3/40; B07B 1/28, B07B 13/04
See application file for complete search history.

(56) References Cited

U.S. PATENT DOCUMENTS 3,003,265 A * 10/1961 Lutjens ..... 37/444
3,195,747 A * 7/1965 Kashergen ..... 414/694
5,160,034 A 11/1992 Potter
5,241,764 A * 9/1993 Modig ..... 37/405
5,248,100 A 9/1993 Arakawa
5,398,430 A * 3/1995 Scott et al. ..... 37/142.5
5,491,914 A 2/1996 Negishi
5,493,796 A * 2/1996 Ballew et al. ..... 37/142.5
5,581,916 A 12/1996 Hirose et al.
5,619,811 A 4/1997 Yrjölä
5,743,030 A * 4/1998 Sirr ..... 37/406
5,964,050 A 10/1999 Svahn
6,237,865 B1 5/2001 Luttermann et al.
6,375,012 B1 * 4/2002 Leyland et al. ..... 209/421
6,718,659 B2 4/2004 Foutz et al.
7,007,877 B1 3/2006 Kuhmonen
7,506,461 B2 3/2009 Jonninen
7,743,881 B2 * 6/2010 Imamura et al. ..... 181/207

(Continued)

FOREIGN PATENT DOCUMENTS

CA 2247715 3/2000
WO WO 2010/095933 8/2010

*Primary Examiner* — Gary Hartmann
(74) *Attorney, Agent, or Firm* — Dority & Manning, P.A.

(57) ABSTRACT

An excavating bucket apparatus pivotally mounts on an articulating arm of a mobile excavating machine. The bucket includes a scoop member that has a frame and defines a top configured for pivotal connection to the excavating machine's articulating arm. Each of the opposed ends of the scoop member can be open to receive and pass through any material dug or scraped by the scoop member, which defines a bottom disposed opposite the top. The bottom of the scoop member can define a generally banana-shaped bottom profile. The frame carries a screening mechanism disposed at the bottom of the scoop member, and the screening mechanism can define at least two stacked screening decks and a generally banana-shaped profile. The screening mechanism can be mechanically vibrated while being isolated mechanically from the scoop member. The frame accommodates different screening mechanisms, which are easily removed and re-installed.

9 Claims, 37 Drawing Sheets

(56) References Cited

U.S. PATENT DOCUMENTS

| | | | | |
|---|---|---|---|---|
| 7,913,430 | B2 | 3/2011 | Männikkö | |
| 8,112,913 | B2 | 2/2012 | Sirr | |
| 8,117,771 | B2 | 2/2012 | Risi | |
| 8,893,409 | B1 * | 11/2014 | Rossi, Jr. | 37/444 |
| 2008/0000112 | A1 | 1/2008 | Schenk | |
| 2011/0010968 | A1 | 1/2011 | Männikkö | |
| 2011/0100882 | A1 * | 5/2011 | Beam et al. | 209/252 |
| 2013/0092607 | A1 * | 4/2013 | Jonninen | 209/369 |
| 2013/0161429 | A1 | 6/2013 | Turnball | |
| 2014/0262976 | A1 * | 9/2014 | Jonninen et al. | 209/255 |

* cited by examiner

EXCAVATING MACHINERY WITH BUCKET FOR SCREENING AND/OR MIXING EXCAVATED MATERIAL

CROSS-REFERENCE TO RELATED APPLICATIONS

The present application claims priority to U.S. Provisional Patent Application Ser. No. 61/766,986, filed Feb. 20, 2013, U.S. patent application Ser. No. 13/790,716, filed Mar. 8, 2013, and U.S. Provisional Patent Application Ser. No. 61/893,330, filed Oct. 21, 2013, and each of these applications is hereby incorporated herein in its entirety for all purposes by these references.

STATEMENT ABOUT FEDERALLY SPONSORED RESEARCH OR DEVELOPMENT

Not applicable.

FIELD OF THE INVENTION

The subject matter disclosed herein generally involves machinery that separates aggregates and/or demolition debris and/or waste and/or recyclable materials and particularly such machinery that includes a bucket that can be selectively attached to and detached from an articulating arm of a vehicle.

BACKGROUND OF THE INVENTION

A major limitation of any apparatus for screening materials such as for example aggregates, waste, wood, recyclable materials, glass, sand, concrete, asphalt, demolition debris, etc., is the throughput of screened material that can be processed per unit of time. This is true of apparatus such as found in U.S. Pat. Nos. 6,237,865 and 7,506,461 that employ screening shafts for example. As described therein, a screening shaft defines an elongated rotatable shaft. Replaceable fixed elements project radially away from the surface of the circumference of the screening shaft. Each screening shaft is rotatable about its longitudinal axis, and the rotation is powered so that it is driven under the control of the operator. Several of the screening shafts are disposed in alignment with each other across the outlet area of the bucket containing the screening shafts. The screening size can be varied depending on the radial length of the elements from the surface of the shaft. U.S. Pat. Nos. 6,237,865 and 7,506,461 disclose buckets that load from the front, have solid bottoms and sides and have multiple screening shafts aligned in a row at the back of the bucket and lying in a plane that is disposed at a 90 degree angle from the bottom of the bucket.

U.S. Pat. No. 5,581,916 also discloses a bucket that loads from the front and has solid sides, but has a solid back and has a reciprocating screen in the bottom of the bucket. The direction of reciprocation of the screen is front to back. The reciprocating motion of the screen is driven by a motor that is mounted on the bucket and thus provides a reciprocating connection between the screen and the bucket.

However, the buckets described above require additional machines to bring to the buckets from other sites the raw materials that are to be screened, can only be fed from one direction, and become clogged by debris above a predetermined larger size and so must stop operating while such debris is cleared. Accordingly, these limitations in turn limit the throughput that can be attained by these screening apparatus.

Devices that are essentially mechanical shovels are known. U.S. Pat. No. 5,160,034 discloses a front-end loader with a shovel attachment having a vibrating screen forming the bottom of the shovel. The shovel takes up sand as the screen slides beneath about a two inch depth of the sand as the front-end loader moves forward. The screen is vibrated to separate the sand from the oversized material, which remains in the shovel. However, this device must be moving forward to take up sand and only can be loaded from the front. Accordingly, this vibrating screen in the bottom of the shovel attachment is not suitable for processing large volumes of material.

Moreover, the screen media itself typically is formed of a steel plate that typically is about ⅜ inches thick, and holes are punched through this thickness of the plate to allow material smaller than the area of the hole to pass through the screen media. Another type of screen media typically is formed of a sheet of solid rubber or urethane that is about one inch thick and has holes punched through this thickness of the sheet. This sort of screen media is needed to withstand the rigors of screening the heavy materials involved. However, because of the need to punch the openings to create this sort of screen media, the fineness of the particulates that can be passed through such openings tends to be commensurately limited. Both types of this screen media typically are bolted to supports that are in turn bolted to a screen box that is open only at the top and at the bottom of the vibrating screen, and the entire screen box is shaken to facilitate the filtering function of the vibrating screen.

BRIEF DESCRIPTION OF THE INVENTION

Aspects and advantages of the invention are set forth below in the following description, or may be obvious from the description, or may be learned through practice of embodiments of the invention.

An excavating bucket apparatus pivotally mounts on an articulating arm of a mobile excavating machine. The bucket includes a scoop member that has a frame and defines a top configured for pivotal connection to the excavating machine's articulating arm. In one embodiment, each of the opposed ends of the scoop member can be open to receive and pass through any material dug or scraped by the scoop member, which defines a bottom disposed opposite the top. The bottom of the scoop member can define a generally banana-shaped bottom profile. The frame carries a screening mechanism disposed at the bottom of the scoop member, and the screening mechanism can define at least two stacked screening decks and a generally banana-shaped profile. The screening mechanism can be mechanically vibrated while being isolated mechanically from the scoop member. The frame accommodates different screening mechanisms, which are easily removed and re-installed. Some of the screening mechanisms are multi-tiered, and some include a magnet. Some of the screening mechanisms employ screen media that are pliable and/or flexible and that can be held taut under tension as desired by the operator and conformed to non-standard contouring shapes. Some of the screening mechanisms employing such tensioned screen media can combine the attributes of minimizing the size of individual openings while maximizing the open area of the entire screen. The scoop member is configured for orientation by the operator so that material is easily processed to produce segregated piles of separately sized material.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in this specification, including reference to the accompanying figures, in which.

Figure 1:
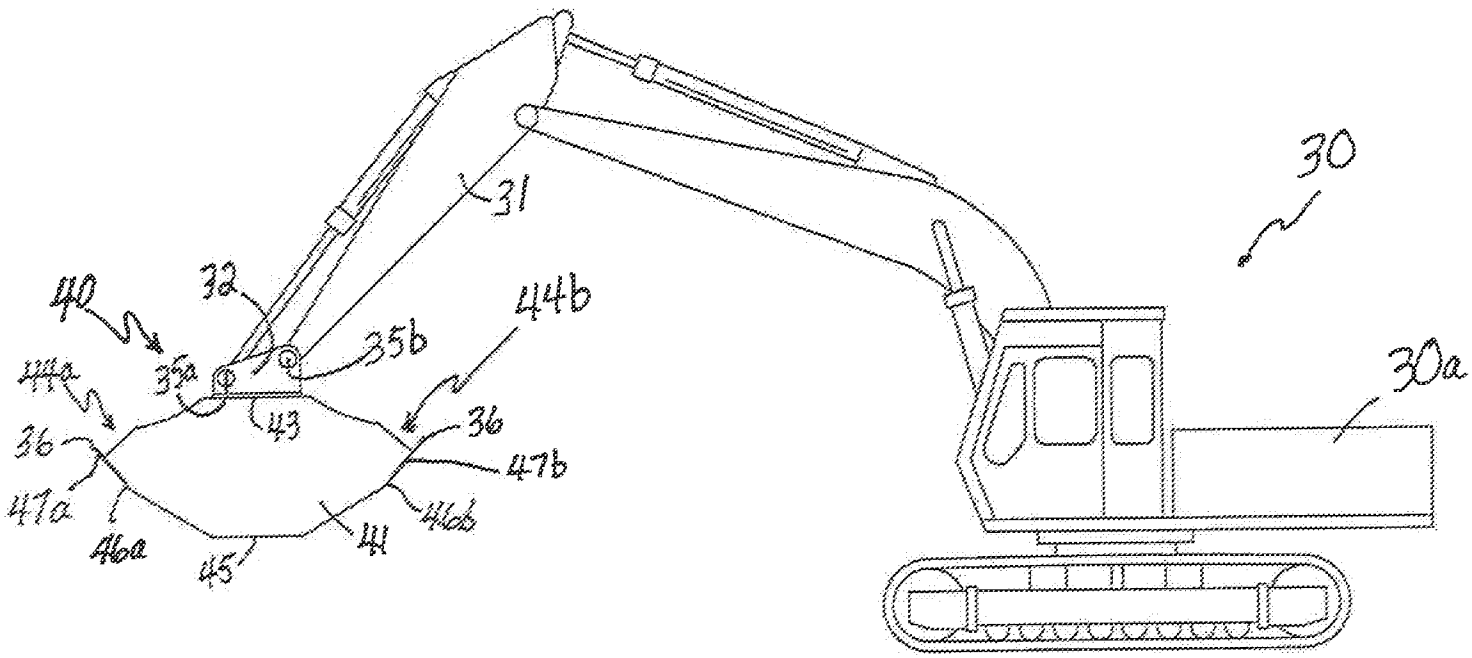
FIG. 1 is a side plan view of an embodiment of the present invention.

The accompanying drawings, which are incorporated in and constitute a part of this specification, illustrate at least one presently preferred embodiment of the invention as well as some alternative embodiments. These drawings, together with the written description, serve to explain the principles of the invention but by no means are intended to be exhaustive of all of the possible manifestations of the invention.

DETAILED DESCRIPTION OF THE INVENTION

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of different embodiments of the invention and/or components thereof.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

It is to be understood that the ranges and limits mentioned herein include all sub-ranges located within the prescribed limits, inclusive of the limits themselves unless otherwise stated. For instance, a range from 100 to 200 also includes all possible sub-ranges, examples of which are from 100 to 150, 170 to 190, 153 to 162, 145.3 to 149.6, and 187 to 200. Further, a limit of up to 7 also includes a limit of up to 5, up to 3, and up to 4.5, as well as all sub-ranges within the limit, such as from about 0 to 5, which includes 0 and includes 5 and from 5.2 to 7, which includes 5.2 and includes 7.

The longitudinal direction extends along the length of a structure, and the length of an elongated structure is the longest dimension of the structure. The transverse direction extends perpendicular to the longitudinal direction along the width of a structure, and the width of an elongated structure is the shorter orthogonal dimension of the structure. The vertical direction typically is the orthogonal direction that is normal to both the transvers direction and the longitudinal direction and typically is parallel to the direction in which the force of gravity would tend to operate when the apparatus in question is being used for its intended purpose.

One embodiment of the excavating bucket apparatus of the present invention is depicted in FIG. 1 and indicated generally by the numeral 40. The excavating bucket apparatus 40 can be selectively attached to and detached from a mobile vehicle 30, and examples of such vehicle 30 can include but are not limited to excavators, front-end loaders, backhoes, skid steer loaders, and machinery similar to the foregoing. As schematically shown in FIG. 1 for example, the mobile vehicle 30 desirably includes a conventional articulating arm 31 and carries its own engine 30*a* that can power movement of the articulating arm 31 as well as the movement of the tracks 30*b* by which the vehicle 30 can be self-propelled. As schematically shown in FIGS. 1, 2A, 2B, 2C, 2D, 2E and 2F for example, excavating bucket apparatus 40 desirably is pivotally mountable on an articulating arm 31 of a mobile vehicle 30. The excavating bucket apparatus 40 is configurable for controlled, powered operation. However, as is conventional in the art, the power for such operation of the excavating bucket apparatus 40 can be supplied by the vehicle 30, or be integrated into the excavating bucket apparatus 40 itself or be supplied by a stand-alone power supply separate from the vehicle 30 and separate from the excavating bucket apparatus 40. Moreover, the power can be supplied hydraulically, pneumatically, electrically or any combination thereof. The arrows designated 28 in each of FIGS. 2A, 2B, 2C, 2D, 2E and 2F schematically indicate the direction of powered movement of the excavating bucket apparatus 40.

Figure 3:
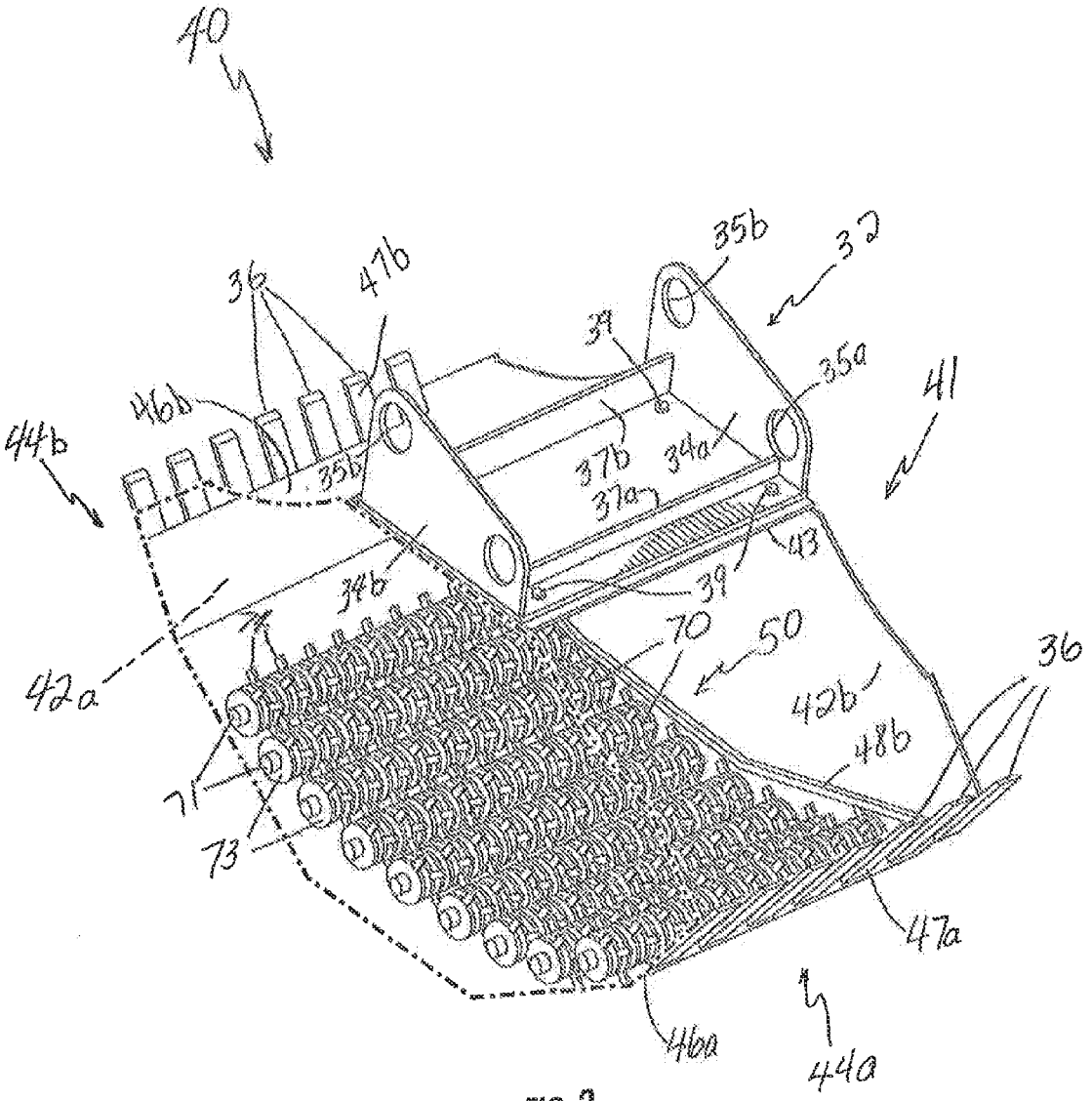
FIG. 3 is an elevated perspective view of embodiments of components of the present invention with certain features shown in chain-dashed line for purposes of illustrating features that ordinarily would not be visible in the view shown.
Figure 15:
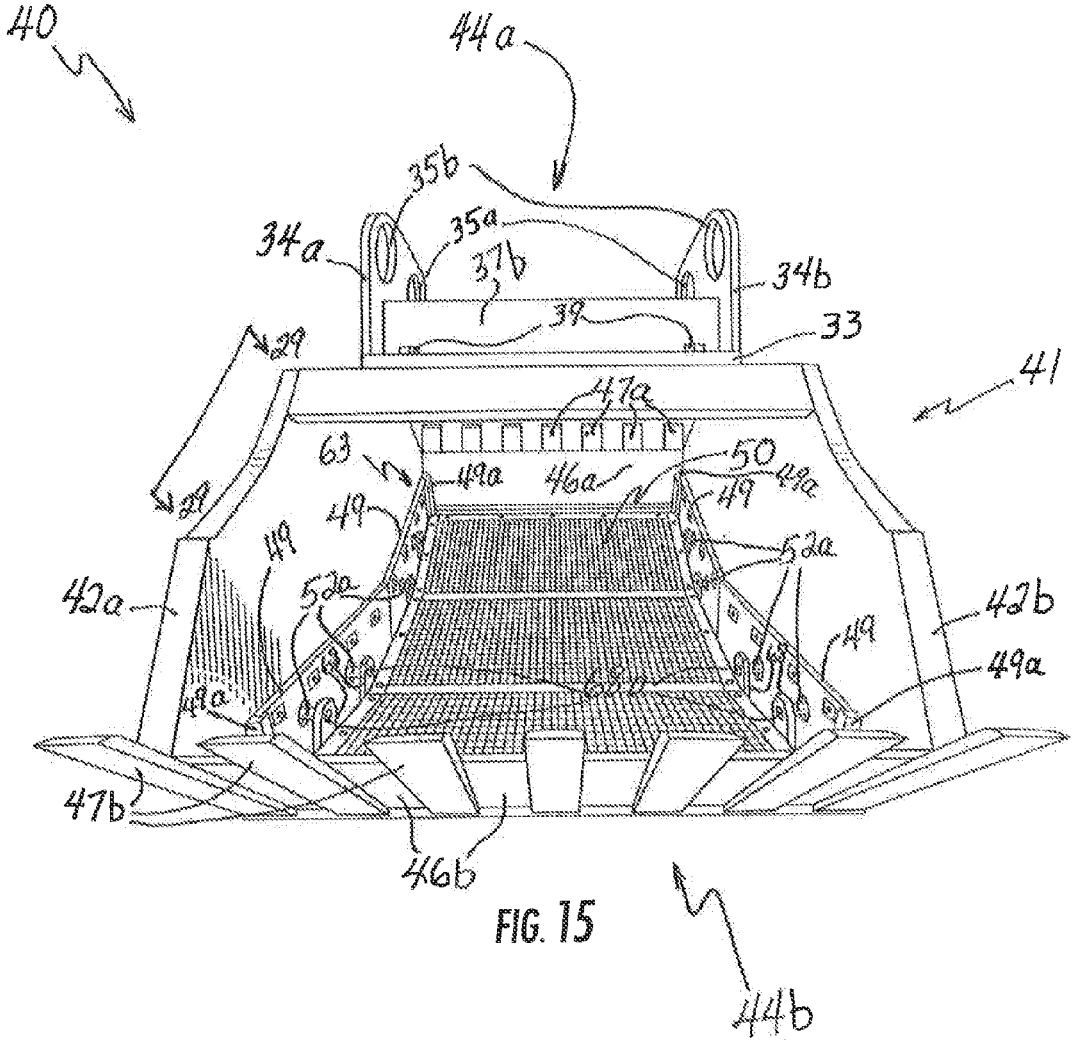
FIG. 15 depicts an elevated perspective view of an embodiment such as shown in FIG. 6 taken along the lines of sight of the arrows designated 15—15 in FIG. 6.
Figure 23:
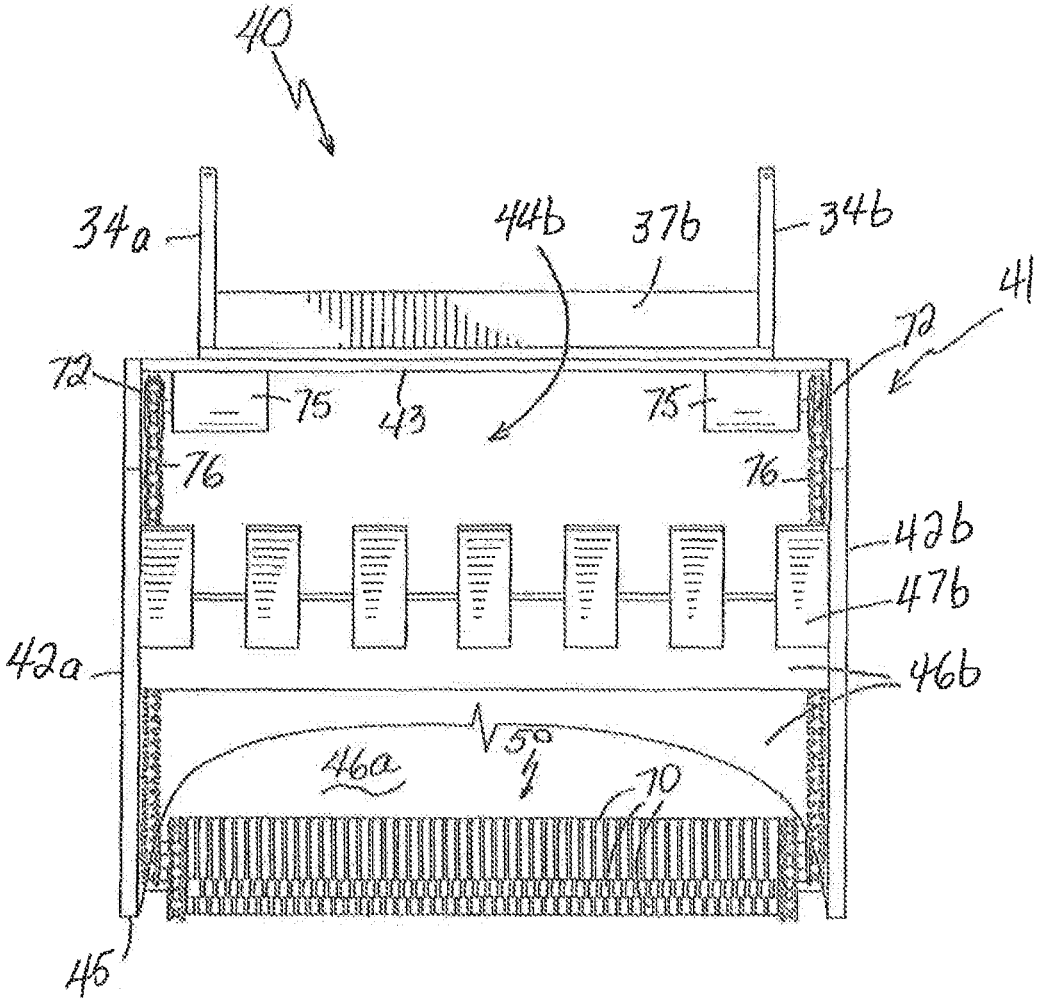
FIG. 23 is a plan view taken along the lines of the arrows 23—23 of components of yet another embodiment of the present invention depicted in FIG. 11.
Figure 31:
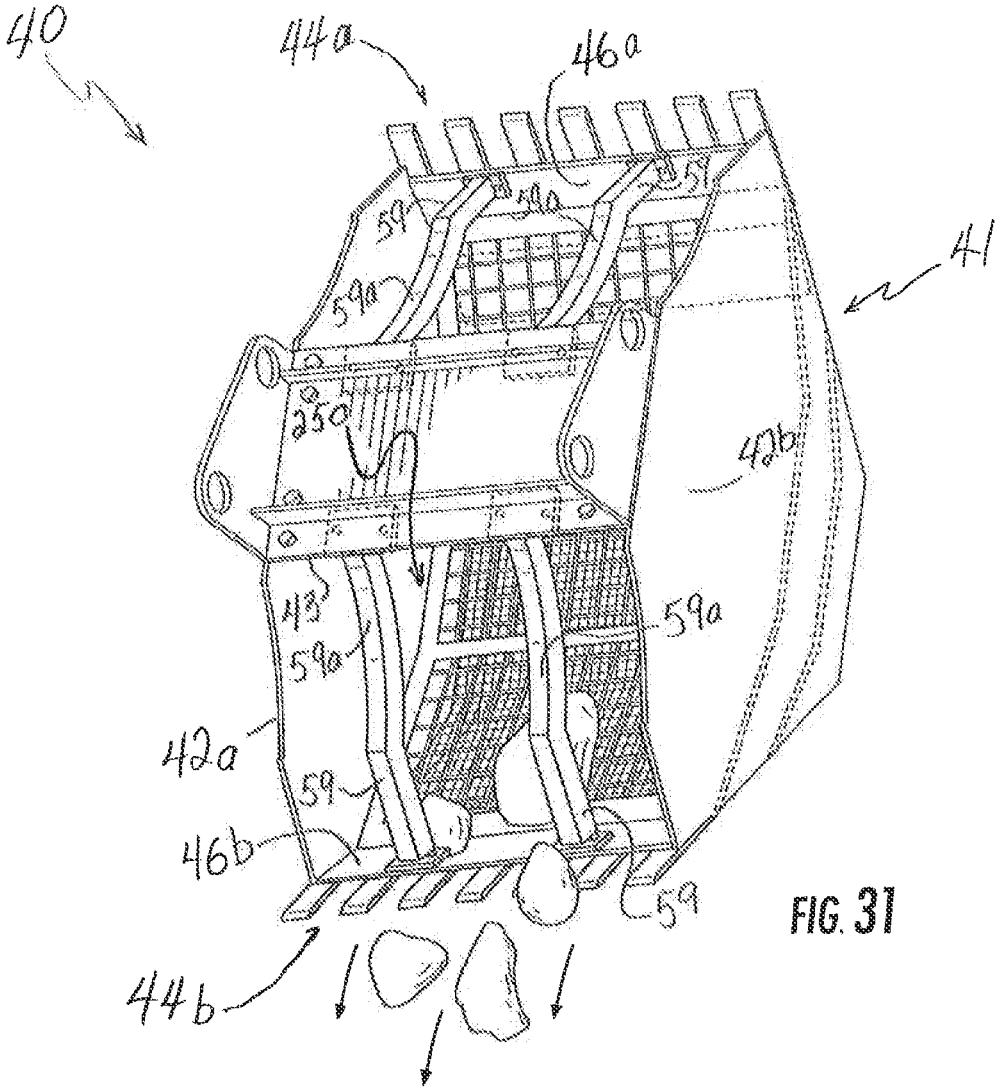
FIG. 31 is a perspective view of embodiments of components of the present invention with certain features shown in chain-dashed line for purposes of illustrating features that ordinarily would not be visible in the view shown.

As shown in FIGS. 3, 6, 15 and 17 for example, the excavating bucket apparatus 40 includes a scoop member 41. As shown in FIGS. 3, 15 and 31 for example, the scoop member 41 desirably includes a frame defining a pair of spaced apart and opposed side panels 42*a*, 42*b*. As shown in FIGS. 3, 23 and 31 for example, the scoop member 41 further desirably defines a top 43 configured for pivotal connection to the articulating arm 31 (FIG. 1) of the mobile vehicle 30.

Figure 12:
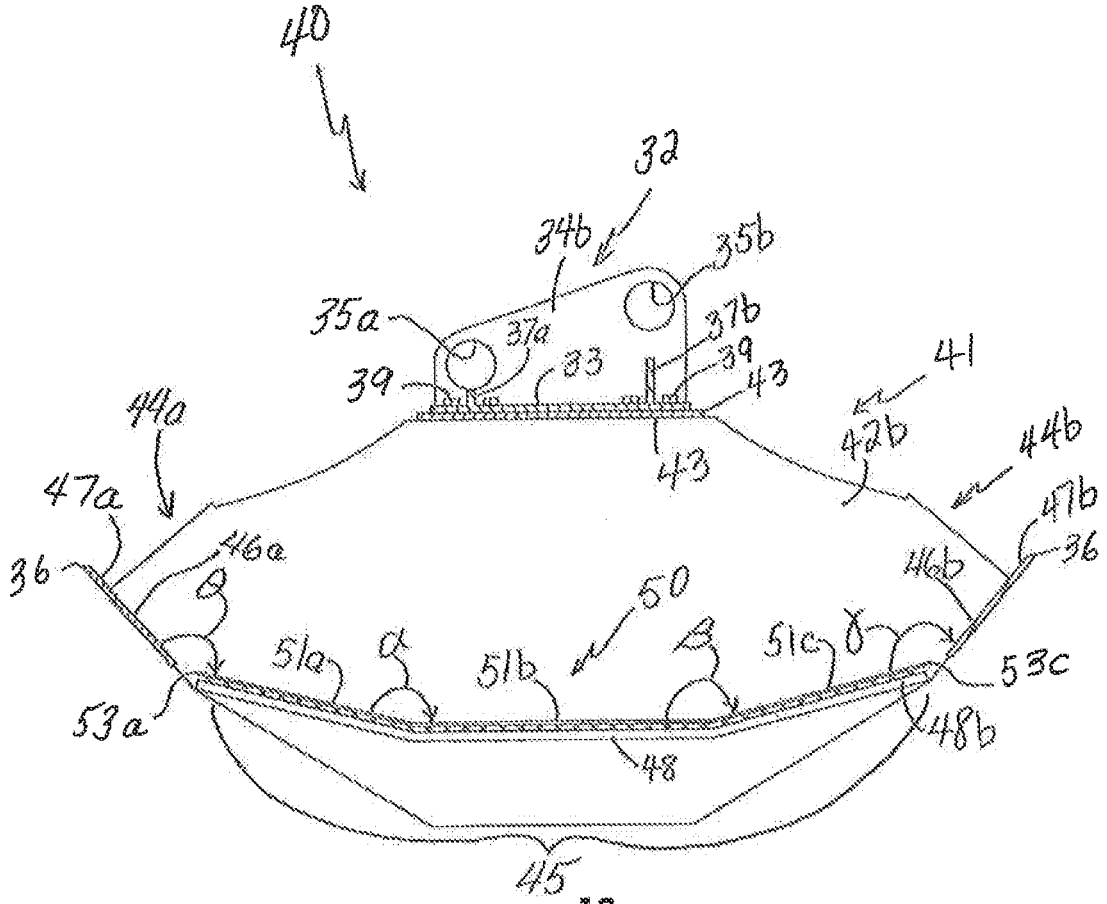
FIG. 12 is a partial schematic representation of a cross-sectional view taken in the direction along the lines of the arrows designated 12—12 in FIG. 6.

As schematically shown in FIGS. 1 and 3 for example, the excavating bucket apparatus 40 desirably is pivotally mountable on an articulating arm 31 of a mobile vehicle 30 via a hitch 32. As shown in FIGS. 3 and 12 for example, an embodiment of the hitch 32 desirably includes a base plate 33. As shown in FIGS. 3 and 12 for example, the hitch 32 desirably is connected to the top 43 of the scoop member 41 via a plurality of bolts 39 connecting the base plate 33 to the top 43 of the scoop member 41. Each bolt 39 desirably has a threaded exterior surface at one opposite end that receives a like-threaded opening of a nut. The mechanically fastened bolts 39 are removable by unscrewing the nuts so that different hitches 32 can be used to mount the same excavating bucket apparatus 40 on different mobile vehicles 30.

As shown in FIG. 3 for example, each side of the hitch 32 is defined by one of a pair of attachment flanges 34*a*, 34*b* connected to and extending vertically from the base plate 33 in a direction that is perpendicular to the flat plane in which the base plate 33 lies. As shown in FIGS. 3 and 12 for example, separate reinforcement bars 37*a*, 37*b* desirably are attached, as by welding, to the base plate 33. As shown in FIG. 3 for example, each separate reinforcement bar 37*a*, 37*b* desirably is attached, as by welding, to each of the attachment flanges 34*a*, 34*b*. The reinforcement bars 37*a*, 37*b* desirably extend between and connect the two attachment flanges 34*a*, 34*b* and provide strength and rigidity to the hitch 32.

Each attachment flange 34*a*, 34*b* in the embodiment shown in FIG. 3 for example defines a pair of pin openings 35*a*, 35*b*. The articulating arm 31 of a mobile vehicle 30 is pivotally connected to the hitch 32 via the pin openings 35*a*, 35*b* in any conventional manner so that angle adjustments of the orientation of the scoop member 41 can be made by the operator by tilting the scoop member 41. However, in the embodiment shown in FIGS. 1 and 3 for example, the pin openings 35*a* in the forward end of the hitch 32 are disposed lower (closer to the base plate 33 and to the top 43 of the scoop member 41) than the pin openings 35*b* in the backward end of the hitch 32 to allow for maximum travel of the scoop member 41 before the cutting edge 36 would hit the arm 31 of the excavator 30.

As shown in FIGS. 3 and 12 for example, the scoop member 41 defines opposed ends 44*a*, 44*b* extending transversely between the side panels 42*a*, 42*b* at each of the respective opposite ends of the side panels 42*a*, 42*b*. As shown in FIGS. 1 and 15 for example, each of the forward end 44*a* and backward end 44*b* of the scoop member 41 is open to receive and pass through any material engaged by the scoop member 41. As shown in FIG. 12 for example, the scoop member 41 defines a bottom 45 disposed generally opposite the top 43 of the scoop member 41. The bottom 45 of the scoop member 41 extends transversely between the side panels 42*a*, 42*b*, and the bottom 45 extends longitudinally between the opposed ends 44*a*, 44*b* of the scoop member 41.

Figure 6:
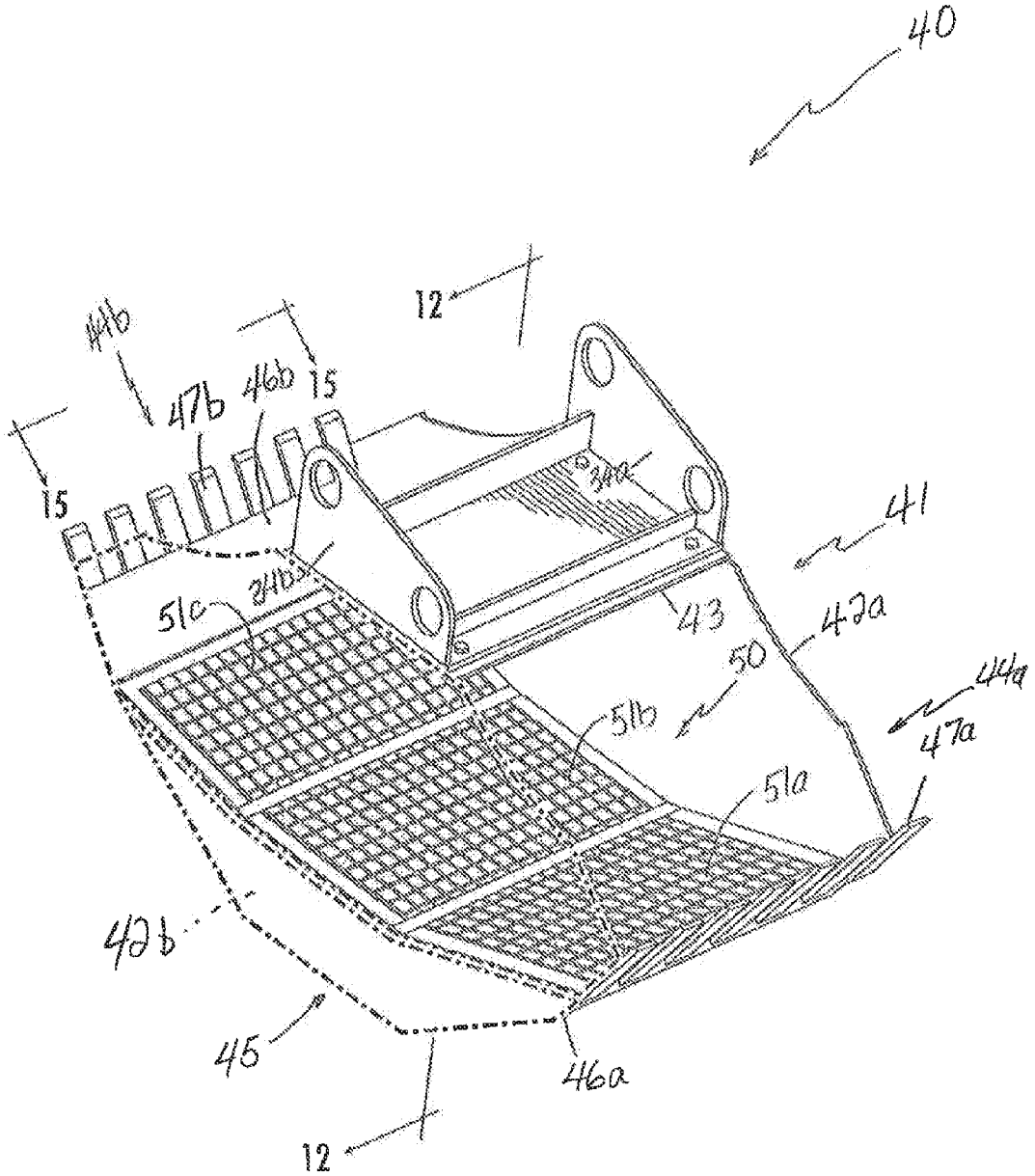
FIG. 6 is a perspective view of embodiments of components of the present invention with certain features shown in chain-dashed line for purposes of illustrating features that ordinarily would not be visible in the view shown.

As shown in FIGS. 6 and 12 for example, the excavating bucket apparatus 40 includes a screening mechanism 50 carried by the frame and disposed between the top 43 and bottom 45 of the scoop member 41 and generally closer to the bottom 45 of the scoop member 41. Indeed, the bottom 45 of the scoop member 41 is that portion of the scoop member 41 that lies beneath the finest screening implements of the screening mechanism 50. As schematically shown in FIGS. 12 and 15 for example, the screening mechanism 50 desirably is carried by and suspended between the side panels 42*a*, 42*b* of the frame of the scoop member 41. FIG. 12 schematically depicts the screening mechanism 50 being supported and carried by a flange 48*b* that is attached to the side panel 42*b* of the scoop member 41. If there were a mirror image of FIG. 12, a similar flange 48*a* would be shown attached to the side panel 42*a* of the scoop member 41.

Figure 26:
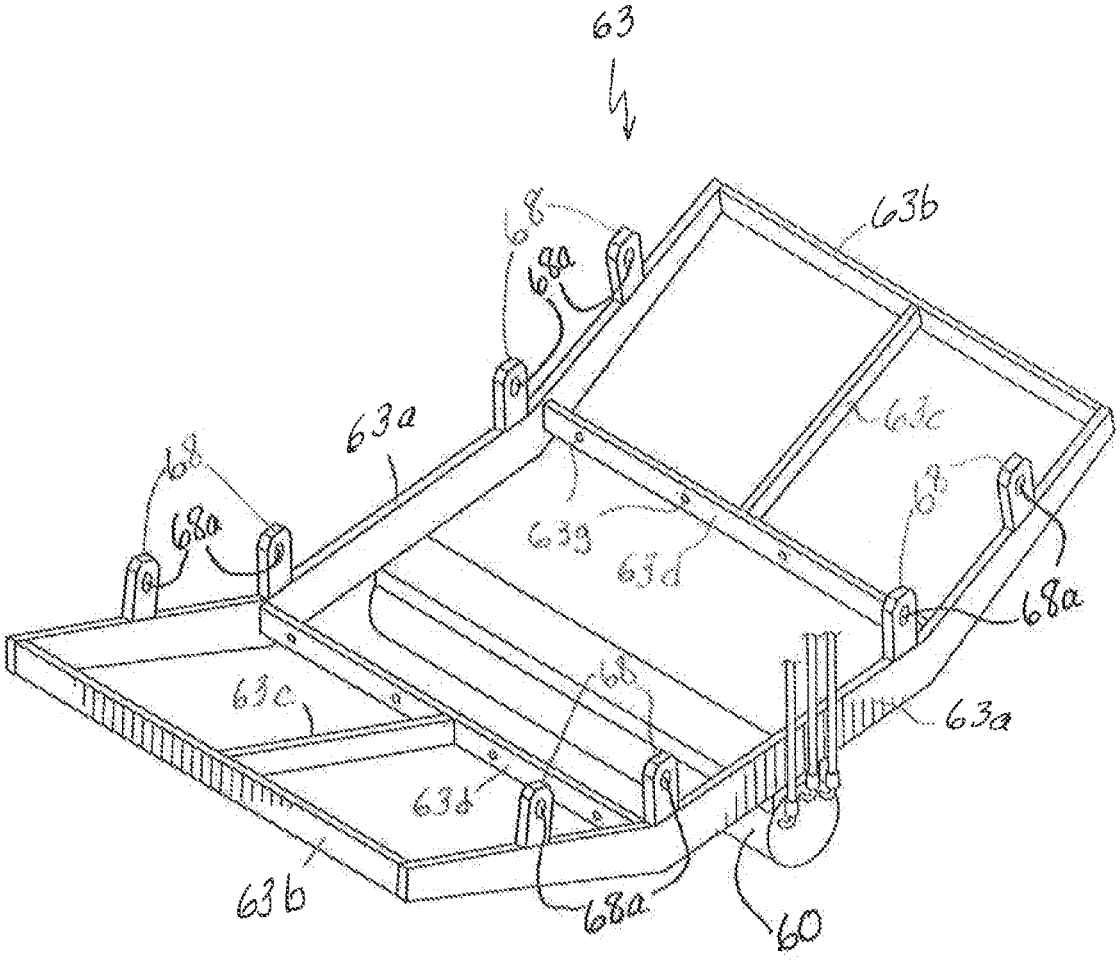
FIG. 26 is a perspective view of embodiments of components of the present invention.
Figure 27:
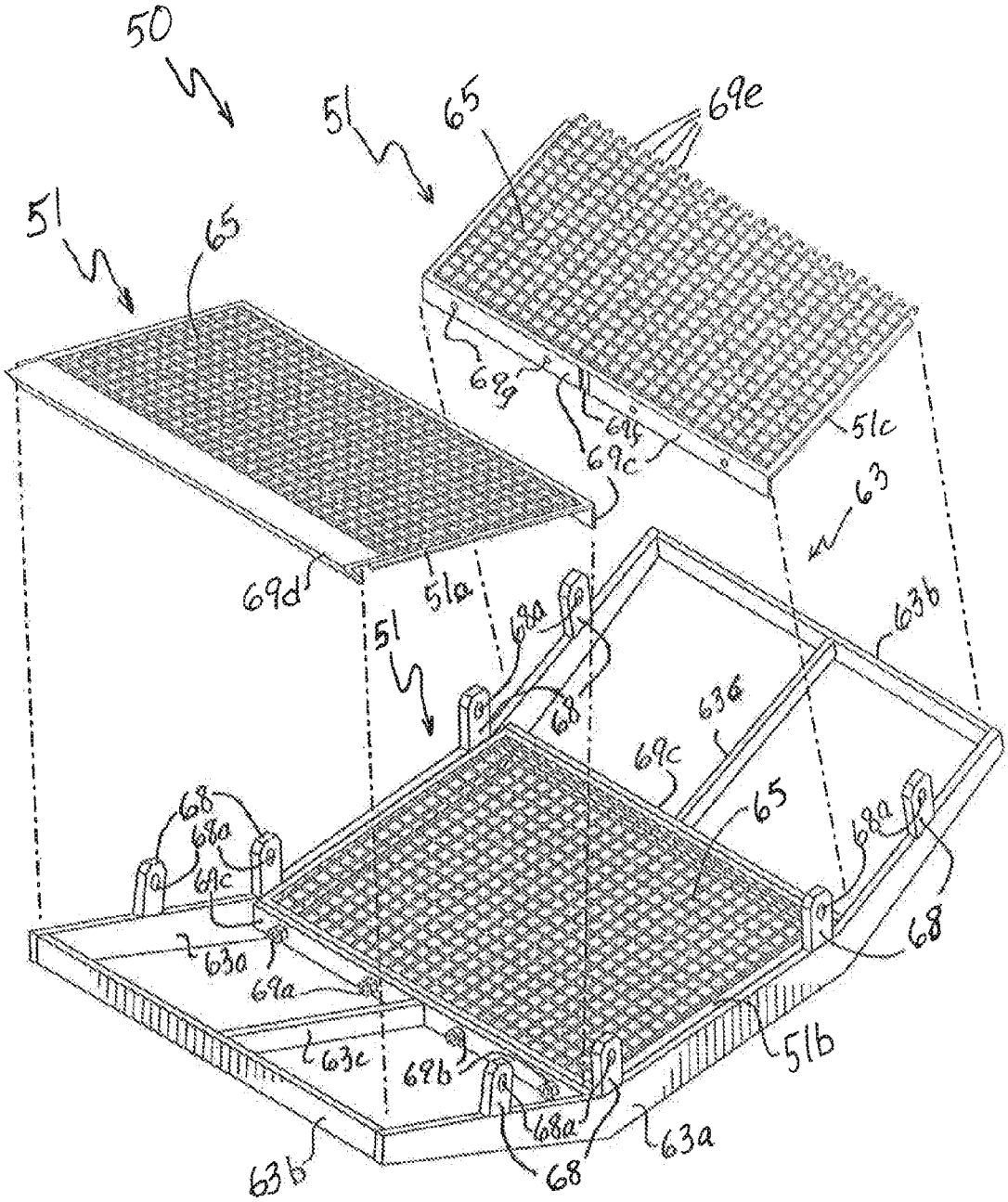
FIG. 27 is a perspective, assembly view of embodiments of components of the present invention.
Figure 28:
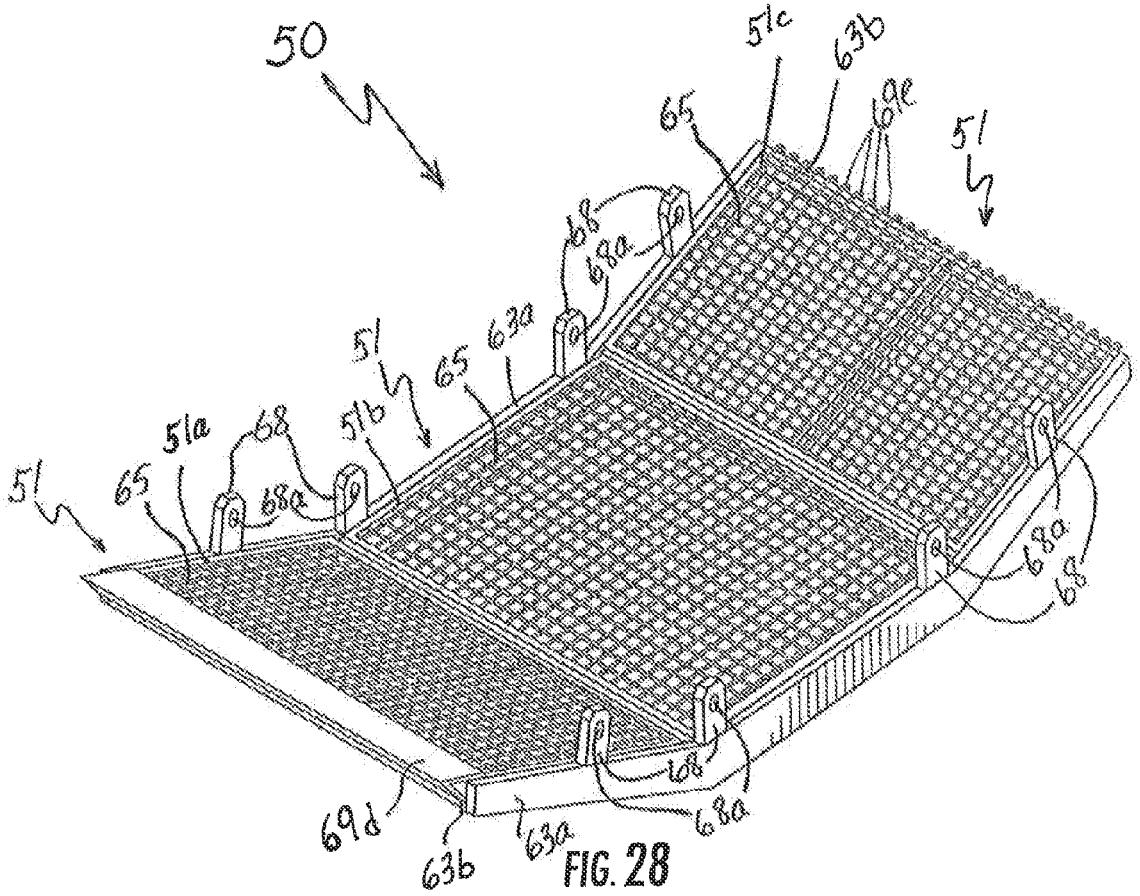
FIG. 28 is a perspective, assembled view of embodiments of components of the present invention.
Figure 34:
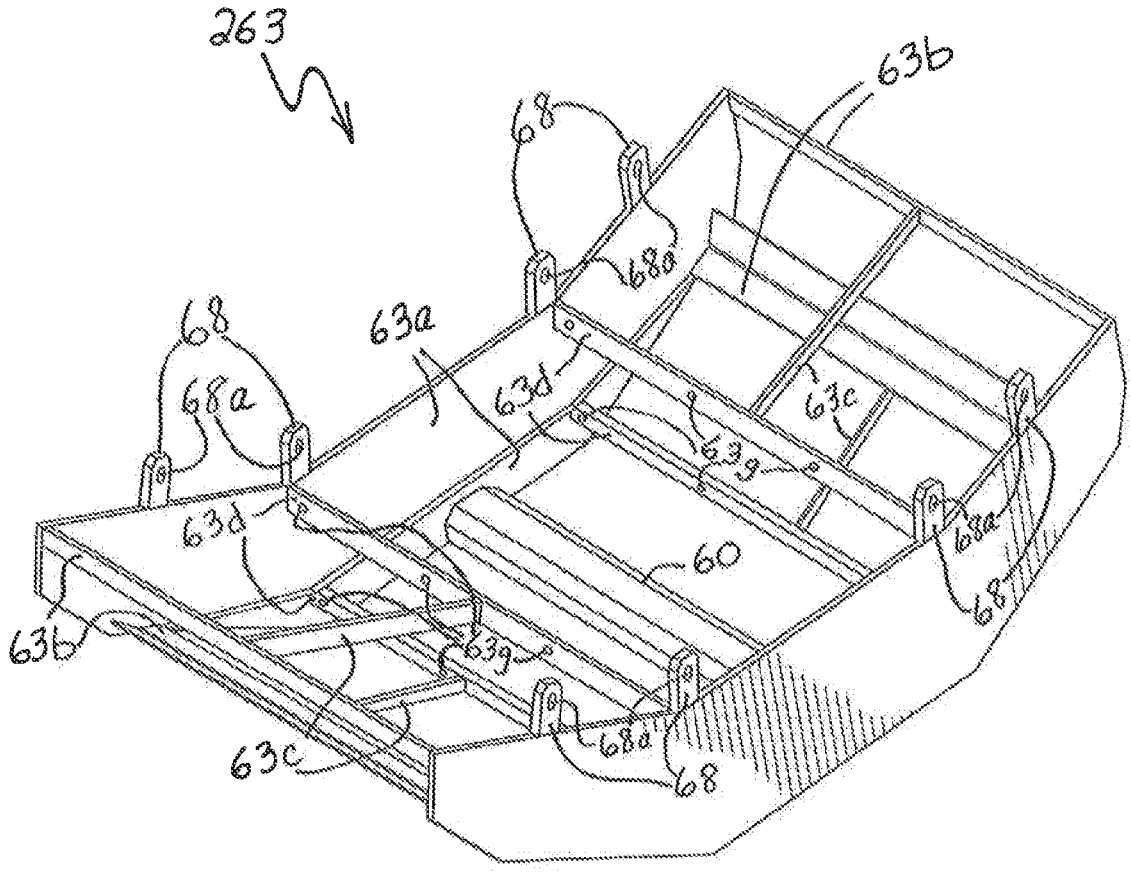
FIG. 34 is an elevated perspective view of embodiments of components of the present invention.

As shown in FIGS. 26, 27 and 28 for example, the screening mechanism 50 desirably includes a screen skeleton 63 that desirably forms the support carriage of the screening mechanism 50. The screen skeleton 63 depicted in FIGS. 26, 27 and 28 is configured for a single deck screening mechanism. Alternatively, as shown in FIG. 34 for example, a double-deck screen skeleton 263 desirably forms the support carriage of a double-deck screening mechanism 250. As shown in FIGS. 26, 27 and 34 for example, the screen skeleton 63, 263 desirably includes a plurality of rigid side arms 63*a*, rigid end pieces 63*b*, rigid axial braces 63*c* and rigid transverse braces 63*d* that are interconnected to form a rigid lattice framework.

As shown in FIGS. 27 and 28 for example, an embodiment of the screening mechanism 50 desirably includes screening media 65 that is selectively (at the desire of the user) detachably connected to an embodiment of the screen skeleton 63, 263. In other words, the user can detach screen media 65 from the screen skeleton 63, 263 whenever the user desires to replace the screen media 65, whether to replace damaged screen media or to change the sieving characteristics of the screen media 65.

The screen media 65 can be formed from one or more of a variety of materials, which can include but are not limited to: stainless steel, woven steel wire, steel punch plate, urethane, rubber, cloth, carbon, plastic, polymer wire and combinations of the foregoing materials for example. The physical dimensions of the screen media 65 can include an infinite array of opening sizes in combination with an infinite array of wire or solid thicknesses between the openings. Screen media 65 may be formed of steel punch plate that may be three-eighths inches thick and solid rubber or urethane that may be about one inch or so thick. Screen media 65 with as many as 100 holes per square foot are possible. The configurations of the openings in the screen media 65 can be an infinite array of opening shapes, which can include but are not limited to: diamond, circular, oval, square, rectangular, or any combinations of different shapes and sizes. Regardless of the opening size, the screen media 65 forming the panels can be conformed to non-standard contouring shapes such as a banana-shape for example.

In one exemplary embodiment, the screen media desirably is stretched across the screen skeleton 63 and held under tension against the screen skeleton 63. The screen media 65 can be held under tension only in the longitudinal direction, or only the transverse direction or in both directions at the same time. The same is true of the double deck skeleton 263 depicted in FIG. 34 for example. Screen media 65 formed of panels of woven steel wire materials can be held taut under tension against the screen skeleton 63 or 263 to the degree of tension that is desired by the operator. In this way it is possible to generate openings that are smaller than 0.75 inches down to openings that are nominally as low as one micron across the narrowest dimension of the opening.

In alternative embodiments, the panels of screen media 65 can be formed of more rigid material that does not stretch or that only stretches very little, and such rigid screen panels can be bolted onto the screen skeleton 63 or 263. In some cases, the screen media 65 are formed of panels of polymer materials such as rubber or urethanes that are pliable and/or flexible and thus more easily conformed into non-planar shapes. In the case of the screen media 65 formed of panels of pliable and/or flexible polymer materials such as rubber or urethanes, the panels can be held in place on the screen skeleton 63 or 263 with or without applying tension to stretch the screen media 65 across the screen skeleton 63, 263. The screen media 65 formed of solid rubber or urethane that is one inch or so thick may not be put under tension across the screen skeleton 63, 263.

Desirably, a plurality of adjustable mechanical fastening implements are deployed to hold the screen media 65 against the screen skeleton 63 or 263 under tension that is selectively variable by adjusting the adjustable mechanical fastening implements. As shown in FIG. 27 for example, the adjustable mechanical fastening implements desirably can include a plurality of threaded bolts 69*a* and mating threaded nuts 69*b*. As shown in FIG. 27 for example, the screen media 65 can be mounted on individual screen panels 51, which can take a variety of different forms. As shown in FIG. 27 for example, a front flat screen panel 51*a* carrying the screen media 65 desirably can include at least one tensioning flange 69*c* that is fastened to the screen media 65 as by welding for example and is bolted to the screen skeleton 63 by the threaded bolts 69*a* and mating threaded nuts 69*b*. As shown in FIGS. 27 and 28 for example, a front flat screen panel 51*a* carrying the screen media 65 desirably also can include an acute angled flange 69*d* that is a type of tensioning flange that is configured so that it can be hooked to the screen skeleton 63 without additional fastening elements like threaded bolts and nuts for example. Similarly, as shown in FIGS. 27 and 28 for example, one of the axially terminating edges of the screen media 65 carried by a rear flat screen panel 51*c* desirably can include a plurality of hook ends 69*e* that overhang and define one axially terminating edge of the main surface of the screen media 65. Moreover, these hook ends 69*e* are configured so that they can be hooked securely to a respective one of the rigid end pieces 63*b* of the screen skeleton 63 and withstand the tensioning forces that occur while the screening media is subjected to tensioning at least in the axial direction.

Referring to FIG. 27 for example, installing onto the screen skeleton 63 a panel 51*c* of the screening media 65 having at one end a plurality of hook ends 69*e* and a tensioning flange 69*c* at the opposite end becomes a relatively simple matter that begins with hooking the hook ends 69*e* to one of the rigid end pieces 63*b* of the screen skeleton 63. As the opposite end of the screening media 65 is pivoted down to rest on top of the screen skeleton 63, the gap 69*f* that is defined between two transversely extending tensioning flanges 69*c* receives therein the underlying axial brace 63*c* of the screen skeleton 63. Then the threaded bolts 69*a* are extended through the holes 69*g* that are defined through the tensioning flange 69*c* and aligned with the holes 63*g* (FIG. 26) that are defined through the transverse braces 63*d* of the screen skeleton 63. The mating threaded nuts 69*b* are rotatably screwed onto the threaded bolts 69*a* such that rotation of any the one nut 69*b* on the associated one bolt 69*a* varies the tension in the screen media 65 according to the degree of rotation of the one nut 69*b* on the one bolt 69*a*. A similar installation process pertains to the panel 51*a* of the screening media 65 having at one end an acute angled flange 69*d* and a tensioning flange 69*c* at the opposite end, except that the process begins with hooking the acute angled flange 69*d* to the one of the rigid end pieces 63*b* of the screen skeleton 63. Likewise, the middle panel 51*b* of screening media 65 depicted in FIG. 27 desirably has a tensioning flange 69*c* at each opposite end, each tensioning flange 69*c* being bolted to a respective different one of the transverse braces 63*d* of the screen skeleton 63 with the same bolts 69*a* and nuts 69*b* that are used to secure one of the tensioning flanges 69*c* of the panels 51*a*, 51*c* of screening media 65 at the opposite ends of the screen skeleton 63. Thus, as regards the middle panel 51*b* of the screening media 65 depicted in FIG. 27, at least a second tensioning flange 69*c* is bolted to the screen skeleton 63.

Figure 14:
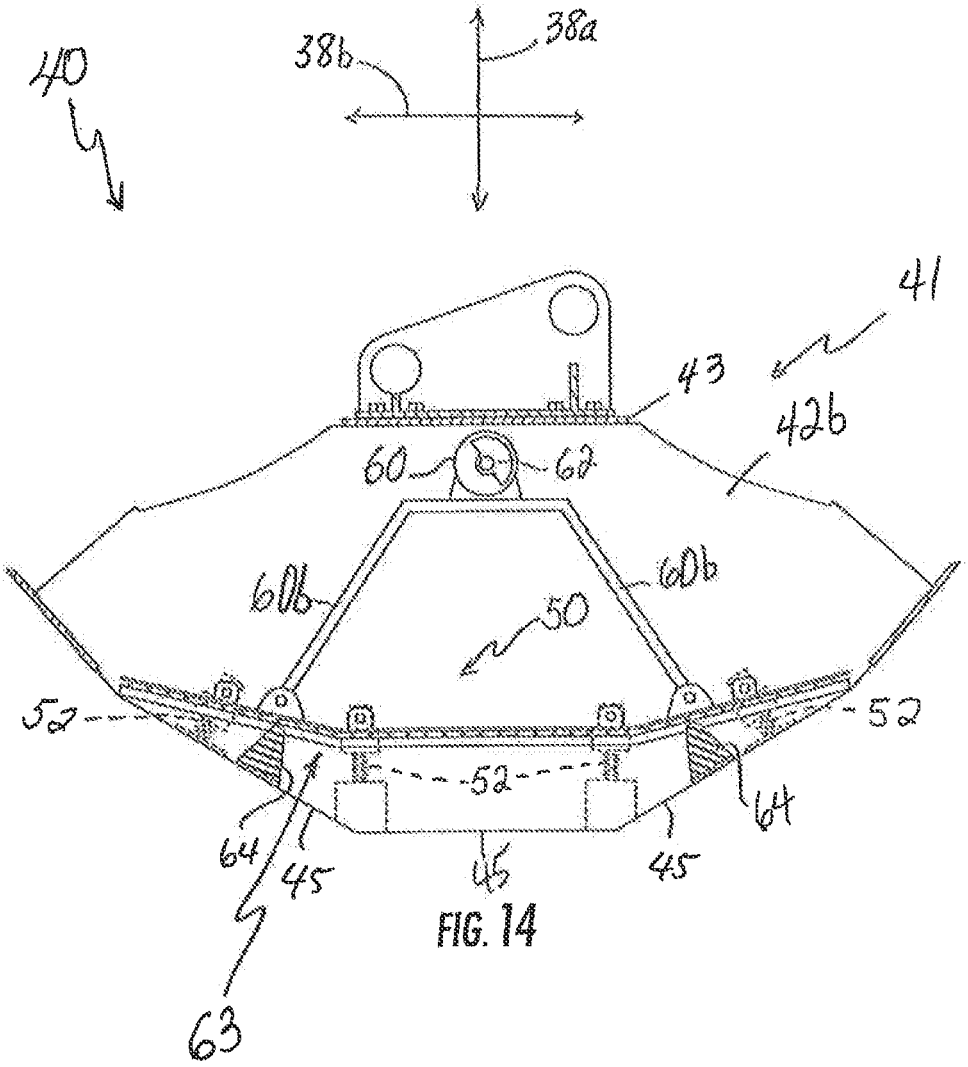
FIG. 14 is a partial schematic representation of a cross-sectional view of components of still another embodiment of the present invention from a view that is similar to the view depicted in FIG. 12.
Figure 16:
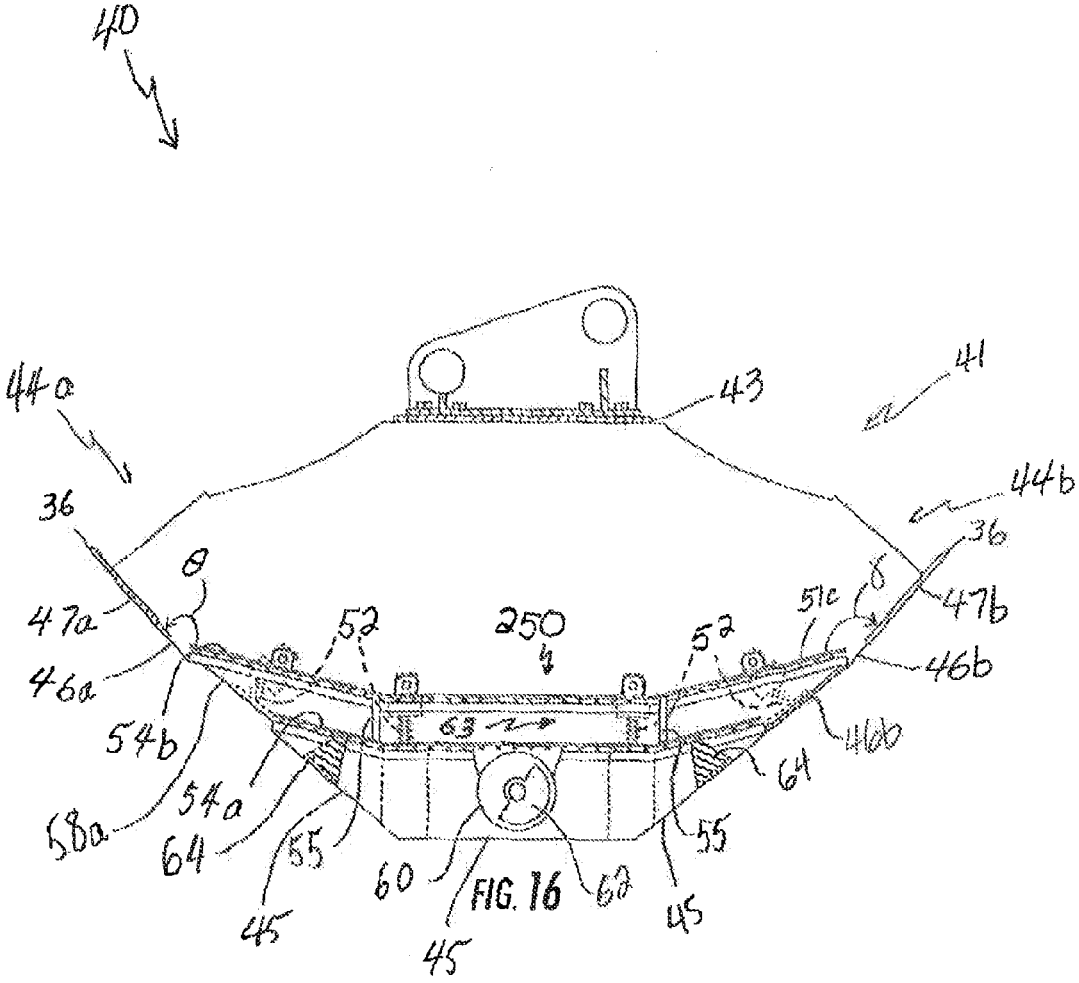
FIG. 16 is a partial schematic representation of a cross-sectional view of components of still another embodiment of the present invention from a view that is similar to the view depicted in FIG. 12.

However, as schematically shown in FIGS. 14, 15 and 16 for example, the screen skeleton 63 that supports and carries the screening mechanism 50 desirably is mechanically isolated from the frame of the scoop member 41 by a plurality of elastic supports 52 that are disposed between the screening mechanism 50 and the side panels 42*a*, 42*b* of the frame of the scoop member 41. These spring-loaded supports 52 are configured and installed so that the screening mechanism 50 can move relative to the scoop member 41. As schematically shown in FIG. 14 for example, such movements of the screening mechanism 50 relative to the scoop member 41 would have directional components in both the vertical direction indicated schematically by the two-headed arrow designated 38*a* and in the horizontal direction indicated schematically by the two-headed arrow designated 38*b*. Thus, overall movements of the screening mechanism 50 relative to the scoop member 41 would take on sort of an elliptically shaped orbit. However, the magnitude and velocity of such relative movement between the screening mechanism 50 and the scoop member 41 is constrained by the spring-loaded supports 52.

As shown in FIGS. 26, 27 and 34 for example, hang tabs 68 are formed integrally with or mechanically connected to each of the side arms 63*a* of each respective screen skeleton 63, 263. As schematically shown in FIG. 15 for example, the hang tabs 68 are spaced axially apart and extend generally vertically from the screen skeleton, providing sites for connecting the respective screen skeleton 63, 263 to the side panels 42*a*, 42*b* of the scoop member 41 so that the respective screen skeleton 63, 263 can be carried by the scoop member 41. Thus, as shown in FIGS. 26, 27, 28 and 34 for example, each of the hang tabs 68 of each respective screen skeleton 63, 263 is provided with a through hole 68*a*. As shown in FIG. 15 for example, each through hole 68*a* is configured to receive therethrough a connecting pin 52*a* that is a component of a spring-loaded support 52.

Figure 29:
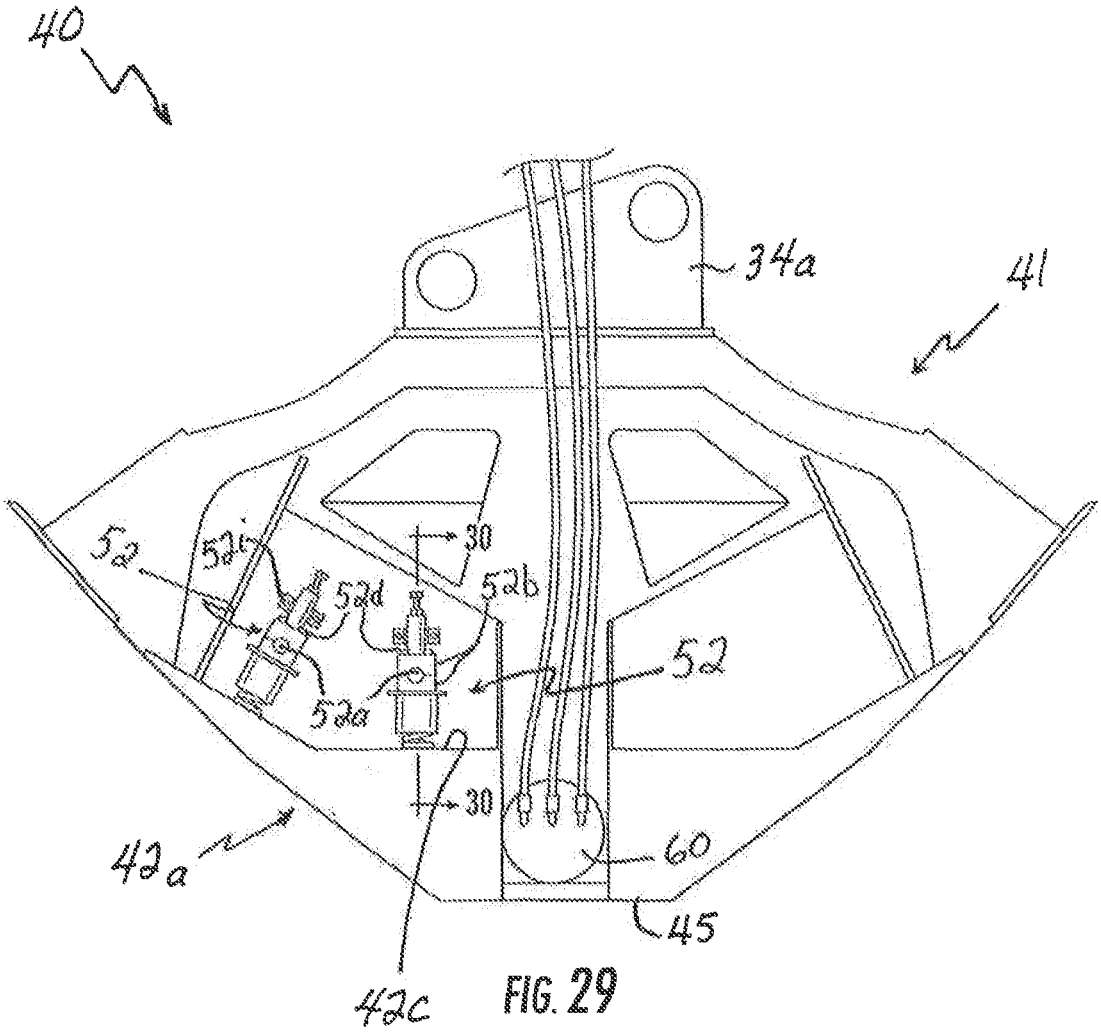
FIG. 29 is a partial schematic representation of components of yet another embodiment of the present invention with some features omitted so that certain structures otherwise hidden from view would become visible to the viewer.
Figure 30:
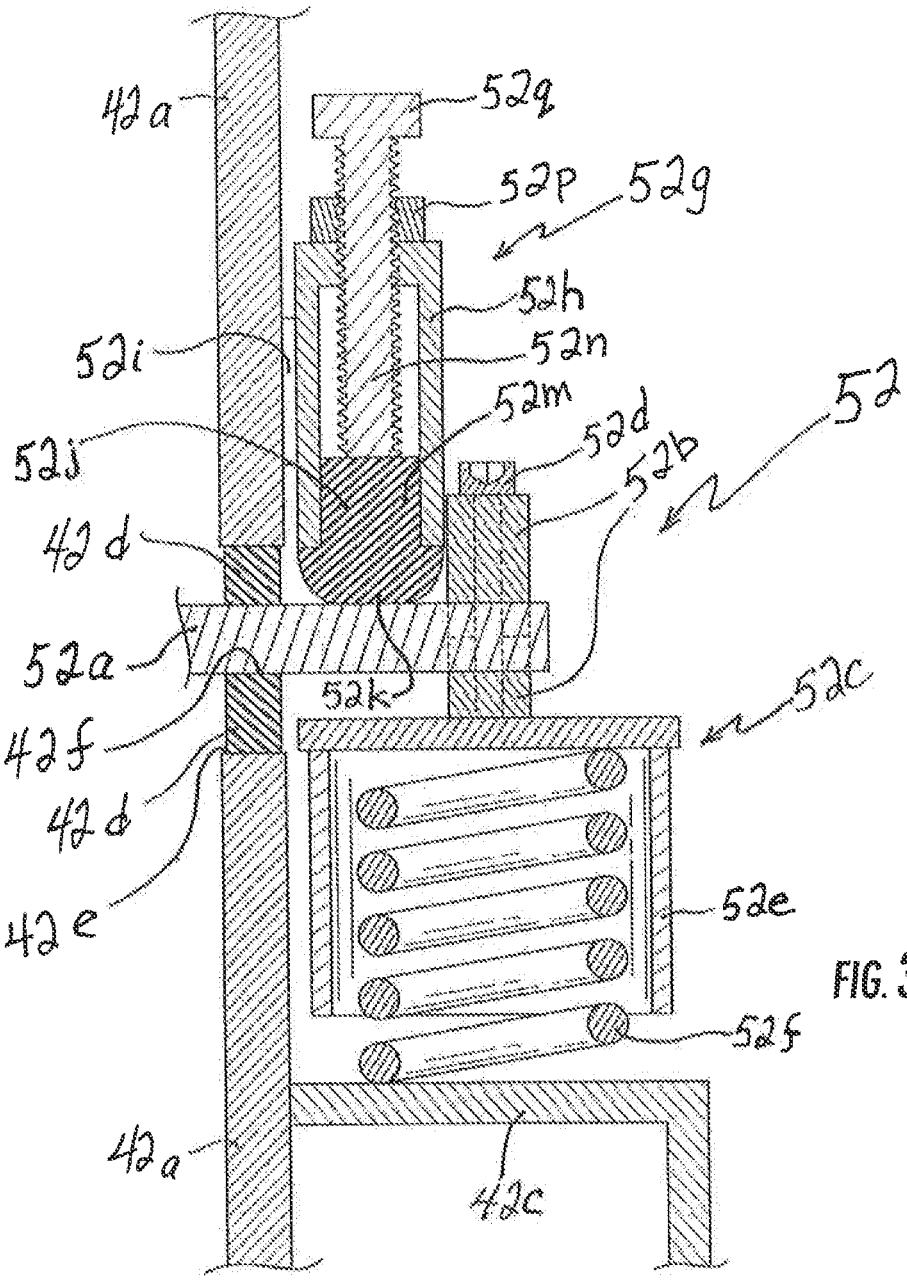
FIG. 30 is a cross-sectional view of embodiments of components of the present invention taken in the direction along the lines of the arrows designated 30—30 in FIG. 29.

FIG. 29 depicts a view taken from the exterior of one side of the bucket 40 and looking generally in the direction of the arrows 29, 29 in FIG. 15, but without the exterior facing, which normally would form the exterior wall of the side panel 42*a* covering the spring-loaded support 52 depicted in FIG. 29. As shown in FIGS. 29 and 30 for example, each connecting pin 52*a* forms a component of a spring-loaded support 52 and desirably is formed as a steel rod. As shown in FIG. 30 for example, the connecting pin 52*a* passes through an opening 42*e* defined through the main wall of the side panel 42*a* of the scoop member 41. A heavy duty rubber sleeve gasket 42*d* is fitted within the wall opening 42*e* and defines a generally centrally located aperture 42*f* that desirably surrounds the portion of a connecting pin 52*a* passing through the wall opening 42*e* and so serves to shield the connecting pin 52*a* from wear against the wall opening 42*e* during movement of the screening mechanism 50 with respect to the frame of the scoop member 41.

As schematically shown in FIG. 15 for example, the screening mechanism 50 desirably is disposed into the rigid frame defined by the side panels 42*a*, 42*b* of the scoop member 41 in a very tight fit. Accordingly, as shown in FIG. 15 for example, rubber side panels 49 are mounted to the inwardly facing surfaces of the side panels 42*a*, 42*b* of the scoop member 41. These rubber side panels 49 are disposed between the frame of the scoop member 41 and the longitudinally extending edges of the screen panels 51*a*, 51*b*, 51*c* of the screening mechanism 50 to prevent spillage of material therebetween and creating a seal between the longitudinally extending edges of the screen panels 51*a*, 51*b*, 51*c* and the respective adjacent side panels 42*a*, 42*b* of the scoop member 41. Moreover, as shown in FIG. 15 for example, each of the leading and trailing edges of each rubber side panels 49 is received within its own steel protector 49*a* that has an angled exterior surface to deflect material entering the forward end 44*a* or backward end 44*b* of the scoop member 41.

As shown in FIG. 12 for example, the screening mechanism 50 defines a forward free edge 53*a* and a rearward free edge 53*c*. As shown in FIG. 12 for example, in embodiments of the screening mechanism 50 defining at least two flat screen panels, a front panel 51*a* desirably defines the forward free edge 53*a* of the screening mechanism 50 and a rear panel 51*c* desirably defines the rearward free edge 53*c* of the screening mechanism 50. In the embodiment schematically shown in FIGS. 6 and 12 for example, a plurality of screen panels 51*a*, 51*b*, 51*c* is depicted as forming a screening mechanism 50 disposed at the bottom 45 of the scoop member 41. In the embodiments of the screening mechanism 50 depicted in FIGS. 6, 12, 27 and 28, each of two screen panels 51*a* or 51*c* at each opposite end of the screening mechanism 50 forms an angle with a center panel 51*b* of the screening mechanism 50. However, embodiments with more than three screen panels 51 and more variety in the magnitudes of each angle that lies between any two screen panels 51 are contemplated.

In the embodiments depicted in FIGS. 6, 12, 27 and 28, each of the individual screen panels 51*a*, 51*b*, 51*c*, which are connected together end-to-end to form the screening mechanism 50, extends in only two dimensions and lies in a single plane. However, in other embodiments of screening mechanisms 50, 250 there need only be a single screen panel 51 that desirably forms a continuous surface. That single screen panel 51 having a continuous surface of screen media 65 can be shaped in as many different ways as there are ways for the screen skeleton 63, 263 to be configured to support the screen panel 51. For example, the continuous surface of screen media 65 could be formed as a curved surface with a concave shape facing toward the top 43 of the scoop member 41 and a convex shape facing toward the bottom 45 of the scoop member 41. The shape of a longitudinal cross-section cut through such a single curved screen panel 51 can resemble a banana in shape. Moreover, embodiments of a screening mechanism 50 can have screen panels 51 that define a curved longitudinal cross-section as well as a curved transverse cross-section, or one or the other. The shape of a longitudinal cross-section cut through such a curved screen panel 51 desirably can be shaped to form a catenary or a parabola, but screen panels 51 with other longitudinal cross-sectional shapes can be employed. In each case, the screen skeleton 63, 263 will be configured to accommodate the shapes of the screen panels 51 that are to be carried by the screen skeleton 63, 263. For example, the screen skeleton 63, 263 can include arch supports on which the screen media 65 can be stretched to form a perfect convex shape or a perfect concave shape. Alternatively, steel cloth forming the screen media 65 could be prebent to form the shape of a such an arch.

Figure 25:
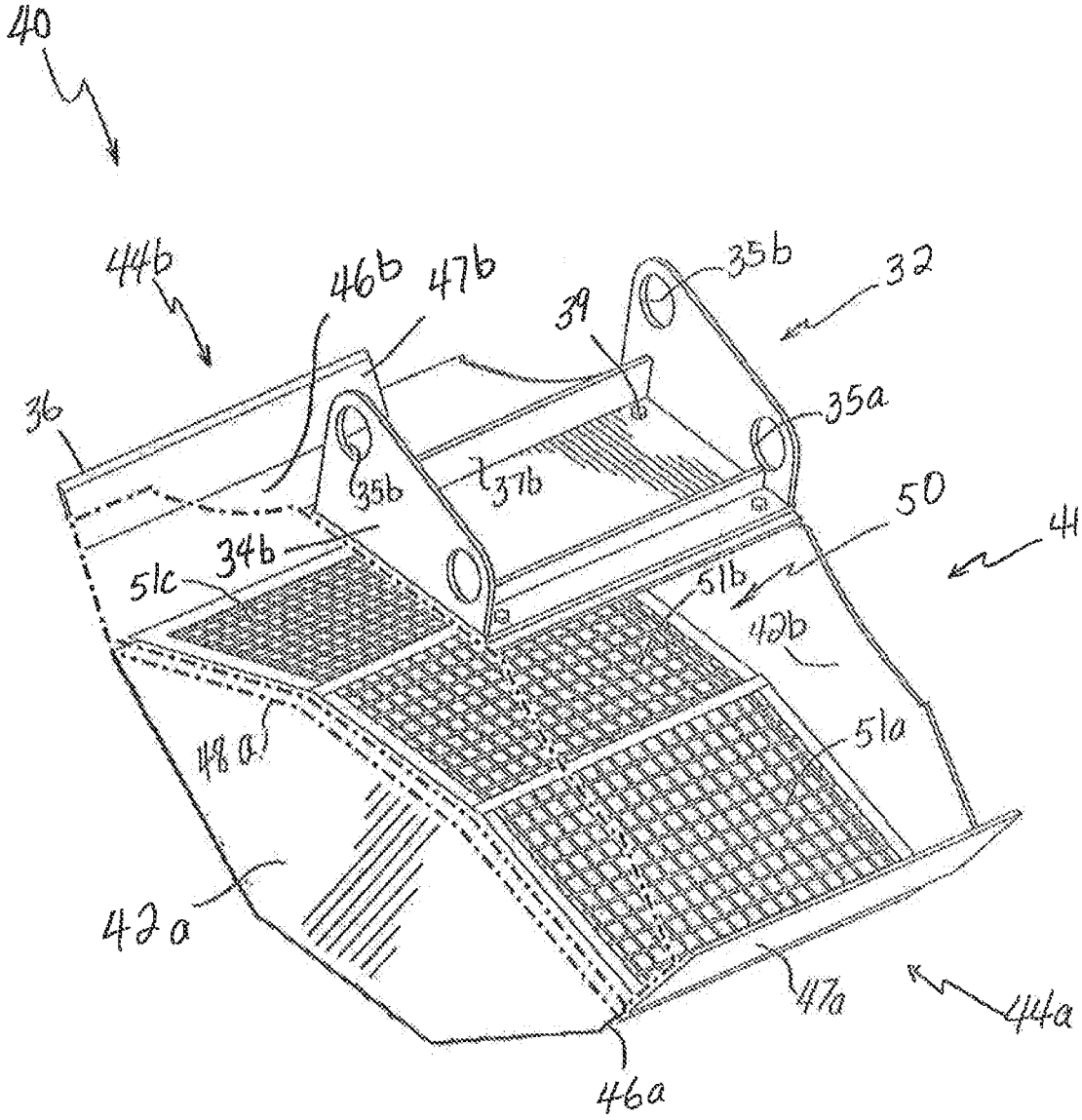
FIG. 25 is a perspective view of embodiments of components of the present invention with certain features shown in chain-dashed line for purposes of illustrating features that ordinarily would not be visible in the view shown.

Moreover, as schematically shown in FIG. 25 for example, an embodiment of a screening mechanism 50 can include individual flat screen panels 51*a*, 51*b*, 51*c* that connected together end-to-end form a curved surface with a generally convex shape facing toward the top 43 of the scoop member 41 and a concave shape facing toward the bottom 45 of the scoop member 41 also can be employed. Additionally, though not shown in FIG. 25, a single curved screen panel can form the screening mechanism 50 with a convex shape similar to the shape shown in FIG. 25.

In the embodiment of the screening mechanism depicted in FIGS. 6 and 12 for example, three flat screen panels 51*a*, 51*b*, 51*c* are connected so that a middle panel 51*b* is disposed so as to lie in a plane that is parallel with the plane of the top 43 of the frame defining the scoop member 41. As schematically shown in FIG. 12 for example, the front panel 51*a* lies in a plane that is disposed at an angle $\alpha$ with respect to the forward edge of the middle panel 51*b*, and the rear panel 51*c* lies in a plane that is disposed at an angle $\beta$ with respect to the rearward edge of the middle panel 51*b*. While each angle $\alpha$, $\beta$ can range between 90 and 180 degrees, with the 180 degree angle being a flat screen in which the screening mesh lies in a flat plane, each angle $\alpha$, $\beta$ angle desirably falls in a range of 150 to 165 degrees. Moreover, embodiments of the screening mechanism 50 desirably can include more than three flat screen panels, and the angles between successive panels can be smaller while still achieving the desired overall curvature that fewer panels can achieve with larger angles between the successive panels. As noted above, in a further alternative embodiment to embodiments that employ one or more separate flat screen panels (e.g., 51*a*, 51*b*, 51*c*), the screen mesh in the screen panel can assume a curved shape employed in one or more separate curved screen panels. As shown in FIGS. 6 and 12 for example, some embodiments of the screening mechanism 50 desirably define a shape that generally resembles a banana-shaped profile, concave facing toward the top 43 of the scoop member 41 and toward the material that is to be screened and convex facing toward the bottom 45 of the scoop member 41. Moreover, a banana-shaped profile of some embodiments of the screening mechanism 50 can be formed with a plurality of curved screen panels arranged successively end-to-end instead of the flat screen panels 51*a*, 51*b*, 51*c* shown in FIGS. 6 and 12 for example.

Figure 7:
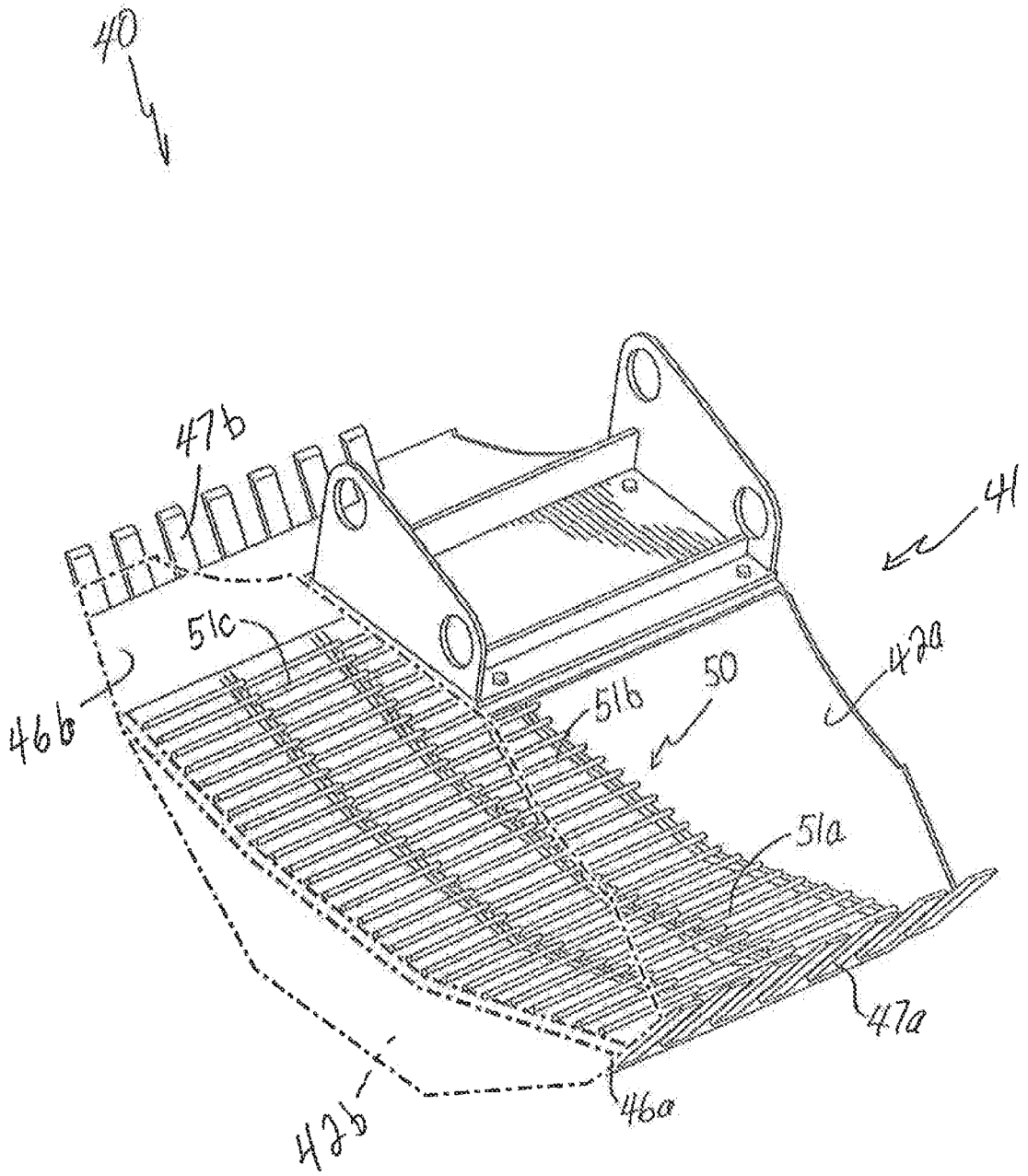
FIG. 7 is a perspective view of embodiments of components of the present invention with certain features shown in chain-dashed line for purposes of illustrating features that ordinarily would not be visible in the view shown.
Figure 8:
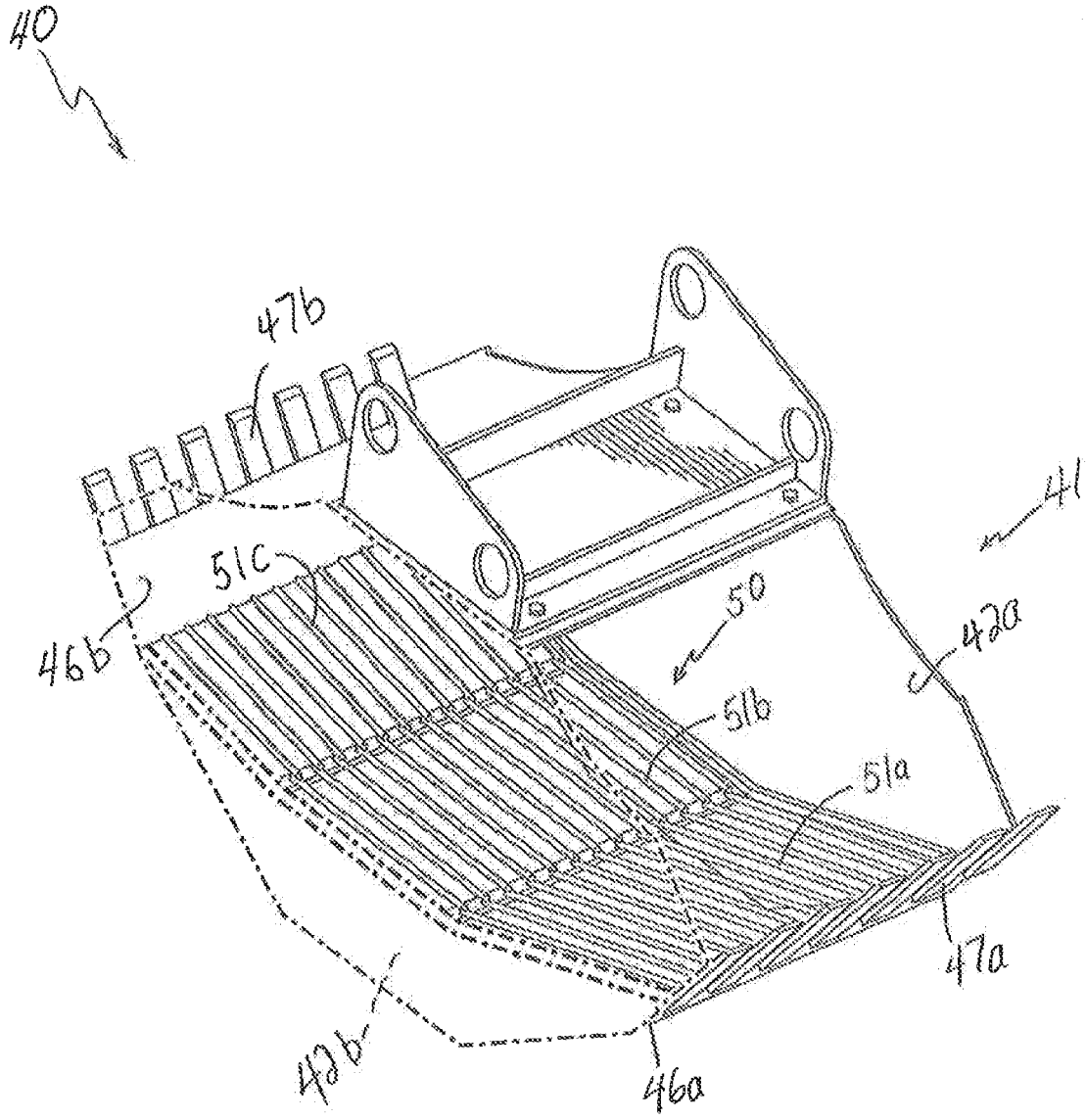
FIG. 8 is a perspective view of embodiments of components of the present invention with certain features shown in chain-dashed line for purposes of illustrating features that ordinarily would not be visible in the view shown.

Though the screening panels 51*a*, 51*b*, 51*c* depicted in FIGS. 6, 25, 27 and 28 are configured with a square pattern of openings, other opening shapes and sizes are possible according to the wishes of the operator. In the embodiment of FIG. 7, the screening surface is continuous and is defined by rectangular openings having the longer sides of the openings extending in the direction that is normal to the side panels 42*a*, 42*b* of the scoop member 41. In the embodiment of FIG. 8, the screening surface is continuous and is defined by rectangular openings having the longer sides of the openings extending in the direction that is parallel to the side panels 42*a*, 42*b* of the scoop member 41.

In accordance with the present invention, the excavating bucket apparatus 40 is configured to "retain" at least one category of oversize product until the operator decides to deposit each category in a separate pile. Fine material will pass through the screening mechanism 50 on any angle, including horizontal, i.e., normal to the direction of the gravitational force. However, as shown in FIGS. 6 and 12 for example, the scoop member 41 defines at one opposite end 44*a* a front wall 46*a* and a rear wall 46*b* at the other opposite end 44*b* of the scoop member 41. Each of the front wall 46*a* and the rear wall 46*b* of the scoop member 41 terminates in a respective edge portion 47*a*, 47*b* at the respective free end thereof. The material that does not pass through the screening mechanism 50 can be retained by the edge portions 47*a*, 47*b*, which are disposed at a more severe angle upwards towards the top 43 of the scoop member 41 relative to the nearby portion of the screening mechanism 50.

In the embodiments of the excavating bucket apparatus depicted in each of FIGS. 6-8, 12 and 15 for example, the respective edge portion 47*a*, 47*b* of each of the front wall 46*a* and the rear wall 46*b* of the scoop member 41 desirably terminates in a plurality of tooth-like flat bars that define chamfered free edges. Alternatively, as shown in FIG. 25, the respective edge portion 47*a*, 47*b* of each of the front wall 46*a* and the rear wall 46*b* of the scoop member 41 terminates in a continuous blade that defines a chamfered free edge 36. In either case, as shown in FIGS. 6-8, 12, 15 and 25 for example, the respective edge 47*a*, 47*b* portion of each of the front wall 46*a* and the rear wall 46*b* of the scoop member 41 lies in a plane that is disposed at an angle with respect to the plane in which lies the leading front screen panel 51*a* or the trailing rear screen panel 51*c* of the screening mechanism 50. As schematically shown in FIG. 12 for example, the edge 47*a* portion of the front wall 46*a* lies in a plane that is disposed at a forward angle $\theta$ with respect to the plane in which the leading forward free edge 53*a* of the front screen panel 51*a* lies, and the edge 47*b* portion of the rear wall 46*b* lies in a plane that is disposed at a rearward angle γ with respect to the plane in which the trailing rearward free edge 53*c* of the rear screen panel 51*c* lies. While each angle θ, γ can range between 30 and 50 degrees, each angle θ, γ desirably falls in a range of 35 to 55 degrees and further desirably is disposed at an angle of about 50 degrees. Moreover, in some embodiments, each respective angle θ and angle γ will be different, while in other embodiments the angle θ will have the same magnitude as the angle γ.

This feature of the angled edge portions 47*a*, 47*b* of the excavating bucket apparatus 40 of the present invention gives the operator options. This feature of the angled edge portions 47*a*, 47*b* allows the operator to tilt the scoop member 41 while screening and creates a more drastic angle, which may be beneficial when screening. This feature of the angled edge portion 47*a*, 47*b* gives the operator a great deal of control. If for example the material that entered the scoop member 41 is not screened to the desired extent, then the operator can tilt the scoop member 41 in the opposite direction until the oversize material hits the opposing upturn angled edge portion 47*a* or 47*b*.

The overall shape of the scoop member 41 including the extra angle θ, γ on the opposed cutting edges/digging edges 47*a*, 47*b* at each opposite end 44*a*, 44*b* of the scoop member 41, allows material to pass and retains oversize material for future discharge. The overall shape of the scoop member 41 is specifically designed so that the operator can maximize the angle of the scoop member 41 relative to the articulating arm 31 to which the scoop member 41 is pivotally connected while adjusting the angle of the screening surfaces (e.g., 51*a*, 51*b*, 51*c*) of the screening mechanism 50 relative to the direction of the force of gravity and retaining oversize material without the use of gates. Therefore, the overall shape of the scoop member 41 provides a simple way to screen without additional gates or gadgets.

As shown in FIG. 31 for example, some embodiments of the scoop member 41 desirably can include at least one grizzly bar 59. In the embodiment shown in FIG. 31, each grizzly bar 59 desirably is disposed extending across one of the open opposed ends 44*a* and/or 44*b* of the scoop member 41. In the embodiment shown in FIG. 31, each grizzly bar 59 desirably has a first end connected to the top 43 of the scoop member 41 and a second end connected to the respective front wall 46*a* or rear wall 46*b* of the scoop member 41. In alternative embodiments, the opposite ends of each grizzly bar 59 can be variously attached to different parts of the scoop member 41, including the side panels 42*a*, 42*b* of the scoop member 41. In the embodiment shown in FIG. 31, there are two grizzly bars 59 disposed across the open forward end 44*a* of the scoop member 41 and two grizzly bars 59 disposed across the open backward end 44*b* of the scoop member 41. The grizzly bars 59 so disposed function to prevent large chunks of debris and/or excavation material dropping from above directly onto the vibratory mechanism 60 (described below) and/or the top side of the screening mechanism 50 or 250 and thereby damaging the vibratory mechanism 60 (described below) and/or the screening mechanism 50 or 250 in the bottom of the scoop member 41 when the bucket apparatus 40 is digging into a pile of debris. The grizzly bars 59 also will absorb much of the stress of digging through a pile of debris and/or excavation material rather than having that digging stress transmitted to the vibratory mechanism 60 or the screening mechanism 50 or 250. The grizzly bars 59 also prevent extra large chunks of debris and/or excavation material from clogging the openings in the screening mechanism 50 or 250. Accordingly, as shown in FIG. 31 for example, the bucket apparatus 40 further comprises at least one grizzly bar 59 that is configured and disposed so as to extend above and in front of a double deck screening mechanism 250. Such screening mechanism 250 desirably can include screening media 65 such as shown in FIG. 27 having a plurality of the hook ends 69*e* by which the screening media 65 is hooked to the screen skeleton 63 or 263. The grizzly bars can be spaced apart at desired distances depending on the application. More grizzly bars 59 or fewer grizzly bars 59 could be added at the desire of the user. Additionally, the grizzly bars 59 can be arranged in a lattice structure as a tic-tac-toe grid or in a configuration in which at least one grizzly bar 59 crosses another grizzly bar 59 so as to form the letter "X" or a plus sign "+."

Figure 31A:
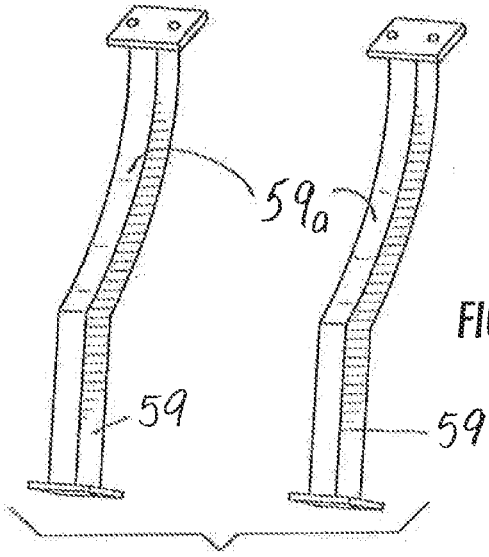
FIG. 31A is a perspective view of embodiments of components of the present invention depicted in FIG. 31.

In the embodiment shown in FIGS. 31 and 31A, each grizzly bar 59 desirably includes a section that defines a surface 59*a* with a concave curvature. As shown in FIG. 31, the surface 59*a* with a concave curvature of each grizzly bar 59 desirably is disposed so as to face away from the one open opposed end 44*a* or 44*b* of the scoop member 41. This concave surface 59*a* provides a cradle in which large chunks of debris and/or excavation material that cannot bypass the grizzly bars 59 and thus cannot gain entrance into the scoop member 41, can be carried by the scoop member 41 until such chunk or chunks is/are offloaded into a collection area for similarly sized chunks of debris and/or excavation material. Accordingly, the provision of one or a plurality of grizzly bars 59 functions as yet another size-based differentiator of debris and/or excavation material.

While horizontal screens, i.e., screens disposed to extend in a plane that is normal to the direction of the force of gravity, allow material to stay on the horizontal screen for a given period of time, separating material with a conventional horizontal screening mechanism is subject to limitations on the efficiency with which the screen surface can be used. For due to the so-called hour-glass effect, only the area of the screen that receives the material can be used in the screening operation. Thus, if a bucket drops material on the screen, only the screen's area directly affected by being beneath the bucket's so-called drop zone is being used. The rest of the screen does not receive any material to be screened. The dropped contents of the bucket forms a mound of material on top of the area of the screen beneath the bucket's drop zone, and so it takes a while for that mound of material to filter through the screen, sort of like an hour glass works. If the material is too big to pass through the screen, then that area of the screen beneath this oversized material becomes clogged and thus unavailable to filter any additional material until the clog is cleared. Moreover, even if the screen is vibrated, vibration of the screen results in only a little additional area of the screen being used than the area that was covered by the initial drop of material on top of the screen.

Because embodiments of the scoop member 41 of the excavating bucket apparatus 40 of the present invention define a top 43 that is configured for pivotal connection to the articulating arm 31 of the mobile vehicle 30, the scoop member 41 has the ability to rock back and forth from one end 44*a* of the scoop member 41 to the opposite end 44*b* of the scoop member. As schematically illustrated in FIGS. 2A through 2F for example, as the scoop member 41 pivots to change the orientation of the surfaces 51*a*, 51*b*, 51*c* of the screening mechanism 50 (not visible in view depicted in these FIGS. 2A through 2F) with respect to the direction of the force of gravity, any material that initially is dropped over one area of the screening surface and that does not immediately pass through the screening surface becomes redirected to engage other areas of the screening surface through which the material might pass and thus vacates the initial drop zone area of the screening surface and so enables smaller material to pass through the vacated area of the screening surface. Using the excavating bucket apparatus 40 of the present invention rather than a conventional screening device significantly shortens the time needed to completely filter one load of material of any given volume. Thus, whether one measures per unit of time or per volume of material dumped onto the screening mechanism 50, by employing the excavating bucket apparatus 40 of the present invention, more of the screening area becomes involved in active filtering of material, thus in effect increasing the useful screening area without increasing the physical size of the screening surface. Accordingly, when compared to conventional material separation machinery, the excavating bucket apparatus 40 of the present invention can do more work in less time and thereby significantly shorten the time needed to recover the operator's investment made in purchase or leasing of the excavating bucket apparatus 40 of the present invention.

Moreover, tilting the scoop member 41 of the excavating bucket apparatus 40 of the present invention is also advantageous since screen angle can be very important to proper screening. Having a screen angle with a steep incline may be necessary for certain difficult materials that simply will not "walk" down a horizontal screen. Tilting the screen at a steeper incline while the screen is operating or not, allows gravity to work and makes the excavating bucket apparatus 40 of the present invention more versatile than conventional separation apparatus. Traditional screens mounted on steel stands or portable frames are typically not angle adjustable relative to the direction of the gravitational force. In any case, the excavating bucket apparatus 40 of the present invention provides a simpler and more efficient way to change the angle at which the screen of the separation apparatus is disposed with respect to the direction of the force of gravity.

Figure 2A:
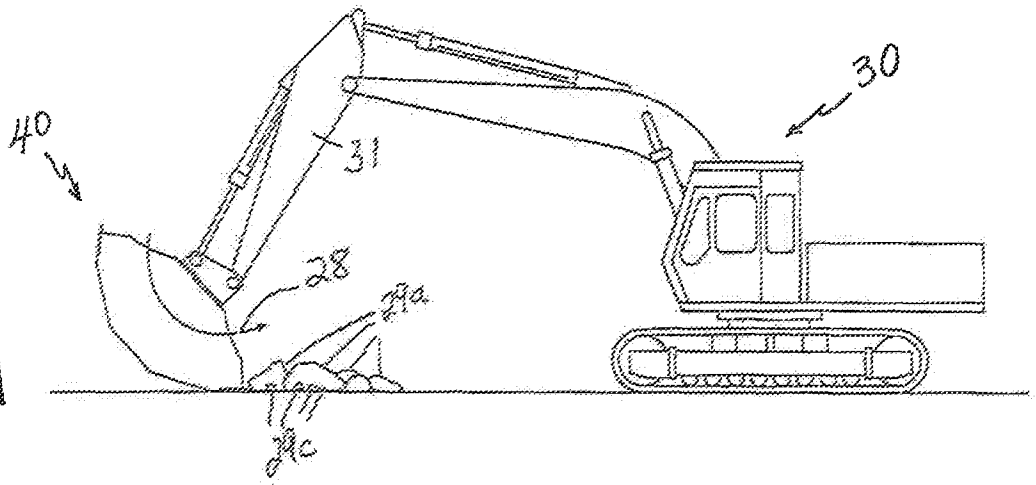
FIG. 2A is a side plan view of an embodiment of the present invention in one operating mode in which material to be screened is inputted from the rear.
Figure 2B:
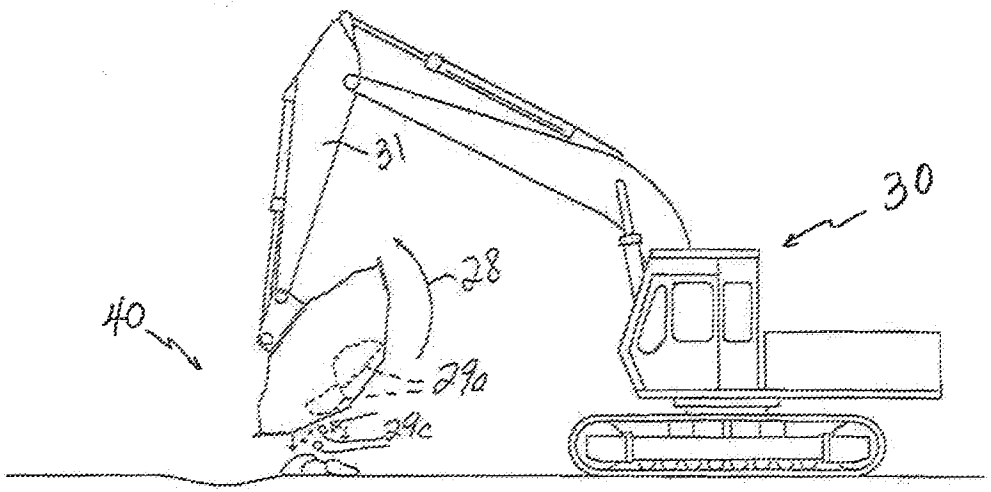
FIG. 2B is a side plan view of an embodiment of the present invention in another operating mode in which material inputted from the rear is being screened.
Figure 2C:
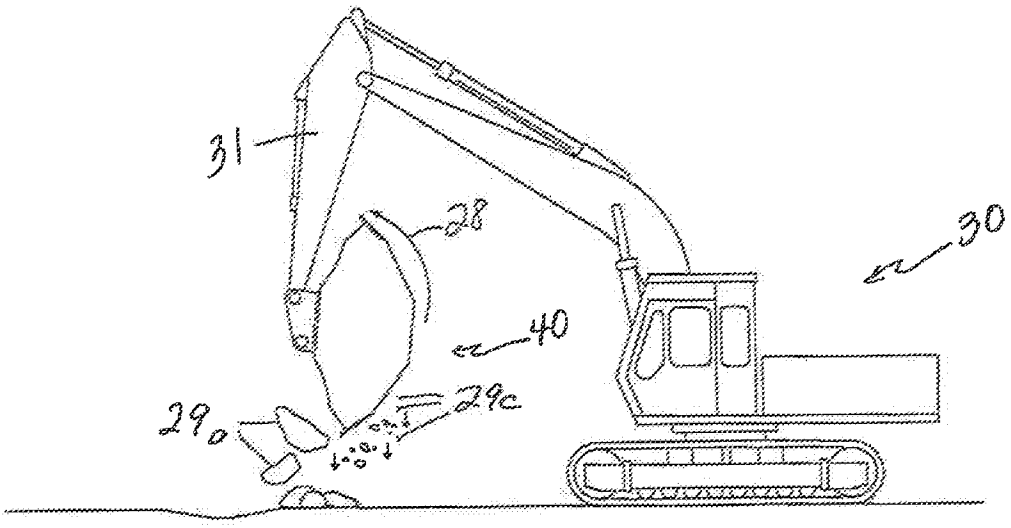
FIG. 2C is a side plan view of an embodiment of the present invention in another operating mode in which material inputted from the rear is being screened and oversized material is being discharged from the front.
Figure 2D:
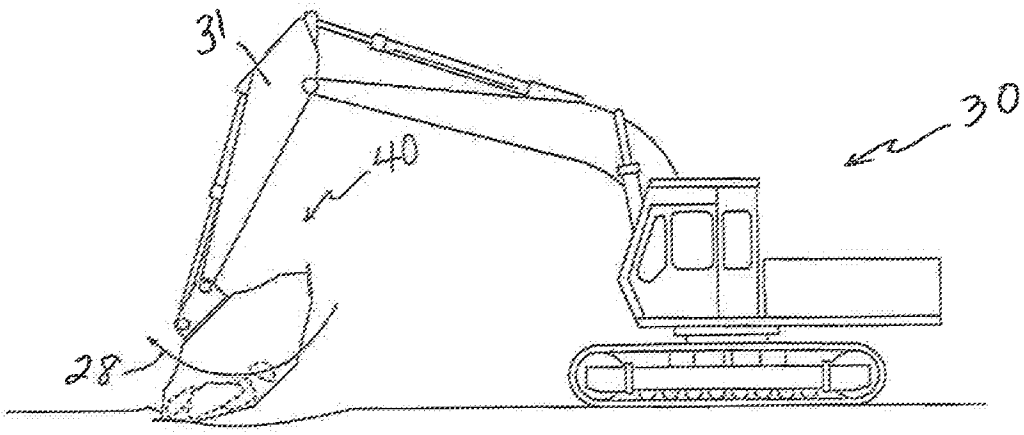
FIG. 2D is a side plan view of an embodiment of the present invention in another operating mode operating mode in which material to be screened is inputted from the front.
Figure 2E:
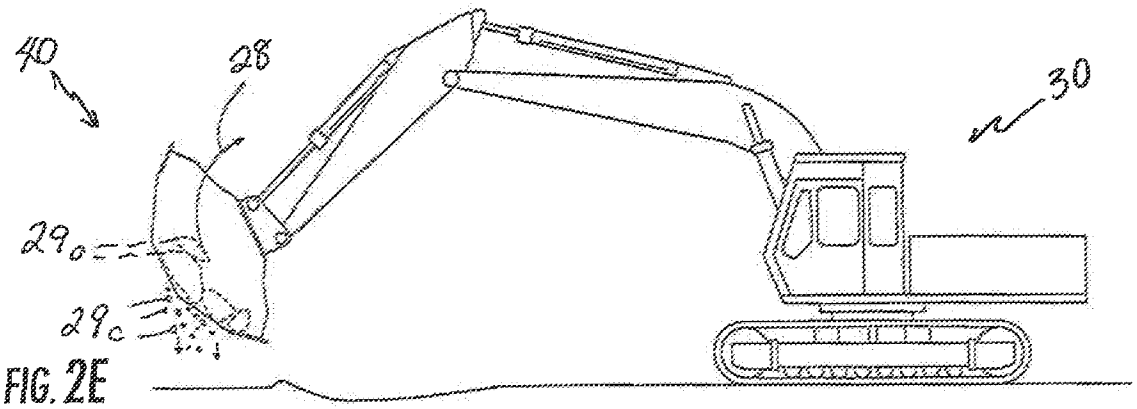
FIG. 2E is a side plan view of an embodiment of the present invention in another operating mode in which material inputted from the front is being screened.

The ability of the scoop member 41 to be rocked back and forth and the ability of the scoop member 41 to discharge oversize material from either opposite end 44*a*, 44*b* of the scoop member 41 enable very efficient operation of the excavating bucket apparatus 40 of the present invention. The operator of the excavating bucket apparatus 40 of the present invention is not limited to discharging from only one opposite end 44*a* or 44*b* of embodiments of the scoop member 41. The efficiency of movement of the excavating bucket apparatus 40 of the present invention allows the operator to immediately scoop another load of material from the end of the scoop member 41 from which was made the last discharge of the oversize material. This feature of the angled edge portions 47*a*, 47*b* reduces costs attributable to machine down-on time and fuel usage, etc. Because of this feature of the angled edge portions 47*a*, 47*b*, the operator also is not limited to digging from only one end 44*a* or 44*b* of embodiments of the scoop member 41. The excavating bucket apparatus 40 of the present invention can be used as a shovel as schematically depicted in FIG. 2D or a standard bucket that works/pulls towards the operator as schematically depicted in FIG. 2A. Having the ability to dig from either end 44*a* or 44*b* of embodiments of the scoop member 41 and dump from either end 44*a* or 44*b* of embodiments of the scoop member 41 saves time and increases overall production. Having the ability to dig from either end 44*a* or 44*b* of embodiments of the scoop member 41 and dump from either end 44*a* or 44*b* of embodiments of the scoop member 41 also may be beneficial in more confined work areas where space to maneuver is limited.

As shown in FIGS. 16-20 and 24 for example, embodiments of the screening mechanism 50 desirably can be configured as a multi-tiered structure. While the embodiments of multi-tiered screening mechanisms depicted schematically in FIGS. 16-20 and 24 are double-deckers with two screen decks 54*a*, 54*b* stacked one atop the other one, additional tiers beyond just two can be added. However, for the sake of brevity, only a double-deck embodiment will be described in any detail and should suffice as the basis for extrapolation to additional decks added in the same manner as the top screen deck 54*b* is disposed above the bottom screen deck 54*a*. As shown in FIG. 16 for example, the screening mechanism 50 desirably can be configured to define a bottom deck 54*a* and a top deck 54*b* disposed between the bottom deck 54*a* and the top 43 of the scoop member 41. As shown in FIG. 34 for example, a double-deck screen skeleton 263 desirably forms the support carriage for both a bottom deck 54*a* and a top deck 54*b* of a double-deck screening mechanism 250.

Figure 18:
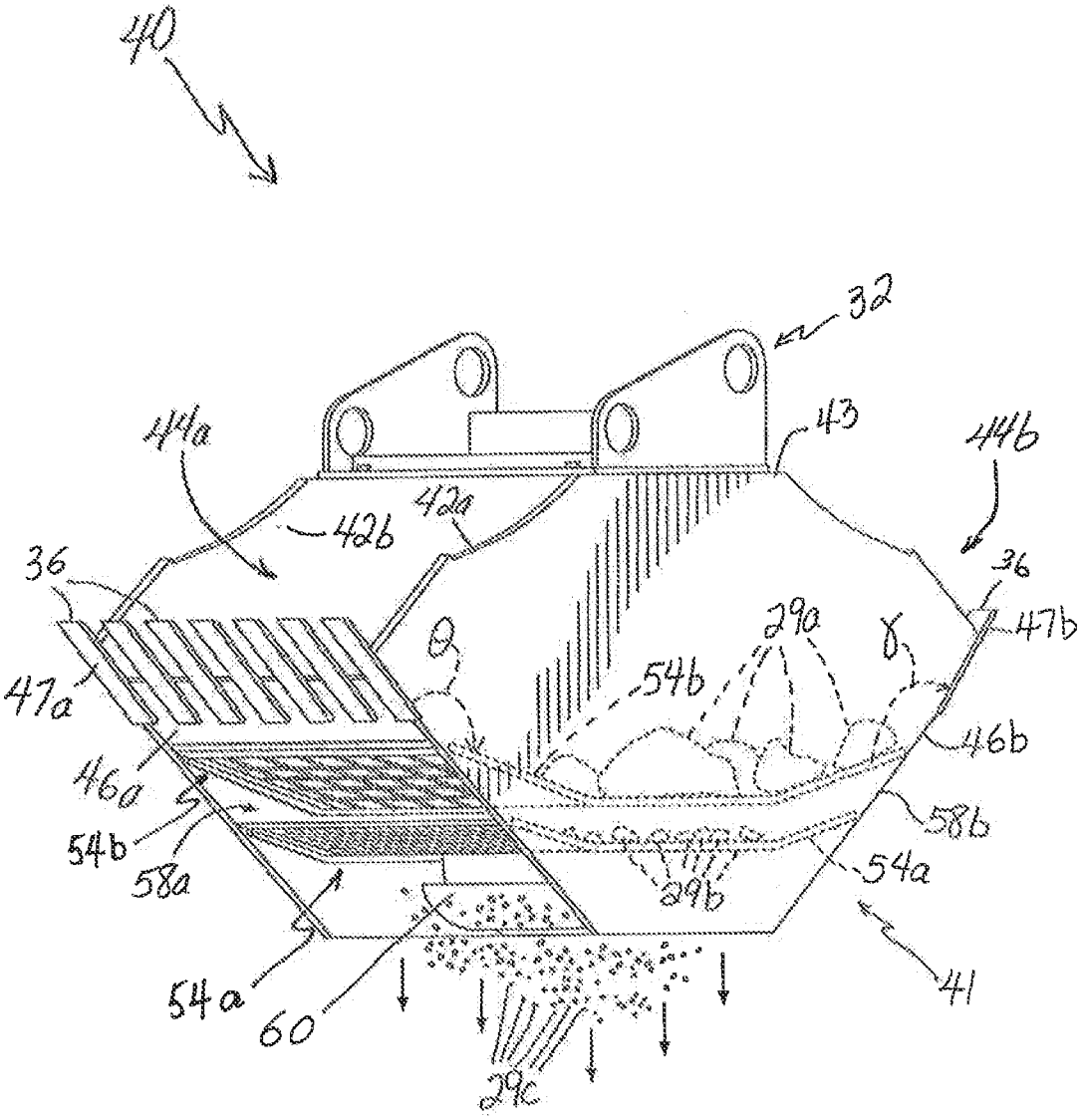
FIG. 18 is an elevated perspective view with certain structures otherwise hidden from view indicated by dashed line and illustrating operation of an embodiment similar to that shown in FIG. 16 in an operating mode in which material inputted from the rear is being screened in a manner that would be similar to what would occur intermediate the orientation and operating condition depicted in FIG. 2A and the orientation and operating condition depicted in FIG. 2B.

As shown in FIG. 18 for example, in some tiered embodiments there is defined a front discharge opening 58*a* between the two decks 54*a*, 54*b* and a rear discharge opening 58*b* between the two decks 54*a*, 54*b*. As shown in FIG. 18 for example, the front wall 46*a* of the scoop member 41 meets and terminates at the front end of the top screen deck 54*b* to partially define the front discharge opening 58*a* between the two decks 54*a*, 54*b* and between the two opposed side panels 42*a*, 42*b* of the scoop member 41. Similarly, the rear wall 46*b* of the scoop member 41 meets and terminates at the rear end of the top screen deck 54*b* to partially define the rear discharge opening 58*b* between the two decks 54*a*, 54*b* and between the two opposed side panels 42*a*, 42*b* of the scoop member 41. In such embodiments, material 29*b* that is too large to pass through the openings in the screening material forming the bottom screen deck 54*a* can be discharged by passing through either the front discharge opening 58*a* between the two decks 54*a*, 54*b* at the front end 44*a* of the scoop member 41 or the rear discharge opening 58*b* between the two decks 54*a*, 54*b* at the rear end 44*b* of the scoop member 41.

Alternatively, in some embodiments of the excavating bucket 40 of the present invention, it is desirable to restrict passage of material 29*b* that is too large to pass through the openings in the screening material forming the bottom screen deck 54*a* to be discharged from only one of either the front discharge opening 58*a* or the rear discharge opening 58*b* between the two decks 54*a*, 54*b*. As shown in FIG. 16 for example, the scoop member 41 only has a front discharge opening 58*a* at the front end 44*a* of the scoop member 41. In the FIG. 16 embodiment, the rear wall 46*b* of the scoop member 41 meets the rear end of the bottom screen deck 54*a* and extends to the edge portion 47*b* of the rear wall 46*b* of the scoop member 41, thereby eliminating any rear discharge opening 58*b* between the two decks 54*a*, 54*b* at the rear end 44*b* of the scoop member 41.

Figure 24:
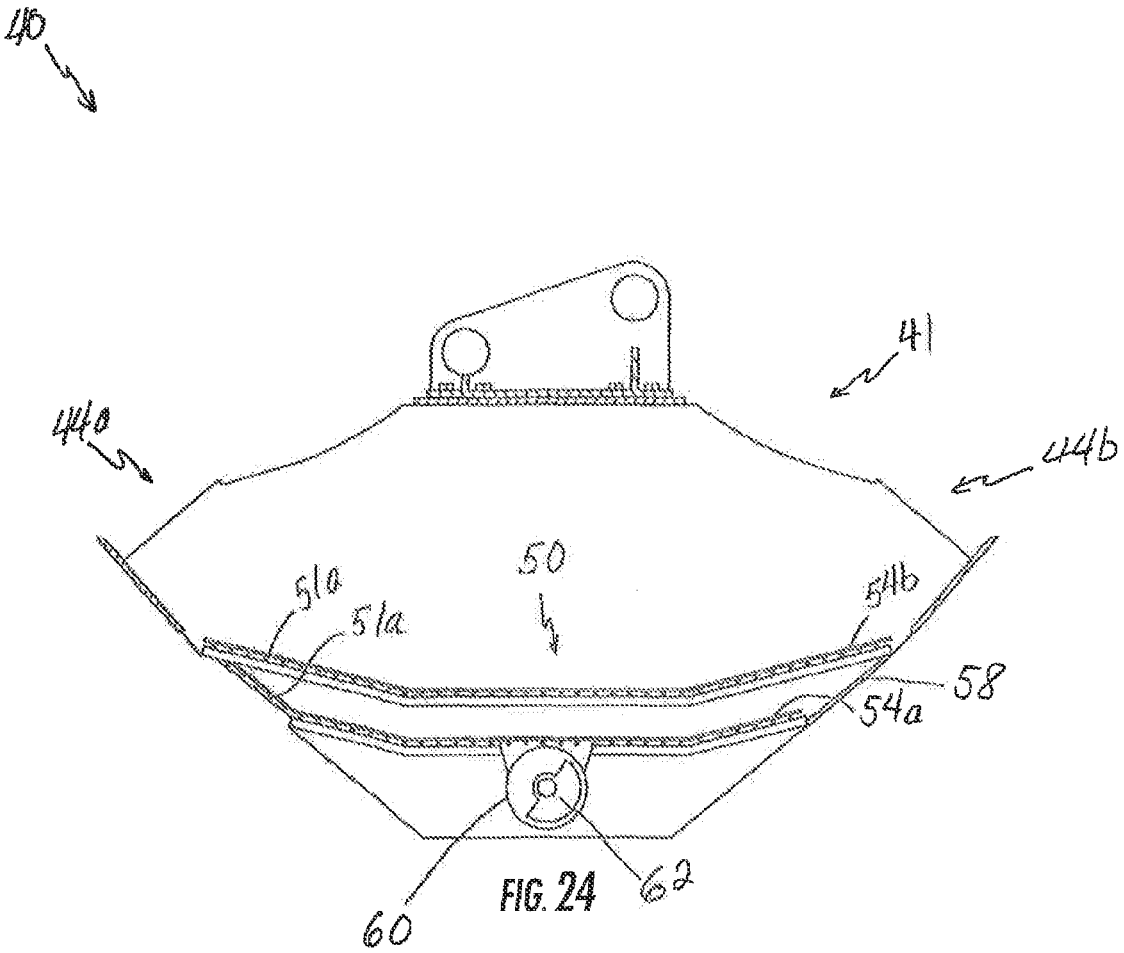
FIG. 24 is a partial schematic representation of a cross-sectional view of components of still another embodiment of the present invention from a view that is similar to the view depicted in FIGS. 12 and 16.

Alternatively, in some embodiments of the excavating bucket 40 of the present invention, it is desirable for one of either the forward free edge of the front screen panel 51*a* or the rearward free edge of the rear screen panel 51*c* of the bottom screen deck 54*a* to be disposed to come up to and meet the underside of the top screen deck 54*b* and desirably to contact the underside of the top screen deck 54*b*. So configured, material 29*b* (FIG. 18) larger than the second predetermined size that characterizes the screen size of the lower screen deck 54*a* only can be discharged from the space between the two decks via only one end 44*a* or 44*b* of the scoop member 41. As schematically shown in FIG. 24 for example, the forward free edge of the front screen panel 51*a* of the bottom screen deck 54*a* is disposed to contact the underside of the forward free edge of the front screen panel 51*a* of the top screen deck 51*b*. Thus, as schematically shown in FIG. 24, material 29*b* (FIG. 18) that is too large to pass through the openings in the screening material forming the front screen panel 51*a* of the bottom screen deck 54*a* only can be discharged by passing through the rear discharge opening 58 between the two decks 54*a*, 54*b* at the rear end 44*b* of the scoop member 41.

Moreover, in still other embodiments of the excavating bucket apparatus 40, at least one end of the bottom screen deck 54*a* has been curved upward toward the top 43 of the scoop member 41 so as to get very near to the underside of the top screen deck 54*b* without contacting the top screen deck 54*b* so that a gap is formed between the free end of the bottom screen deck 54*a* and the underside of the top screen deck 54*b*. That gap desirably is sized small enough so that oversize material 29*b* (FIG. 18) that is too large to pass through the bottom screen deck 54*a* likewise is too large to pass through the gap and thus only can be dumped from the opposite end of the excavating bucket apparatus 40.

The top screen deck 54*b* defines openings that desirably are configured to block passage of material larger than a first predetermined size. While the bottom deck 54*a* defines openings that desirably are configured to block passage of material larger than a second predetermined size. Each of the two screen decks 54*a*, 54*b* desirably is configured and disposed so that the first predetermined size is larger than the second predetermined size.

As shown schematically in FIG. 16 for example, the rigid frame carrying the screen decks 54*a*, 54*b* desirably is mounted on spring-loaded supports 52 that connect the screening mechanism 50 to the scoop member 41 as described above. Each of the two screen decks 54*a*, 54*b* of the screening mechanism 50 desirably can be configured in much the same manner as described above with respect to the single deck embodiments of FIGS. 6 and 12 for example, and so this description will not be repeated here. While in the embodiments shown in FIGS. 16-20 and 24 each of the two decks 54*a*, 54*b* lies in a plane that is parallel to the plane in which the other decks lies, such strict parallelism between the planes of the vertically stacked screen decks 54*a*, 54*b* is not required in all embodiments. Additionally, while in the embodiment shown in FIG. 16 each of the two decks 54*a*, 54*b* is rigidly connected to the other deck via rigid support members 55 so that the vertical separation between them remains constant, such strict rigid separation distance need not be the case in all multi-tiered embodiments of the screening mechanism 50. However, in the embodiment shown in FIG. 16, both screen decks 54*a*, 54*b* move in unison relative to the scoop member 41 via the spring-loaded supports 52, and thus the screening mechanism 50 as a whole can move in unison relative to the scoop member 41. In multi-tiered screen deck embodiments in which any of the screen decks is not rigidly connected to the other screen decks in the screening mechanism 50, individual screen decks can move in a different manner in relation to the scoop member 41.

While in the embodiment shown in FIG. 16, the top screen deck 54*b* is configured with three flat screen panels 51*a*, 51*b*, 51*c* as in the embodiment of FIGS. 6 and 12 for example, some embodiments of the top screen deck 54*b* of the excavating bucket apparatus 40 desirably are configured to accept a single screen panel that extends for the entire length of the top deck 54*b* and desirably has opposite free ends that are upwardly curved toward the top 43 of the scoop member 41. This design enables the operator to be able to slide one screen panel into the top deck 54*b* and so affords the operator ease of maintenance and the ability to change screen cloth sizes simply and quickly. The bottom deck 54*a* of the excavating bucket apparatus 40 desirably is configured so that it is not necessary to remove the top deck 54*b* when changing the mesh size of the screening forming the bottom deck 54*a*. Similarly, the excavating bucket apparatus 40 desirably is configured so that the entire multi-tiered screening mechanism 50 does not have to be removed from its spring-loaded supports 52 in the scoop member 41 in order to change screen cloth sizes.

Figure 17:
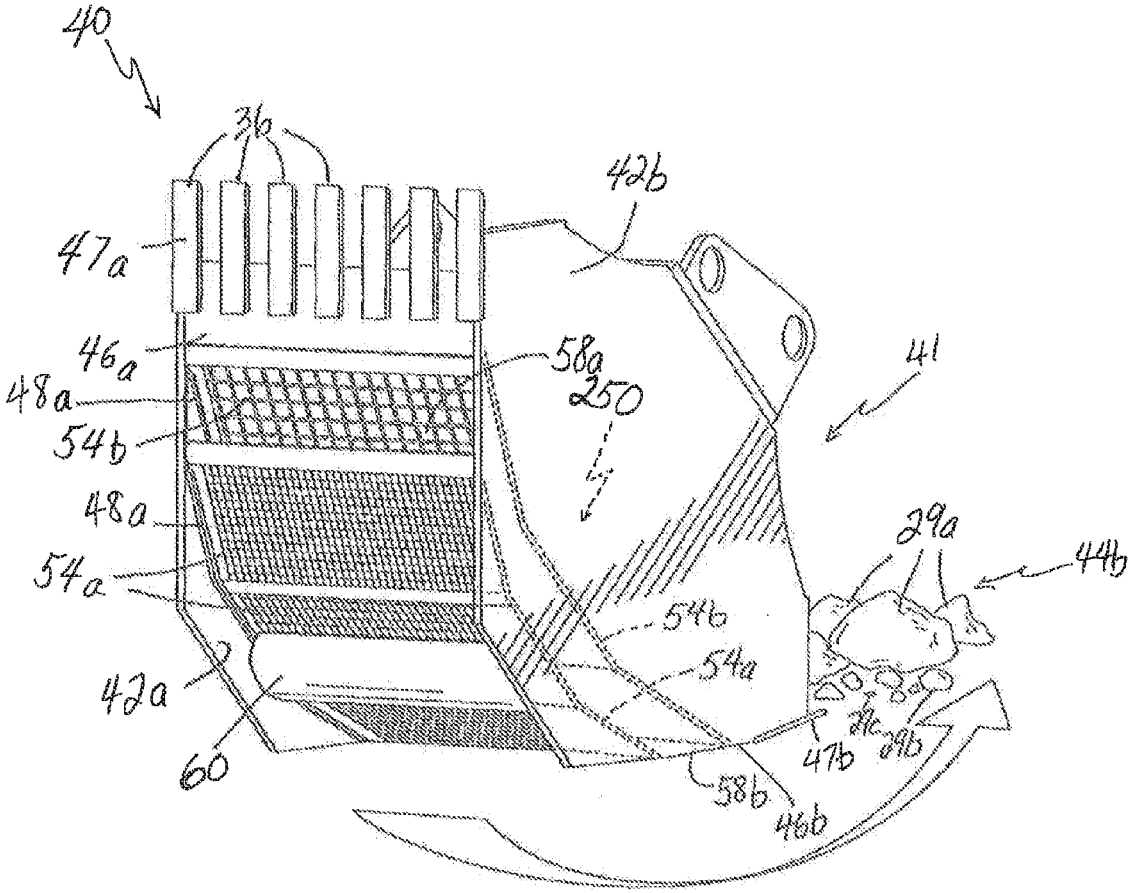
FIG. 17 is an elevated perspective view with certain structures otherwise hidden from view indicated by dashed line and illustrating operation of an embodiment similar to that shown in FIG. 16 in one operating mode in which material to be screened is inputted from the rear in the manner similar to what is depicted in FIG. 2A.

As schematically shown in FIG. 17 for example, as the scoop member 41 is moving in the direction of the un-numbered arrow, the open backward end 44*b* of the scoop member 41 is scooping up variously sized material 29*a*, 29*b*, 29*c* to be deposited onto the upper surface of the top screen deck 54*b* to be screened and separated. See also FIG. 2A and the arrow 28. As schematically shown in FIG. 18 for example, once the variously sized material 29*a*, 29*b*, 29*c* has been deposited onto the upper surface of the top screen deck 54*b*, the fine material 29*c* will pass through both the top screen deck 54*b* and the bottom screen deck 54*a* of the screening mechanism 50 on any angle (See FIGS. 2B, 2C, 2E and 2F), including horizontal, i.e., normal to the direction of the gravitational force. When the operator orients the excavating bucket apparatus 40 as schematically shown in FIG. 18 for example, this fine material 29*c* can be deposited in a first pile directly beneath the bottom 45 of the scoop member 41 of the excavating bucket apparatus 40. The five un-numbered arrows in FIG. 18 schematically indicate the direction in which this finely sized material 29*c* is tumbling through the screen openings 58*a* in the bottom screen deck 54*a* under the force of gravity and out of the bottom 45 of the scoop member 41.

In accordance with the present invention, the excavating bucket apparatus 40 is configured to "retain" more than one category of oversize product until the operator decides to deposit each category in a separate pile. As described above and shown in FIGS. 1 and 16 for example, the scoop member 41 defines at one opposite end 44*a* a front wall 46*a* and a rear wall 46*b* at the other opposite end 44*b* of the scoop member 41. As described above, each of the front wall 46*a* and the rear wall 46*b* of the scoop member 41 terminates in a respective edge portion 47*a*, 47*b*, which in turn can desirably define a cutting edge 36. As schematically shown in FIG. 18 for example, the material 29*b* that does not pass through the bottom screen deck 54*a* can be retained by the free ends of the bottom screen deck 54*a* of the screening mechanism 50 that are curved upward toward the top 43 of the scoop member 41. Similarly, as schematically shown in FIG. 18 for example, the material 29*a* that does not pass through the top screen deck 54*b* can be retained by the edge portions 47*a*, 47*b*.

As schematically shown in FIG. 16 for example, each of the edge portions 47*a*, 47*b* lies in a plane that desirably is disposed at a more severe respective angle θ, γ upwards towards the top 43 of the scoop member 41 relative to the plane in which the ends of the top screen deck 54*b* of the screening mechanism 50 lie. The same angular relationships apply to the ends of the bottom screen deck 54*a* of the screening mechanism 50. Thus, as schematically shown in FIGS. 18 and 20 for example, each of the opposite ends of the bottom screen deck 54*a* of the screening mechanism 50 are curved upward toward the top 43 of the scoop member 41 at a less severe angle than the respective angle θ, γ of each of the edge portions 47*a*, 47*b*.

Figure 20:
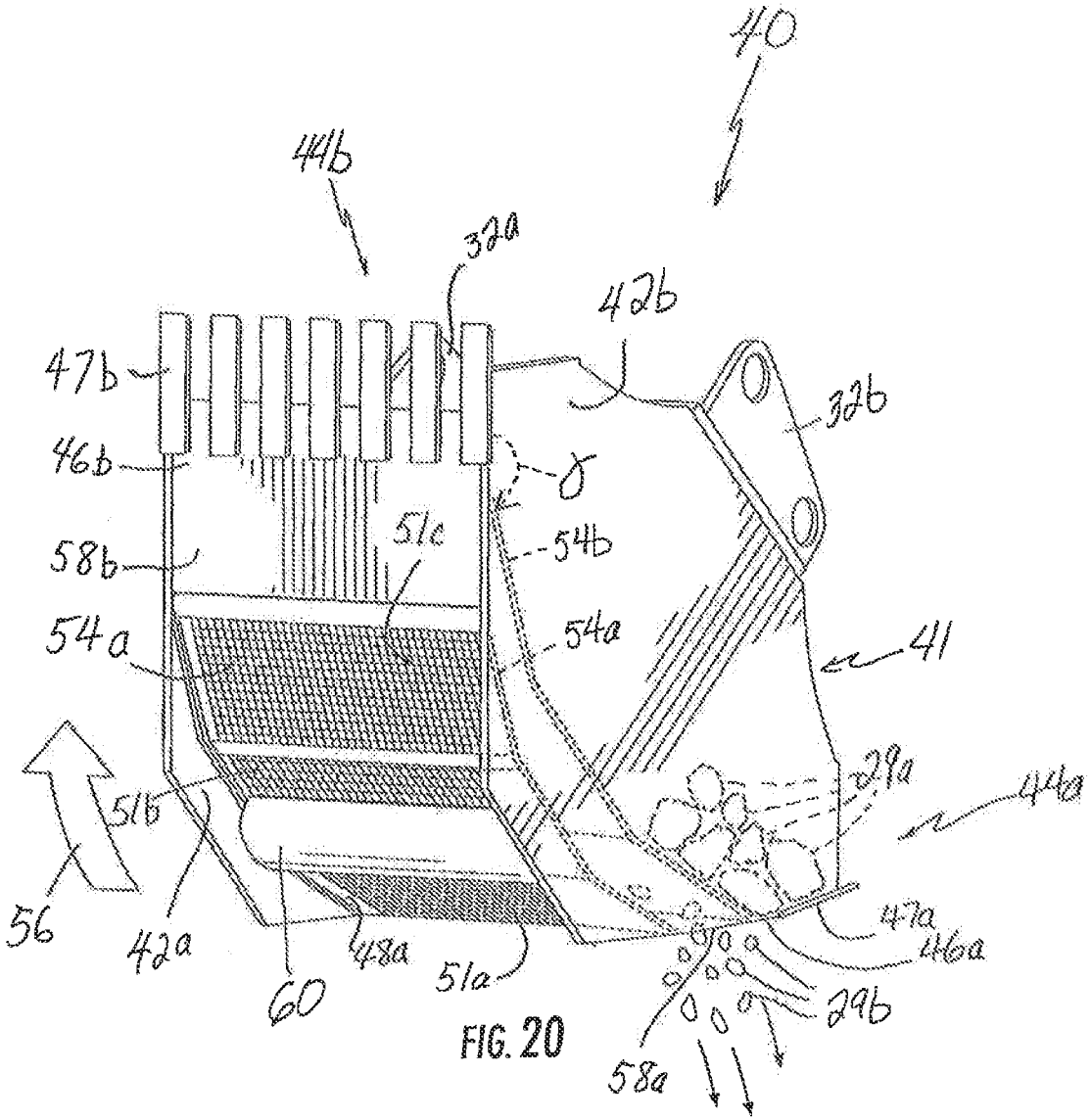
FIG. 20 is an elevated perspective view with certain structures otherwise hidden from view indicated by dashed line and illustrating operation of an embodiment similar to that shown in FIG. 16 in another operating mode in which material that has passed through a coarser upper screen but blocked by a finer screen is being discharged from the front end of the scoop member in a manner similar to what is depicted in FIG. 2B.

Accordingly, as schematically shown in FIG. 20, when the scoop member 41 is swung in the direction of the arrow designated 56, the edge portion 47*a* retains the material 29*a* (shown in dashed outline) that does not pass through the top screen deck 54*b*. See also FIGS. 2B and 2E. However, when the scoop member 41 is swung in the direction of the arrow designated 56, the bottom screen deck 54*a* becomes tilted at an angle sufficient to dump from the surface of the bottom screen deck 54*a* the material 29*b* (some shown in dashed outline and some shown in solid outline) that is too large to pass through the screen openings in the bottom screen deck 54*a*. The three un-numbered arrows in FIG. 20 schematically indicate the direction in which this oversize (in relation to the screen openings) material 29*b* is tumbling out of the front discharge opening 58*a* that is defined between the two screen decks 54*a*, 54*b* through the front wall 46*a* of the scoop member 41. Thus, the oversize material 29*b* that is too large to pass through the screen openings in the bottom screen deck 54*a* can be deposited in a second pile directly beneath one of the opposite ends 44*a* of the excavating bucket apparatus 40, and this second pile of screened material 29*b* is separate from the first pile of fine screened material 29*c*. However, as schematically shown in FIG. 20, despite the angle at which the scoop member 41 has been tilted in order to discharge completely the material 29*b* that is oversize relative to the size of the screen openings in the bottom screen deck 54*a*, the oversize material 29*a* that is too large to pass through the screen openings in the top screen deck 54*b* has been retained on the top screen deck 54*b* by the front wall 46*a* and associated edge portion 47*a* of the scoop member 41.

Figure 19:
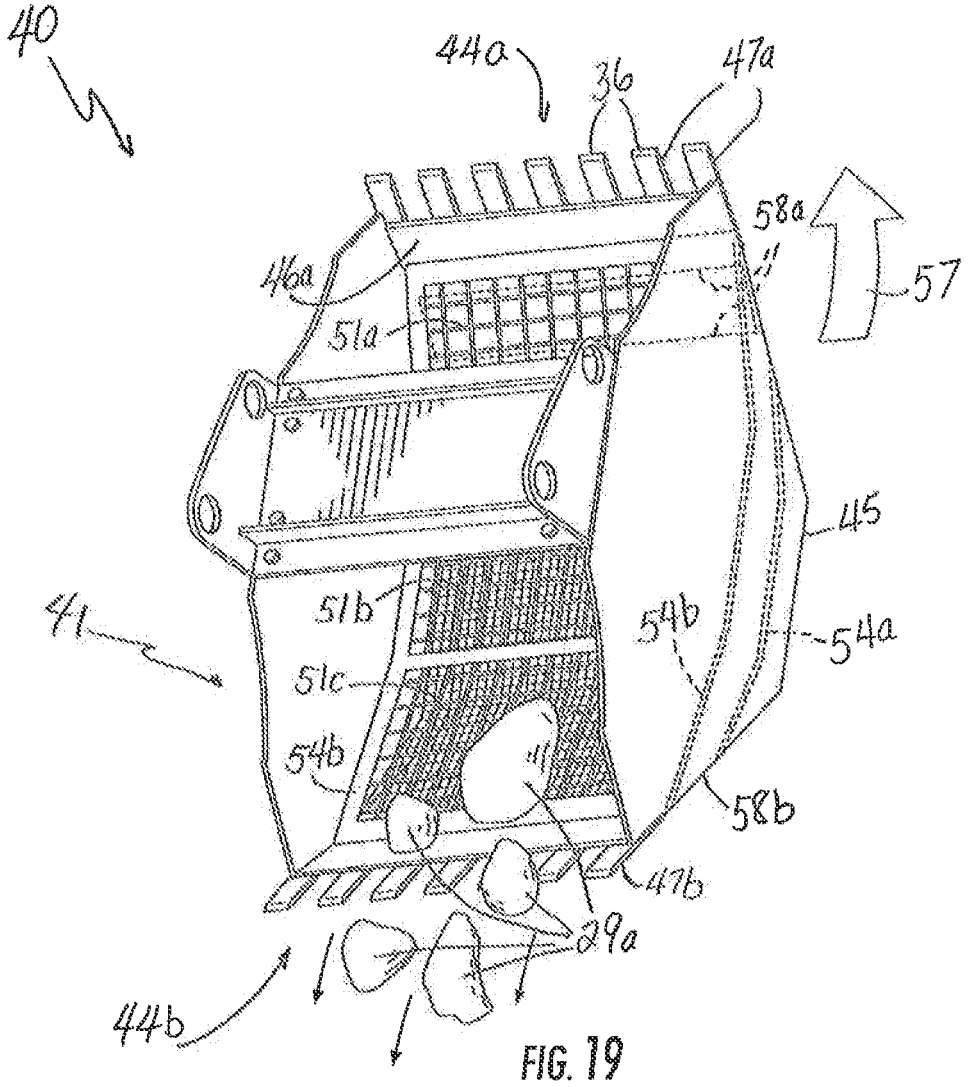
FIG. 19 is an elevated perspective view with certain structures otherwise hidden from view indicated by dashed line and illustrating operation of an embodiment similar to that shown in FIG. 16 in another operating mode in which oversized material is being discharged from the rear end of the scoop member in a manner similar to what is depicted in FIG. 2F.

Then, as schematically shown in FIG. 19, when the scoop member 41 is swung in the direction of the arrow designated 57, the edge portion 47*b* no longer retains the material 29*a* that does not pass through the top screen deck 54*b* as the top screen deck 54*b* becomes tilted at an angle sufficient to dump from the surface of the top screen deck 54*b* the material 29*a* that is too large to pass through the screen openings in the top screen deck 54*b*. See also FIGS. 2C and 2F. Thus, the material 29*a* that is too large to pass through the screen openings in the top screen deck 54*b* can be deposited in a third pile directly beneath one of the opposite ends 44*b* of the excavating bucket apparatus 40, and this third pile of screened material 29*a* is separate from the first pile of fine screened material 29*c* and separate from the second pile of screened material 29*b*.

As explained above, the excavating bucket apparatus 40 of the present invention can deposit screened material into various stock piles that are separated from one another according to the relative size of the material. The excavating bucket apparatus 40 of the present invention also can be placed over the bed of a truck that may move the material. This mobile feature of the excavating bucket apparatus 40 of the present invention is more efficient than conventional separation apparatus since material does not need to be stock piled first. Also, the excavating bucket apparatus 40 of the present invention affords to many pipe line contractors the option of screening material over the pipe they are covering with fine material 29*c*. Pipe must be surrounded with small screened material to prevent pipe breakage. The excavating bucket apparatus 40 of the present invention will allow operators to simply screen dirt, etc. while fines 29*c* are discharged over and around the pipe.

Additionally, in embodiments of the screening mechanism 50 that include a top screen deck 54*b* disposed above and spaced apart from a bottom screen deck 54*a*, some embodiments are configured so that the top screen deck 54*b* is provided with a slightly different curvature and/or angle than the curvature and/or angle that is provided to the bottom screen deck 54*a*. Thus, the upturned angle of the screen at the free end thereof in the top screen deck 54*b* likely would differ from the upturned angle of the screen at the free end thereof in the bottom screen deck 54*a* in order to ensure better retention of oversize material in each of the screen decks for future discharge. Such retention helps prevent oversize material dumped from one screen deck from being mixed into the pile of oversize material that has been dumped from the other screen deck and thereby better achieves the goal of maintaining separate piles of relatively uniformly sized material.

As described more fully below and schematically shown in FIGS. 13, 14, 16 and 17 for example, the screening mechanism 50 can be shaken by connection to a vibratory mechanism 60. As schematically shown in FIGS. 13, 16, 17 and 24 for example, the vibratory mechanism 60 desirably is attached to the screening mechanism 50 by being bolted to the underside of the screening mechanism 50. As shown in FIGS. 26 and 34 for example, this desirably can be accomplished by having the vibratory mechanism 60 attached rigidly to the respective screen skeleton 63, 263. In a single screen embodiment shown in FIG. 26 for example, the vibratory mechanism 60 is rigidly mounted to an elongated base plate 60*a*, which in turn has each of its opposite ends rigidly mounted to a respective one of the side arms 63*a* of the screen skeleton 63.

Figure 13:
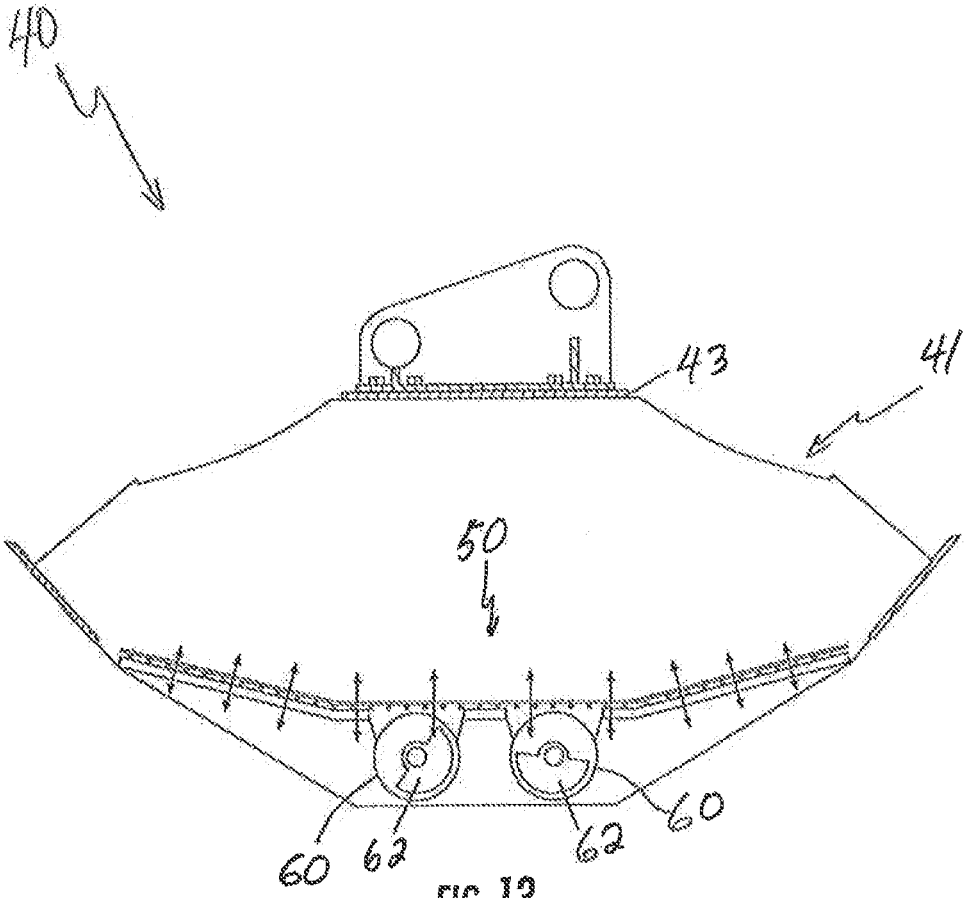
FIG. 13 is a partial schematic representation of a cross-sectional view of components of another embodiment of the present invention from a view that is similar to the view depicted in FIG. 12.

In embodiments such as those schematically shown in FIGS. 13, 16 and 17, the screening mechanism 50 is disposed between the top 43 of the scoop member 41 and the vibratory mechanism 60. However, as schematically shown in FIG. 14 for example, the vibratory mechanism 60 also can be disposed above the screening mechanism 50 and connected to the screening mechanism 50 by a pair of depending arms 60*b* that have opposite ends pivotally connected to the screening mechanism 50. Thus, in embodiments such as those schematically shown in FIG. 14, the vibratory mechanism 60 is disposed between the top 43 of the scoop member 41 and the screening mechanism 50.

Any conventional vibratory mechanism 60 can be employed. As schematically shown in FIGS. 13, 14, 16, 24 and 34 for example, the vibratory mechanism 60 can include at least one eccentric shaft 62, which is rotatably driven by a motor to impart a shaking motion to the screening mechanism 50. As schematically shown in FIG. 13 for example, the vibratory mechanism 60 can include two eccentric shafts 62. Each of the two eccentric shafts 62 desirably is separately connected to the screening mechanism 50 and desirably is rotatably driven independently by its own dedicated motor. By independently controlling the rotational direction and rotational speed of each of the two eccentric shafts 62, the operator of the embodiment depicted in FIG. 13 can impart a wider variety of shaking motions to the screening mechanism 50. The un-numbered two-headed arrows in FIG. 13 schematically indicate possible movements of the screening mechanism 50 under one set of operating parameters for the two rotating eccentric shafts 62 of the vibrating mechanism 60.

The vibratory mechanism 60 desirably can be electric-powered or hydraulic-powered, and thus an electric motor or a hydraulic motor can be employed to rotate an eccentric shaft 62 as shown in the examples depicted in FIGS. 14, 16, 24 and 34 for example. When hydraulic-powered, the hydraulic motor desirably is selected so that it can operate the vibratory mechanism 60 efficiently and effectively on a minimal amount of hydraulic pressure and flow. In this way, the excavating bucket apparatus 40 can be mounted on a broader range of articulated vehicles 30 than if the operation of the vibratory mechanism 60 required greater amounts of hydraulic power.

In embodiments having a screening mechanism 50 with at least two screen decks 54*a*, 54*b*, both screen decks can be vibrated, either together or independently. As schematically shown in FIG. 16 for example, the entire screening mechanism 50 is mounted on spring-loaded supports 52 inside the rigid frame of the scoop member 41 while the vibratory mechanism 60 desirably is connected directly to the bottom screen deck 54*a*. As shown schematically in FIG. 16 for example, the top screen deck 54*b* and the bottom screen deck

54*a* are connected via rigid vertical supports 55, and thus as the vibratory mechanism 60 directs vibratory motion directly to the bottom screen deck 54*a*, such vibratory motion also vibrates the top screen deck 54*b*. In an alternative embodiment having a top screen deck 54*b* configured as shown in FIG. 14 and a bottom screen deck 54*a* configured as shown in FIG. 13 for example, each of the two screen decks 54*a*, 54*b* will be vibrated by a separate vibrating mechanism 60. Moreover, a third level screen deck and a fourth level screen deck, etc. can be added and stacked on top of each other in a similar manner so that all of the screen decks would vibrate.

The excavating bucket apparatus 40 further desirably includes a damping mechanism that is carried by the frame of the scoop member 41 and disposed between the frame of the scoop member 41 and the vibratory mechanism 60. The damping mechanism desirably is configured for reducing the shaking of the frame of the scoop member 41 by the vibratory mechanism 60 when the vibratory mechanism 60 is shaking the screening mechanism 50. The damping mechanism desirably includes at least a first resiliently deformable member carried by the frame and disposed between the bottom of the scoop member and the screening mechanism and configured for limiting movement of the screening mechanism closer than a predetermined distance toward the bottom of the scoop member. The first resiliently deformable member desirably also is configured for absorbing the momentum of movements of the screening mechanism directed toward the bottom of the scoop member. The damping mechanism also desirably includes at least a second resiliently deformable member carried by the frame and disposed between the bottom of the scoop member and the screening mechanism and configured for limiting movement of the screening mechanism farther than a predetermined distance away from the bottom of the scoop member. The second resiliently deformable member desirably also is configured for absorbing the momentum of movements of the screening mechanism directed away from the bottom of the scoop member.

As schematically shown in FIGS. 14 and 16 for example, a resiliently deformable member of the damping mechanism desirably includes at least one elastic support 52, and desirably a plurality of elastic supports 52. As explained more fully below, each elastic support 52 is configured for limiting movement of the screening mechanism 50 farther than a predetermined distance away from the bottom 45 of the scoop member 41 as well as closer than a predetermined distance to the bottom 45 of the scoop member 41. As schematically shown in FIGS. 14 and 16 for example, these elastic supports 52 are disposed between the bottom 45 of the scoop member 41 and the screening mechanism 50 and act as resiliently deformable members carried by the frame of the scoop member 41. Thus, each of these elastic supports 52 is a resiliently deformable member that is carried by the frame of the scoop member 41 and configured and disposed for absorbing the momentum of movements of the screening mechanism 50 directed both toward and away from the bottom of the scoop member 41.

As schematically shown in FIG. 29 for example, these elastic supports 52 of the damping mechanism are carried by the frame, which includes each side panel 42*a*, 42*b* of the scoop member 41. These elastic supports 52 of the damping mechanism are disposed between the frame and the vibratory mechanism 60, which is connected to the screen skeleton 63, 263. Because the vibratory mechanism 60 is connected to the screen skeleton 63, 263 rather than to the frame of the scoop member 41, the screening mechanism 50, 250 is carried by the frame of the scoop member 41 in a manner that isolates the movement of the screen skeleton 63, 263 from the frame of the scoop member 41 and so prevents vibration of the screening mechanism 50, 250 from effecting corresponding vibration of the frame of the scoop member 41. Accordingly, each elastic support 52 is configured for reducing the shaking of the frame by the vibratory mechanism 60 when the vibratory mechanism 60 is shaking the screening mechanism 50. Thus, each of these elastic supports 52 is a resiliently deformable member that is carried by the frame of the scoop member 41 and configured and disposed for absorbing the momentum of movements of the screening mechanism 50.

As schematically shown in FIG. 30 for example, each elastic support 52 includes a connecting pin 52*a* that extends through the side panel 42*a* of the scoop member 41. As shown in FIG. 15, one end of the connecting pin 52*a* extends through the hole 68*a* in the hang tab 68 of the respective screen skeleton 63, 263 and desirably can be welded in place. As shown in FIG. 30, the opposite end of the connecting pin 52*a* can be captured by a clamp 52*b* that is mounted on one end of a piston 52*c*. The clamp 52*b* desirably can be provided with a pair of adjustable screws 52*d* that can be rotated to adjust the gripping force of the clamp 52*b* on the end of the connecting pin 52*a*. The opposite end of the piston 52*c* desirably is formed as a hollow cup 52*e* defining a chamber that is open at one end.

The elastic support 52 desirably includes a suspension that is provided for carrying the piston 52*c*. Such suspension employed for carrying the piston 52*c* can take any of a number of forms, which can include but are not limited to: coil springs, rubber springs, hinged springs, and leaf springs. Desirably, such suspension for the piston 52*c* can take the form of a heavy duty coiled spring 52*f*, which desirably is formed of steel, has one end disposed resting against the closed end of the cup 52*e*. The opposite end of the spring 52*f* rests against an exterior ledge 42*c* that is rigidly connected to (desirably by welding) and extends from the exterior surface of the main wall of the side panel 42*a* of the scoop member 41. Thus, the spring 52*f* biases against movement of the connecting pin 52*a*, and with it the screen skeleton 63, 263 that is carried by the connecting pin 52*a*, toward the bottom 45 of the scoop member 41 and thus dampens movement of the screening mechanism 50 in this direction. A heavy duty rubber sleeve gasket 42*d* that surrounds the portion of the connecting pin 52*a* that passes through the main wall of the side panel 42*a* of the scoop member 41 also serves partially to dampen movement of the screening mechanism 50 in this direction toward the bottom 45 of the scoop member 41. Desirably, a separate combination of piston 52*c* and associated spring 52*f* is assigned for each connecting pin 52*a*.

As schematically shown in FIG. 30 for example, the damping mechanism also desirably can include a rubber-tipped stop 52*g* that is adjustable to apply varying degrees of biasing force on the connecting pin 52*a* that extends through the wall opening 42*f* defined through side panel 42*a* of the scoop member 41. Such biasing force acts against movement of the connecting pin 52*a* in a direction away from the bottom 45 of the scoop member 41. Thus, as schematically shown in FIG. 30 for example, the biasing force applied by a rubber-tipped stop 52*g* counteracts the biasing force being applied by the spring 52*f* to the connecting pin 52*a*. As schematically shown in FIG. 29 for example, a plurality of rubber-tipped stops 52*g* desirably are provided on each side of the scoop member 41. Desirably, a separate rubber-tipped stop 52*g* is assigned for each connecting pin 52*a*.

As schematically shown in FIG. 30 for example, the rubber-tipped stop 52*g* desirably includes an elongated hollow cartridge 52*h* that is rigidly attached to the main wall of the side panel 42*a* of the scoop member via a plate 52*i* that can be bolted to the side panel 42*a* or welded to the side panel 42*a*. The cartridge 52*h* is rigidly attached to the plate 52*i* as by being welded thereto. A rubber plug 52*j* having at one end a mushroom-shaped head 52*k* attached to an elongated shaft 52*m* that slides into the lower end of a cylindrical cavity defined within the cartridge 52*h*. A threaded shaft of an adjustment bolt 52*n* having at one end a head 52*q* is screwed into a threaded adjustment nut 52*p* and the threaded opening at the opposite end of the cartridge 52*h*. The end of the adjustment bolt 52*n* opposite the head 52*q* butts against the free end of the shaft 52*m* of the rubber plug 52*j*. The magnitude of the biasing force applied by the head 52*k* of the rubber plug 52*j* to the connecting pin 52*a* can be adjusted by attaching a tool to the head 52*q* of the bolt 52*n* to effect rotation of the threaded bolt 52*n*. This biasing force applied by the rubber-tipped stop 52*g* also functions to retain the screening mechanism 50 in generally the same position relative to the frame of the scoop member 41 when the bucket apparatus 40 is tilted in a so-called vertical position relative to the ground such as shown schematically in FIGS. 2B, 2C and 2F for example. The heavy duty rubber sleeve gasket 42*d* that surrounds the portion of the connecting pin 52*a* that passes through the main wall of the side panel 42*a* of the scoop member 41 also serves partially to dampen movement of the screening mechanism 50 in the direction away from the bottom 45 of the scoop member 41.

As schematically shown in FIGS. 14 and 16 for example, the damping mechanism desirably can include at least one resiliently deformable member 64 carried by the frame of the scoop member 41 and disposed between the bottom 45 of the scoop member 41 and the screening mechanism 50 and configured for limiting movement of the screening mechanism 50 closer than a predetermined distance toward the bottom 45 of the scoop member 41. Each resiliently deformable member 64 desirably is made of a relatively hard durometer rubber. In the embodiments shown in FIGS. 14 and 16, a pair of spaced apart resiliently deformable members 64 is disposed between the bottom 45 of the scoop member 41 and the screening mechanism 50. Thus, these resiliently deformable members 64 are configured and disposed for absorbing the momentum of movements of the screening mechanism 50 directed toward the bottom 45 of the scoop member 41.

Figure 21:
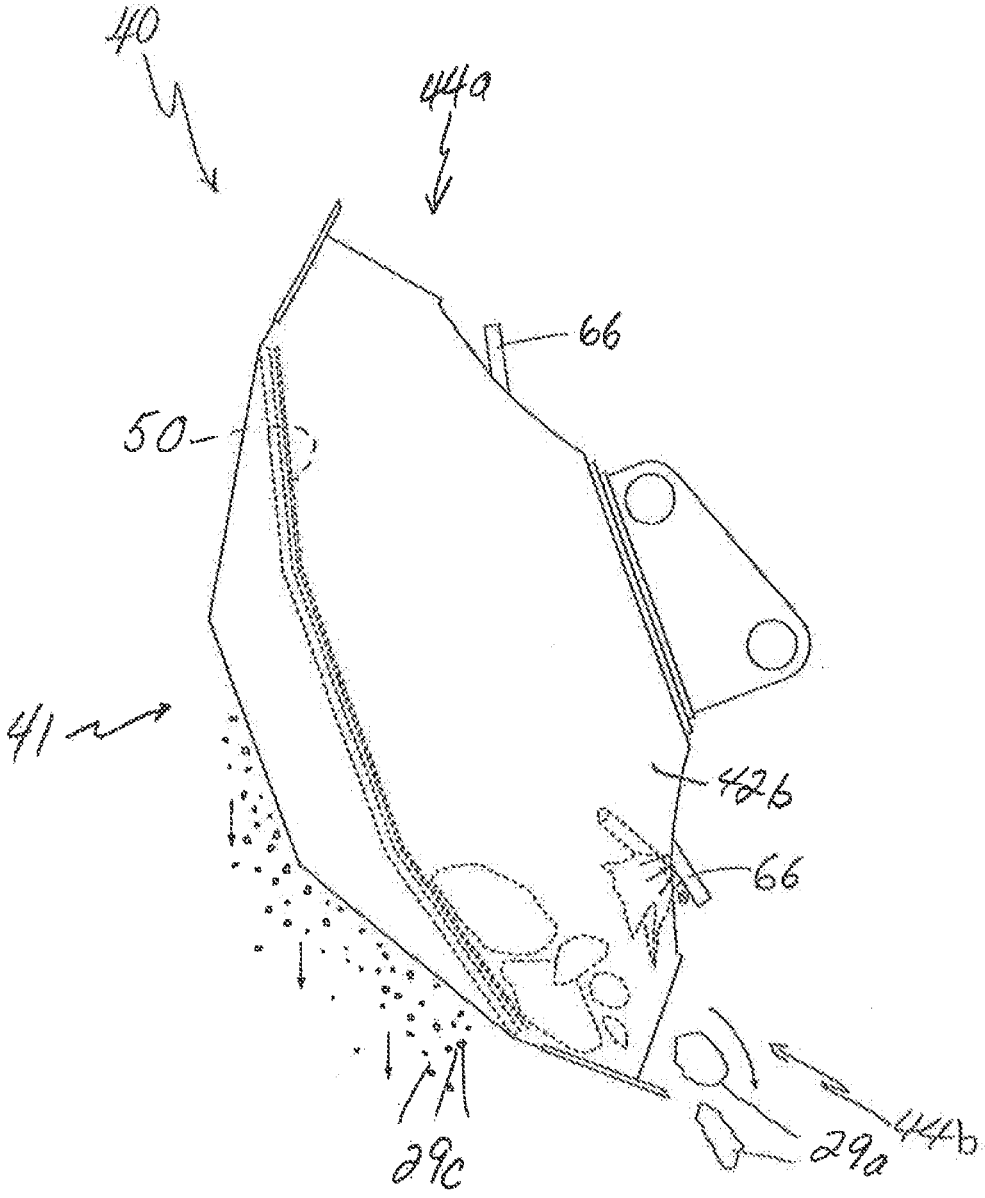
FIG. 21 is a partial schematic representation of a cross-sectional view of components of still another embodiment of the present invention with some features as in one of FIGS. 6, 7 and 8 from a view that is similar to the view depicted in FIG. 12 with certain structures otherwise hidden from view indicated by dashed line and schematically illustrates another operating mode in which finer material is being passed through the screening mechanism, oversized material is being discharged from the rear and metallic debris is collected at the rear.
Figure 22:
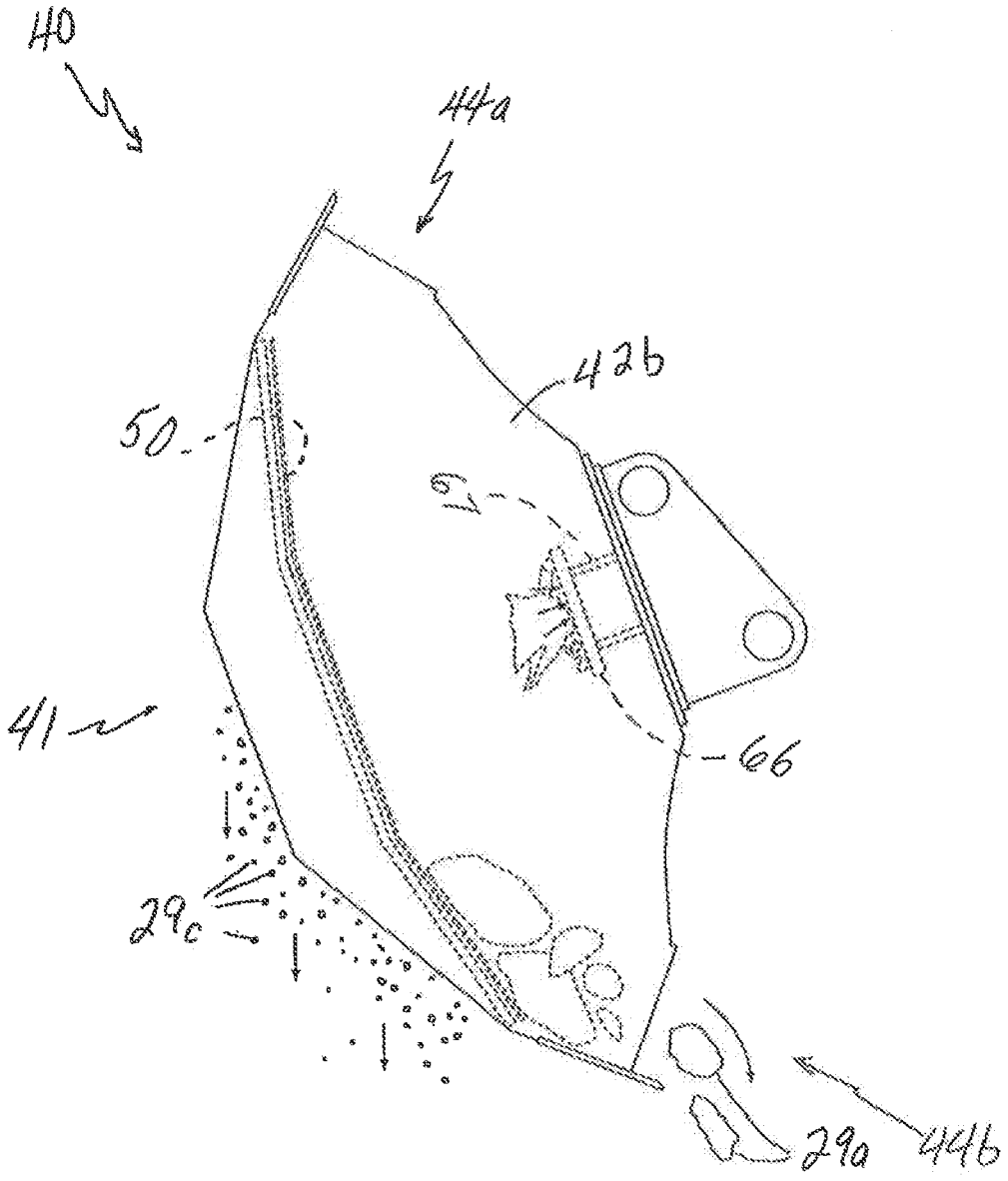
FIG. 22 is a partial schematic representation of a cross-sectional view of components of yet another embodiment of the present invention with some features as in one of FIGS. 6, 7 and 8 from a view that is similar to the view depicted in FIG. 12 with certain structures otherwise hidden from view indicated by dashed line and schematically illustrates another operating mode in which finer material is being passed through the screening mechanism, oversized material is being discharged from the rear and metallic debris is collected at the top.

As schematically shown in FIGS. 21 and 22 for example, some embodiments of the excavating bucket apparatus 40 desirably include at least one magnet 66 carried by the frame of the scoop member 41 and configured and disposed for removing metallic objects from the screening mechanism 50. In some embodiments, the magnet 66 desirably is an electromagnet that can be selectively activated or de-activated as desired by the operator from the mobile vehicle 30 and desirably is powered off the batteries of such vehicle 30. Alternatively, the magnet 66 can be operated hydraulically from the vehicle's hydraulic motor that drives an electric generator supplying power to a rectifier, which supplies direct current to the magnet 66.

In some embodiments, such as shown in FIG. 21 for example, a magnet 66 can be disposed at each opposite end 44*a*, 44*b* of the scoop member 41 so that metal objects can be acquired by the magnet 66 whether they are being discharged at one end 44*a* of the scoop member 41 or at the opposite end 44*b* of the scoop member 41. This arrangement of the magnets 66 also allows for acquisition of metallic objects as they are entering the scoop member 41, and so avoids contact between those metallic objects and the screening mechanism 50. In some embodiments, the magnet 66 desirably is disposed above the screening mechanism 50.

Generally speaking, the closer the magnet 66 to the upper screening surface of the screening mechanism 50, the more effectively can the magnet 66 remove metal objects from the material in the scoop member 41. Different screening mechanisms 50 may require different height dispositions of the magnet 50 for more effective removal of metal objects. As schematically shown in FIG. 22 for example, the magnet 66 desirably can be provided with a height adjustable mechanism 67 by which the operator can raise and lower the magnet 66 relative to the upper screening surface of the screening mechanism 50.

As shown in the examples depicted in FIGS. 9-11 and 23, in some embodiments of the excavating bucket apparatus 40 of the present invention the screening mechanism 50 includes a plurality of rotating screening shafts 70. Screening apparatus that employ rotating screening shafts are known, and an example is disclosed in U.S. Pat. No. 7,007,877, which is hereby incorporated herein in its entirety for all purposes by this reference. Such screening apparatus are to be distinguished from crushing apparatus such as disclosed in U.S. Pat. No. 8,117,771 that reduce the size of the input material until all of that material can pass through the apparatus. Unlike the latter type of crushing apparatus, the rotating screening shafts 70 of the screening apparatus will only incidentally reduce the size of some of the less hard input material but primarily perform a sifting function that allows a significant amount of oversize material to accumulate atop the screening shafts 70 of the apparatus. Proper functioning of the screening apparatus requires removal of this accumulated residue of oversize material from atop the screening shafts 70 of the screening apparatus.

Figure 4:
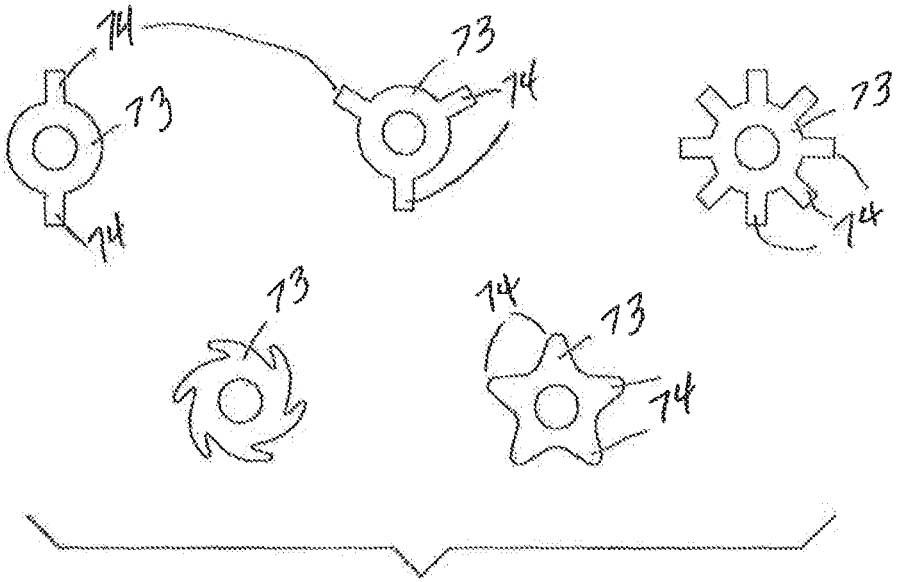
FIG. 4 is a front plan view of several differently shaped embodiments of components of the present invention.
Figure 5:
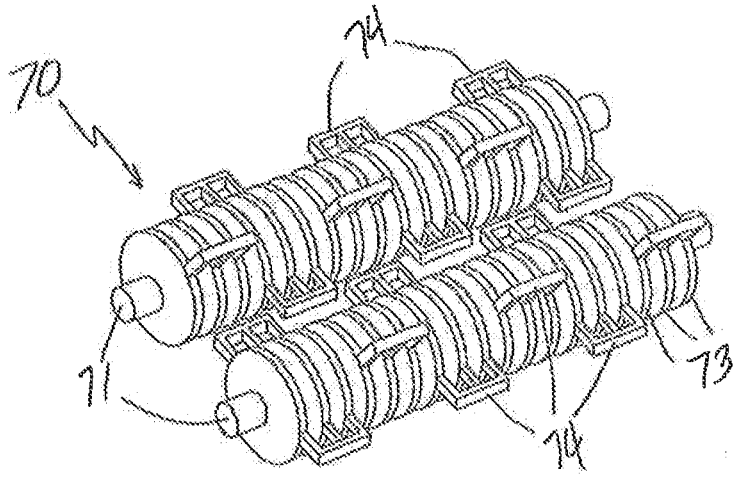
FIG. 5 is an elevated perspective view of embodiments of components of the present invention.

As shown in FIG. 5 for example, each screening shaft 70 is rotatable about a longitudinal axis that is concentric with a central shaft 71. As shown in FIGS. 4 and 5 for example, each screening shaft 70 is formed desirably by a plurality of circular disk-shaped elements 73 that are non-rotatably attached to the central shaft 71. As shown in FIGS. 4 and 5 for example, the disk-shaped elements 73 desirably are provided with lobes 74 or paddles 74 that project radially outwardly from the disk-shaped elements 73. Some exemplary shapes of these lobes 74 or paddles 74 carried by the disk-shaped elements 73 are shown in a transverse view in FIG. 4, but other shapes are possible. As shown schematically in FIG. 5 for example, the rotation of the screening shafts 70 is synchronized so that the paddles 74 of immediately adjacent screening shafts 70 do not contact one another, but rather function to sweep material through the spaces between the immediately adjacent screening shafts 70. The space between the disk-shaped elements 73 carried by any two immediately adjacent screening shafts 70 defines the size of material that will be passed through the screening shafts 70 and accordingly the size of oversized material that will remain on top of the screening shafts 70 and thus not be passed through the screening shafts 70.

Figure 9:
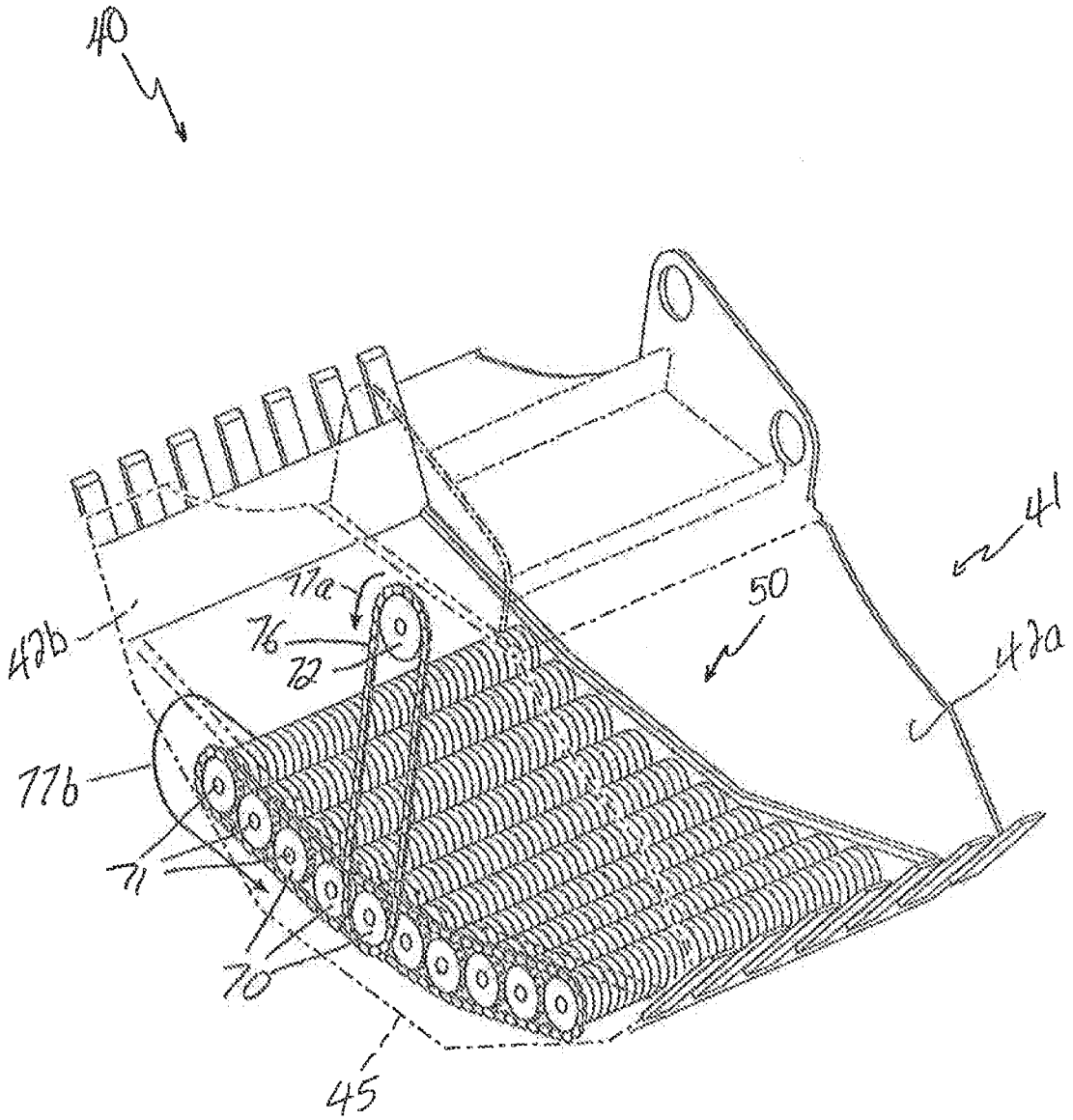
FIG. 9 is a perspective view of embodiments of components of the present invention with certain features shown in chain-dashed line for purposes of illustrating features that ordinarily would not be visible in the view shown.
Figure 10:
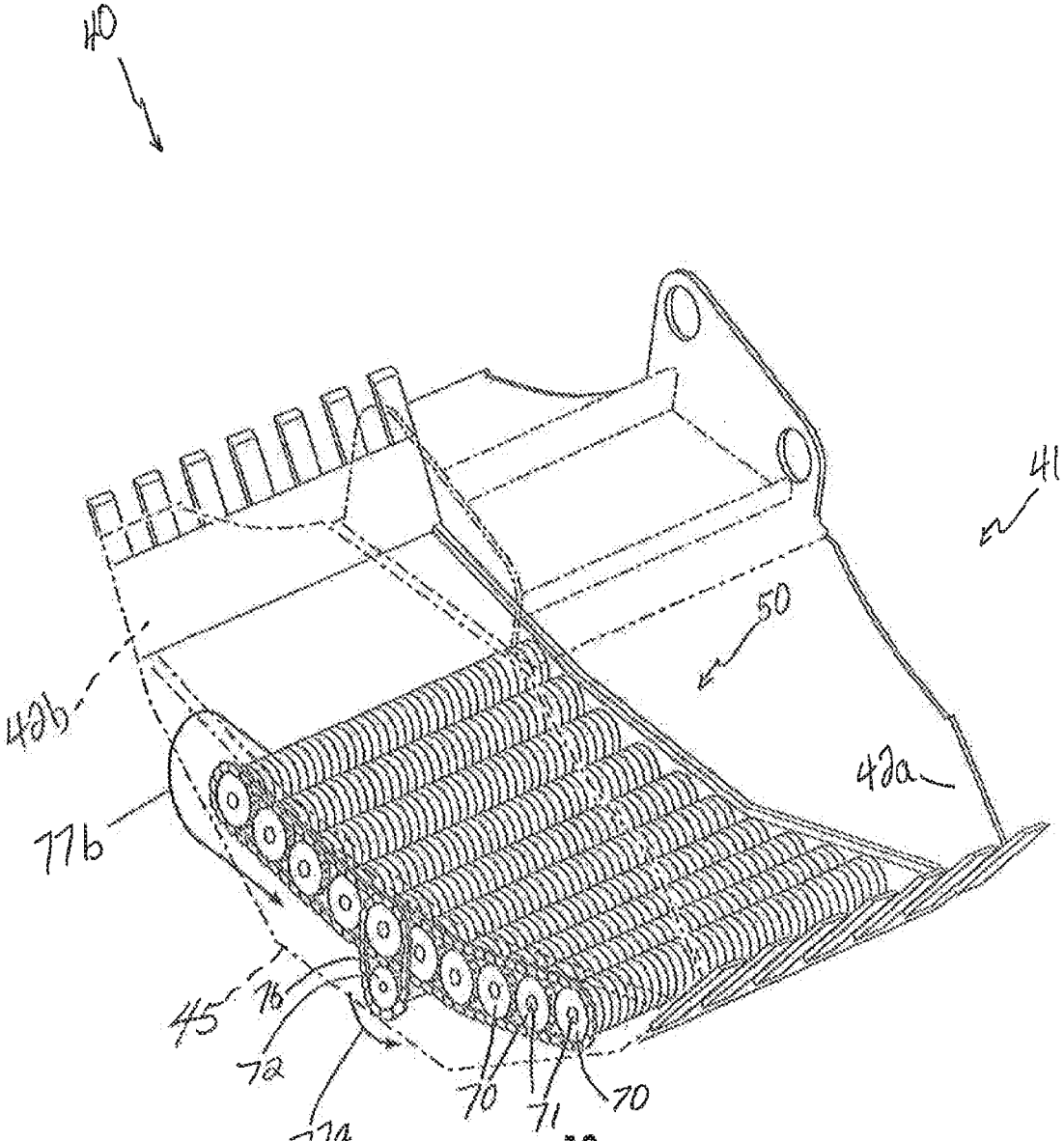
FIG. 10 is a perspective view of embodiments of components of the present invention with certain features shown in chain-dashed line for purposes of illustrating features that ordinarily would not be visible in the view shown.
Figure 11:
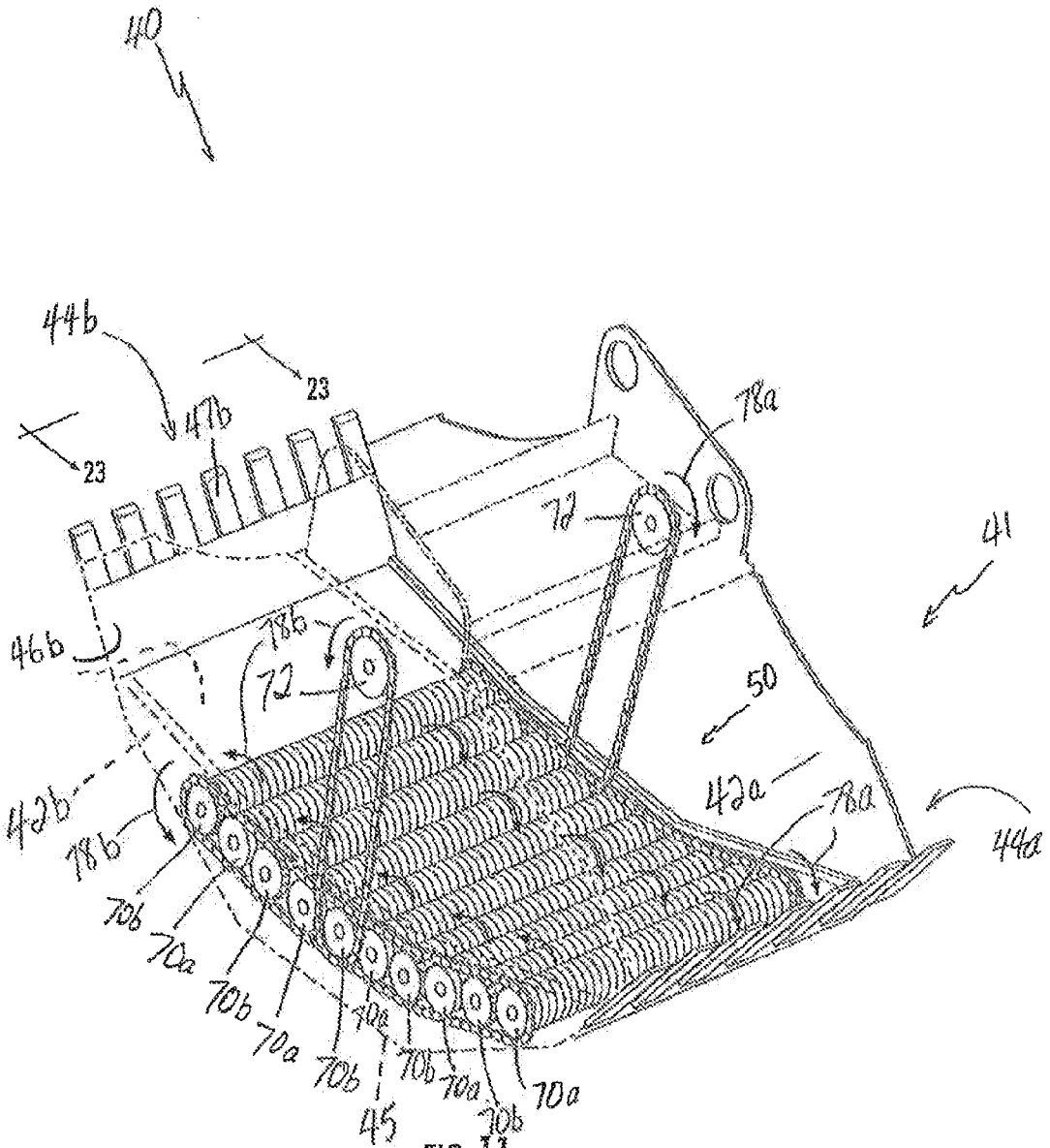
FIG. 11 is a perspective view of embodiments of components of the present invention with certain features shown in chain-dashed line for purposes of illustrating features that ordinarily would not be visible in the view shown.

As shown in FIGS. 9-11 and 23 for example, each central shaft 71 of each screening shaft 70 desirably extends between the side panels 42*a*, 42*b* of the scoop member 41 and is rotatably carried thereby in any conventional manner. As schematically shown in FIG. 11 for example, each screening shaft 70*a*, 70*b* desirably has a set of sprockets on one end thereof. As schematically shown in each of FIGS. 9, 11 and 23 for example, rotation of screening shafts 70 forming the screening mechanism 50 desirably can be powered from a rotationally powered drive shaft 72. As schematically shown in FIG. 23 for example, each drive shaft 72 can be rotationally driven by a motor 75. The drive shaft 72 can have sprockets that engage a drive chain 76 that is connected in a conventional manner to the sprockets on one end of the screening shafts 70*a*, 70*b* to drive all of the screening shafts 70 forming the screening mechanism 50 in unison. As schematically shown in FIGS. 9 and 10 for example, when the drive shaft 72 and drive chain 76 are driven in the direction of the arrow designated 77*a*, the screening shafts 70 are driven to rotate in the direction of the arrow designated 77*b*.

As schematically shown in each of FIGS. 9, 11 and 23 for example, the drive shaft 72 that powers rotation of the screening shafts 70 forming the screening mechanism 50 desirably can be disposed vertically above the screening mechanism 50 that is disposed along the bottom 45 of the scoop member 41. As schematically shown in FIG. 10 for example, rotation of screening shafts 70 forming the screening mechanism 50 desirably can be powered from a rotationally powered drive shaft 72 that is disposed vertically beneath the screening mechanism 50 that is disposed along the bottom 45 of the scoop member 41.

As schematically shown in FIG. 11 for example, rotation of some of the screening shafts 70*a* forming the screening mechanism 50 desirably can be powered from a first rotationally powered drive shaft 72 that rotates in a clockwise direction indicated by the arrows designated 78*b* while rotation of other ones of the screening shafts 70*b* forming the screening mechanism 50 desirably can be powered from a second rotationally powered drive shaft 72 that rotates in a counterclockwise direction indicated by the arrows designated 78*a* simultaneously with rotation of the first rotationally powered drive shaft 72 in the clockwise direction 78*b*. Moreover, as schematically shown in FIG. 11 for example, the side-by-side disposition of screening shafts 70*a*, 70*b* forming the screening mechanism desirably can be arranged so that a screening shaft rotatable 70*a* in the clockwise direction 78*a* is positioned beside a screening shaft 70*b* rotatable in the counterclockwise direction 78*b*. In this way, the rotational direction of the screening shafts 70*a*, 70*b* alternates from one direction to the opposite direction as one encounters each successive screening shaft 70*a*, 70*b* when proceeding longitudinally from one end of the screening mechanism 50 to the opposite end of the screening mechanism 50. Referring to the embodiment schematically shown in FIGS. 11 and 23 for example, it also is possible to drive only one set of screening shafts 70*a* or 70*b* with one of the motors 75 while not driving the other set of screening shafts 70*a* or 70*b* with the other one of the motors 75, and this mode of operation can be useful in clearing jams of the screening mechanism 50.

As shown in FIG. 2A, the excavating bucket apparatus 40 can be operated to shovel or scrape material off the upper surface of the ground. As shown in FIG. 2D, the excavating bucket apparatus 40 can be operated to dig into material disposed beneath the upper surface of the ground.

Having the ability to dig or scrape from either end of the scoop member 41 and dump from either end of the scoop member 41 means that the entrance and exit, input end and output end, of the scoop member 41 are interchangeable. Unlike the screening shafts 70 of the rotor style screening mechanism 50, which does some grinding and size reduction while it is screening and oversize material (e.g., 29*a*) is retained on top of the rotating shafts 70 while smaller material (e.g., 29*c*) passes through the rotating shafts 70 (e.g., FIGS. 3, 9-11 and 23), the tiered screening mechanism 50 (e.g., FIGS. 16-20 and 24) with the vibration mechanism 60 allows for multiple levels of size separation. Multiple levels allows one to process undifferentiated input material into various separate sizes (e.g., 29*a*, 29*b* and 29*c*) all at the same time, thus maximizing efficiency and time.

Figure 32:
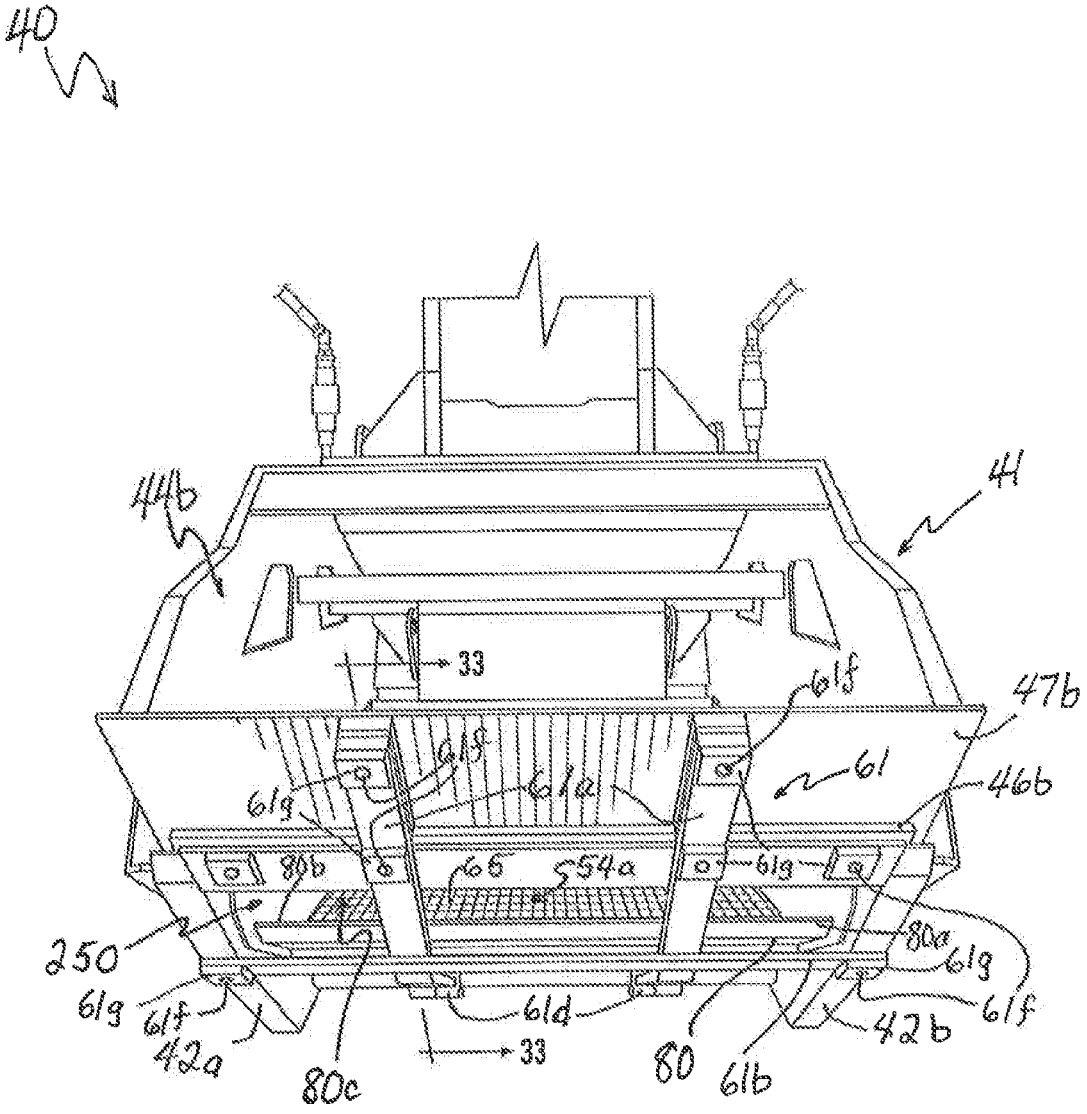
FIG. 32 is an elevated perspective view with certain structures otherwise hidden from view indicated by dashed line and illustrating embodiments of components of the present invention.
Figure 33:
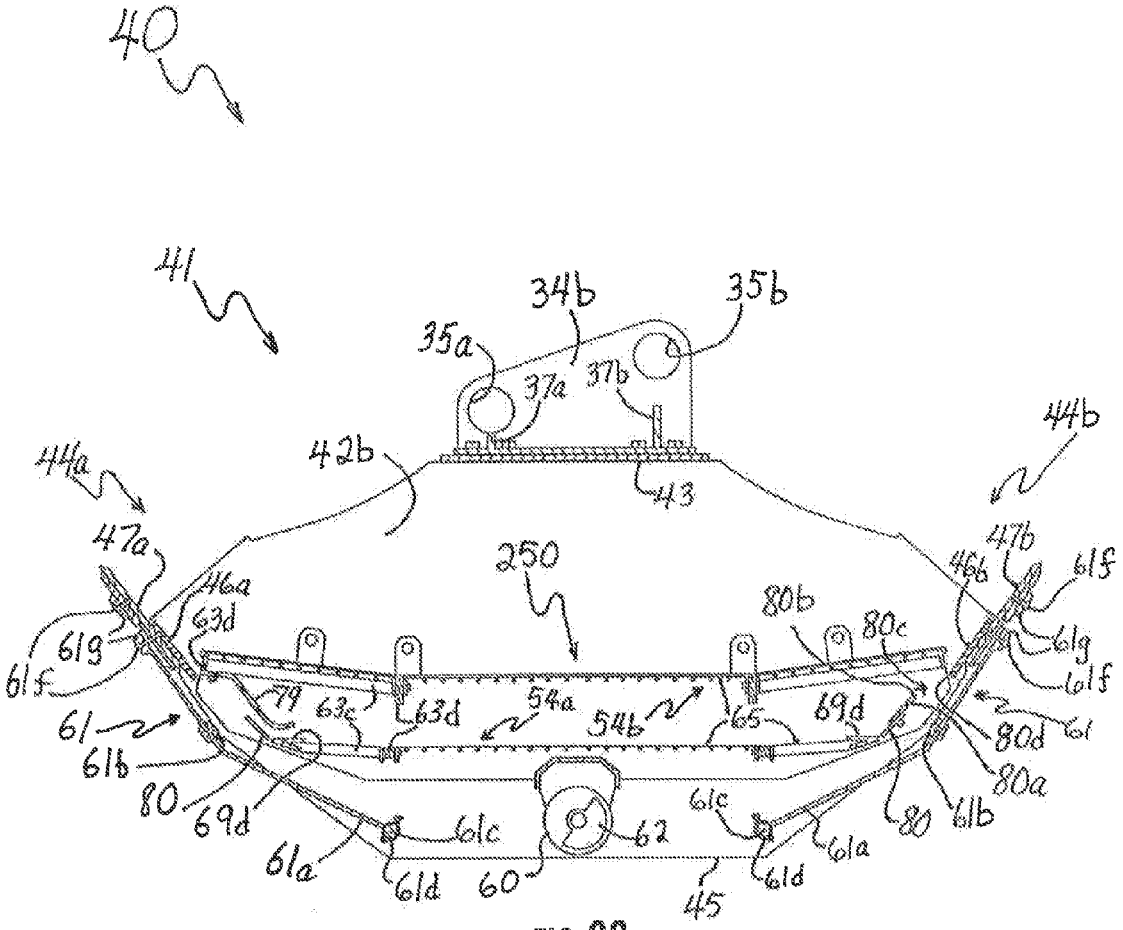
FIG. 33 is a cross-sectional view of embodiments of components of the present invention taken in the direction along the lines of the arrows designated 33—33 in FIG. 32.

Referring to FIGS. 17, 18 and 20 for example, one can see how both the vibratory mechanism 60 and the bottom screen deck 54*a* might be susceptible to damage during operation of the scoop member 41 to dig into a pile of debris and/or excavation material. Accordingly, as shown in FIGS. 32 and 33 for example, the scoop member 41 of the bucket apparatus 40 desirably includes a protection fence 61 that is disposed to protect the underside of the screening mechanism 50 or 250 and the vibratory mechanism 60 when the bucket apparatus 40 is digging into a pile of debris and/or excavation material. Desirably, as shown in FIG. 33 for example, a separate protection fence 61 is disposed at each of the forward end 44*a* and the backward end 44*b* of the scoop member 41. In the view shown in FIGS. 35 and 36 for example, only the top screen deck 54*b* has been provided with screening media 65, while the screening media 65 has been omitted from the bottom screen deck 54*a* of the double deck screening mechanism 250 in order to simplify the drawing.

Figure 35:
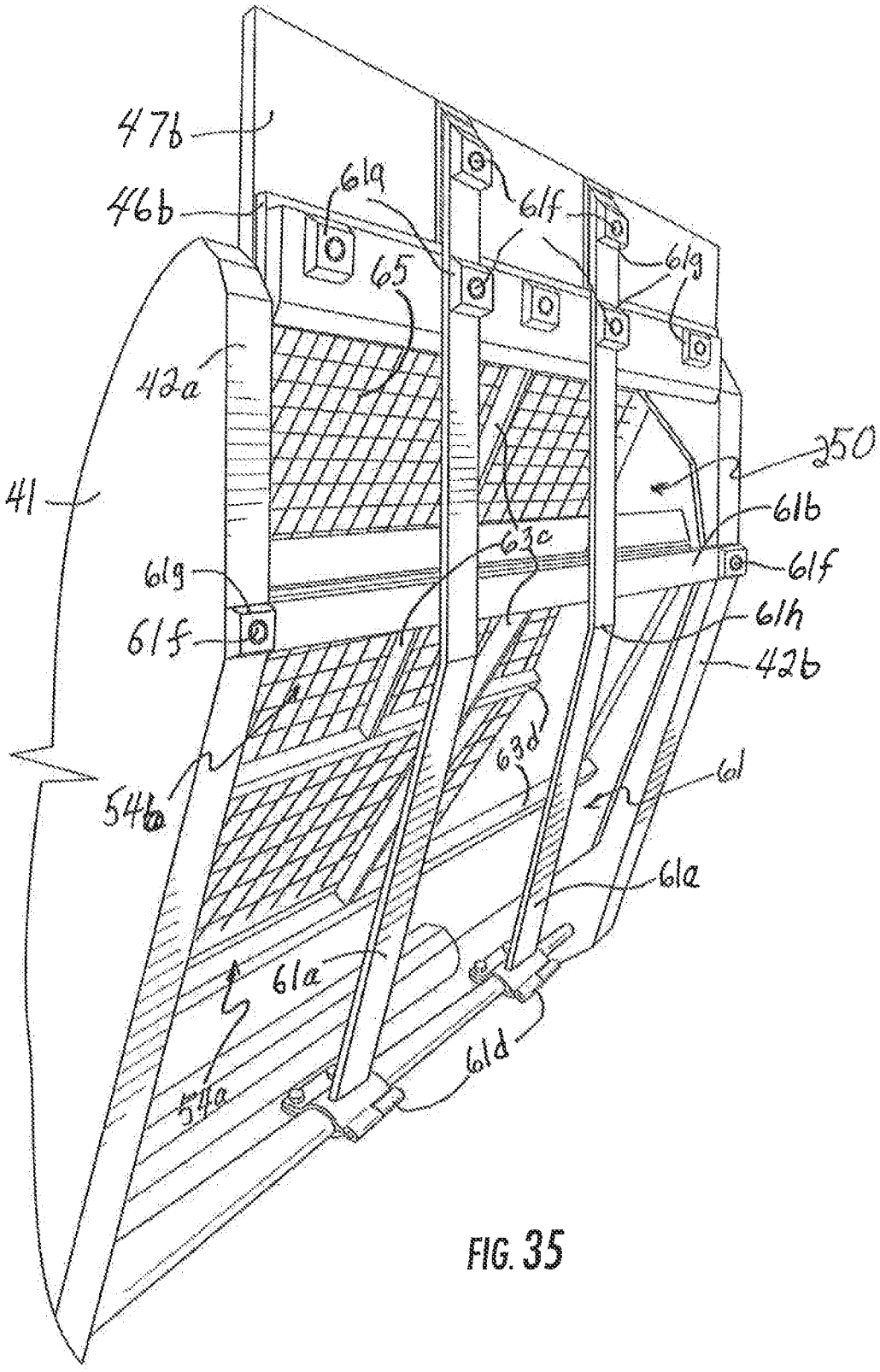
FIG. 35 is a perspective view of embodiments of components of the present invention oriented in a first disposition.
Figure 36:
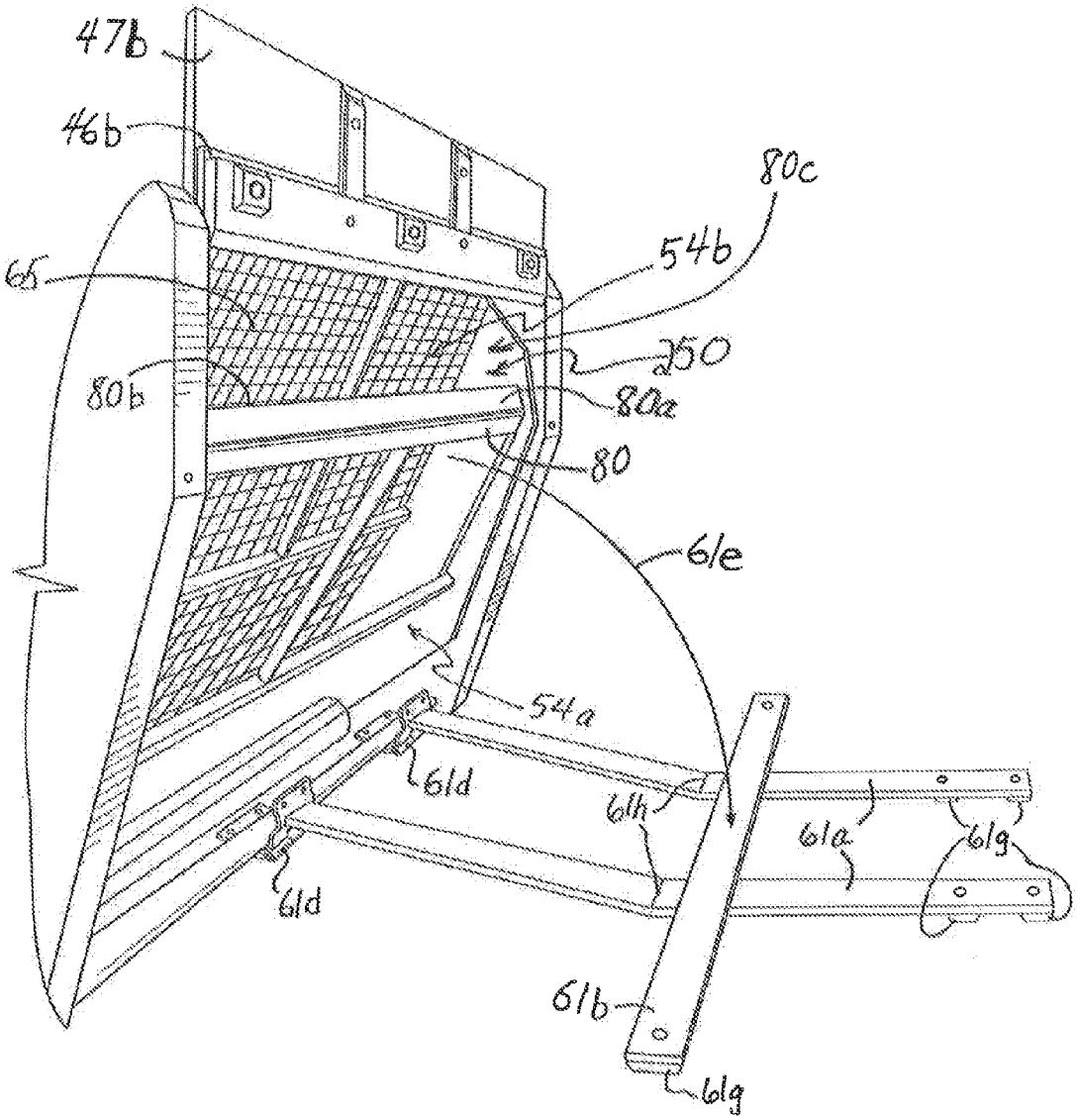
FIG. 36 is a perspective view of the embodiments of the components of the present invention shown in FIG. 35, but oriented in a second disposition.

In the embodiment shown in FIGS. 35 and 36 for example, the protection fence 61 desirably is formed as a lattice of flat, narrow steel rails 61*a*, 61*b*, the open areas of the lattice constituting greater than about 95% of the area occupied by the protection fence 61. The rails 61*a*, 61*b* can be arranged in a lattice structure as a tic-tac-toe grid or in a configuration in which at least one rail 61*a* or 61*b* crosses another rail 61*a* or 61*b* so as to form the letter "X" or a plus sign "+." In the embodiment shown in FIGS. 35 and 36 for example, the protection fence 61 desirably is formed by a pair of longitudinally extending flat rails 61*a* spaced apart in the transverse direction from each other. Each of the longitudinally extending flat rails 61*a* desirably is configured to conform to the shape of the underside of the scoop member 41 so as not to protrude outside of the structural envelope that defines the underside of the scoop member 41. In the embodiment shown in FIGS. 33, 35 and 36 for example, each of the longitudinally extending flat rails 61*a* has a bend 61*h* that demarks where the rail 61*a* branches into a pair of legs that come together at the bend 61*h* to define an obtuse angle, which in the embodiment shown is about 170 degrees.

As shown in FIGS. 35 and 36 for example, an embodiment of the protection fence 61 desirably can include a transversely extending flat rail 61*b* that is connected to the longitudinally extending flat rails 61*a* (desirably as by welding for example) and extends transversely across the longitudinally extending flat rails 61*a*. As shown in FIG. 35, each opposite end of the transversely extending flat rail 61*b* is connected by a selectively disengageable threaded bolt 61*f* to a respective one of the side panels 42*a*, 42*b* of the scoop member 41.

As shown in FIG. 35, a forward end of each longitudinally extending flat rail 61*a* desirably is bolted by a selectively disengageable threaded bolt 61*f* to the respective edge portion 47*a* of front wall 46*b* (or edge portion 47*b* of the rear wall 46*b*) of the scoop member 41. The longitudinally opposite rearward end of each longitudinally extending flat rail 61*a* desirably can be clamped onto a support rod 61*c* that extends transversely between the side panels 42*a*, 42*b* of the scoop member 41, with one end of the support rod 61*c* desirably bolted (or welded) to one side panel 42*a* and the opposite end of the support rod 61*c* bolted (or welded) to the other side panel 42*b*. As shown in FIG. 33 for example, each support rod 61*c* desirably is disposed near the center of the bottom 45 of the scoop member 41.

As shown in FIGS. 35 and 36 for example, each rearward end of each longitudinally extending flat rail 61*a* is connected to the support rod 61*c* by a hinge 61*d* so that once the attachment bolts 61*f* are removed from the forward ends of the longitudinally extending flat rails 61*a*, then the entire protection fence 61 can be pivoted away from the bottom 45 of the scoop member 41 in the direction of the arrow designated 61*e* in FIG. 36 without the need to completely remove the protection fence 61 or lift it, as the protection fence 61 desirably is made of steel and accordingly is heavy. This pivotable movement capability of the protection fence 61 facilitates replacement of components of the screening mechanism 50 or 250 when such maintenance is desired.

As shown in FIGS. 32, 33, 35 and 36 for example, each of the sites where a selectively detachable threaded bolt 61*f* is required to attach one of the ends of the flat rails 61*a*, 61*b* forming the lattice of the protection fence 61 to the scoop member 41 desirably is provided with a surround 61*g* that is configured to protect the head of the bolt 61*f* from damage that otherwise might occur when the bucket apparatus 40 is digging into a pile of debris and/or excavation material. As shown in FIG. 33 for example, each surround 61*g* desirably is formed of a steel cube that is welded to the site surrounding the hole that is to receive the bolt 61*f*. Each surround 61*g* defines a protective recess beneath the outwardly facing surface of the surround 61*g* and concentrically located with respect to the hole that is to receive the bolt 61*f*. Similar surrounds 61*g* desirably are provided elsewhere that removable threaded nuts or the heads of removable bolts 61*f* need protection against damage that otherwise might occur when the bucket apparatus 40 is digging into a pile of debris and/or excavation material.

As shown in FIG. 1, the backward end 44*b* of the scoop member 41 is the end that would be more easily visible to the operator of the mobile excavator vehicle 30. In the embodiment of the bucket 40 shown in a cross-sectional view in FIG. 33, for material that is too large to pass through the bottom screen deck 54*a*, provision is made to discharge such material solely from the backward end 44*b* of the scoop member 41. As shown in FIGS. 33 and 36 for example, an inclined lip 80 is provided near each opposite end of the bottom screen deck 54*a* but not mechanically attached to the screen deck 54*a*. Instead, each inclined lip 80 desirably is formed by a thin flat steel plate that extends transversely between the inner walls that define the opposing side panels 42*a*, 42*b* of the scoop member 41 and has each opposite end connected (as by welding) to a respective one of the side panels 42*a*, 42*b* of the scoop member 41. Each inclined lip 80 desirably is oriented at an obtuse angle upwardly toward the top screen deck 54*b*. That obtuse angle desirably is formed by the inclined lip 80 with respect to the plane in which lies the screening media 65 of the nearest screen panel of the bottom screen deck 54*a*. Desirably, such obtuse angle should not exceed 135 degrees, and for many embodiments an angle of 110 degrees will be deemed sufficient.

Figure 2F:
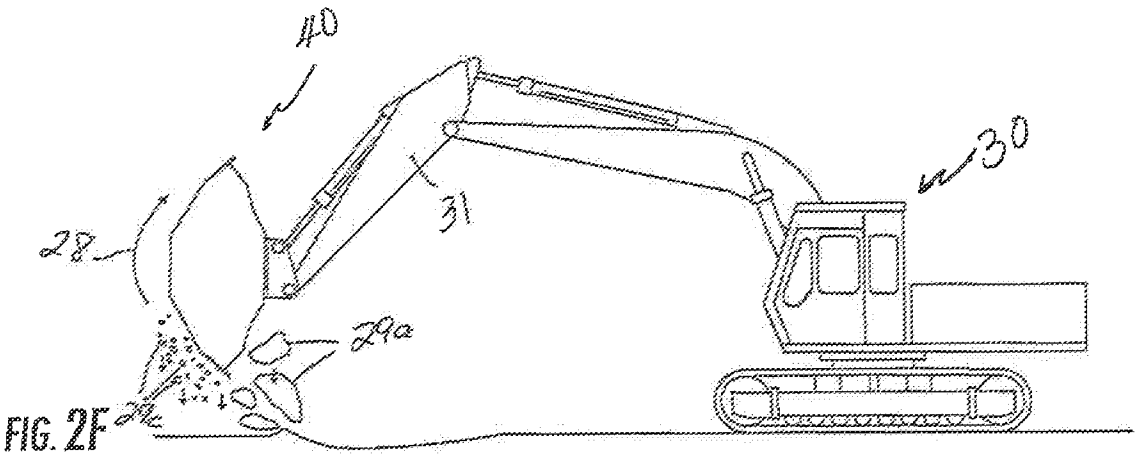
FIG. 2F is a side plan view of an embodiment of the present invention in another operating mode in which material inputted from the front is being screened and oversized material is being discharged from the rear.

Debris and/or excavation material that fails to pass through the screening mechanism 250 (or 50) must be discharged from the respective screen deck, top deck 54*b* or bottom deck 54*a* in the case of a double-deck screening mechanism 250. The backward end 44*b* of the scoop member 41 is shown in FIGS. 33 and 36 for example. The backward end 44*b* of the scoop member 41 usually is facing the mobile excavator vehicle 30 (FIG. 1), and thus when the operator tilts the scoop member 41 into an orientation such as shown in FIG. 2F, the operator readily can observe the discharge of material that fails to pass through the screening mechanism 250 or 50. Accordingly, the backward end 44*b* of the scoop member 41 also is known as the discharge end due to affording the operator a clear view of discharges from the scoop member 41. While some embodiments of the scoop member 41 are configured so that they can discharge from either the forward end 44*a* or the backward end 44*b* of the scoop member 41, it is desirable for the operator of the mobile excavator vehicle 30 (FIG. 1) to be able to observe the discharge of material that fails to pass through the screening mechanism 250 or 50.

As shown in FIGS. 32, 33 and 36 for example, the inclined lip 80 at the discharge end 44*b* of the scoop member 41 desirably can be lengthened by the attachment of a lip extension plate 80*a* to the edge of this inclined lip 80 that is farther from the plane in which lies the screening media 65 of the nearest screen panel of the bottom screen deck 54*a*. The lip extension plate 80*a* desirably is made of steel and can be connected to the inclined lip 80 that is disposed at the discharge end 44*b* of the scoop member 41. So that different lip extension plates 80*a* can be used and so that the position of the free edge 80*b* of the lip extension plate 80*a* more easily can be positioned with respect to the inclined lip 80, an adjustable connection of the lip extension plate 80*a* to the inclined lip 80 desirably is effected. Such adjustable connection of the lip extension plate 80*a* to the inclined lip 80 can be implemented for example by a nut and washer on one end of a threaded bolt extending through an elongated slotted opening through either the inclined lip 80 or the lip extension plate 80*a* for example. As shown in FIG. 33 for example, the lip extension plate 80*a* can extend in a direction that is parallel to the direction in which the inclined lip 80 extends. Alternatively, the lip extension plate 80*a* can extend in a direction that is disposed at an angle to the direction in which the inclined lip 80 extends, such that the free edge 80*b* of lip extension plate 80*a* points more vertically to the underside of the top screen deck 54*b*.

As shown in FIGS. 32 and 33 for example, the free edge 80*b* of the lip extension plate 80*a* cooperates with the lower free edge of the rear wall 46*b* of the scoop member 41 to define therebetween the discharge opening 80*c* of the bottom screen deck 54*a*. The distance between the free edge 80*b* of the lip extension plate 80*a* and the lower free edge of the rear wall 46*b* of the scoop member 41 defines the gap of the discharge opening 80*c* of the bottom screen deck 54*a*. This gap should be sized according to the size of the openings in the screen media 65 of the top screen deck 54*b* and thus desirably should be no smaller than the size of the openings in the screen media 65 of the top screen deck 54*b*. A typical gap for many embodiments will be on the order of two inches or five centimeters. The lip extension plate 80*a* desirably is provided with an elongated slide opening through the lip extension plate 80*a*. By selectively adjusting the position of the lip extension plate 80*a* that is attached to the inclined lip 80 via the elongated slide opening together with the threaded bolt and threaded nut connection, the size of this gap of the discharge opening 80*c* of the bottom screen deck 54*a* desirably can be adjusted. Thus, the adjustable discharge opening 80*c* not only regulates the amount of volumetric size of the particles of material that can be discharged through the discharge opening 80*c*, the adjustable discharge opening 80*c* also allows operators to regulate the production rate of material flowing per unit of time by opening or closing off the area defining the discharge opening 80*c*.

Moreover, as shown in FIG. 33 for example, a constriction plate 80*d* desirably can be provided rearwardly of the discharge opening 80*c* of the bottom screen deck 54*a*. The constriction plate 80*d* desirably can extend vertically downwardly from the discharge end of the top screen deck 54*b*. The constriction plate 80*d* desirably is disposed in front of the flow path that is taken by debris and/or excavation material that is/are being discharged from the bottom screen deck 54*a* through the gap that defines the height of the discharge opening 80*c* of the bottom screen deck 54*a*. The primary function of this constriction plate 80*d* is to turn the flow of debris and/or excavation material being discharged through the discharge opening 80*c* of the bottom screen deck 54*a* and in so doing slow down the flow rate of the debris and/or excavation material that is being discharged from the bottom screen deck 54*a*.

When the scoop member is tilted sufficiently as in FIG. 2F so as to discharge debris and/or excavation material 29*a* from the top screen deck 54*b* (FIG. 33), the combined inclined lip 80 and lip extension plate 80*a* nonetheless function to retain debris and/or excavation material on the bottom screen deck 54*a*. Once discharge of the debris and/or excavation material 29*a* from the top screen deck 54*b* (FIG. 33) is complete, then the operator can further tilt the scoop member 41 until the debris and/or excavation material is able to be discharged from the bottom screen deck 54*a* (FIG. 33) past the free edge of the lip extension plate 80*a* and through the discharge opening 80*c* of the bottom screen deck 54*a* located at the discharge end 44*b* of the scoop member 41.

In some embodiments of the scoop member 41, provision is made to prevent discharge of debris and/or excavation material from the bottom screen deck 54*a* via at least one of the opposite ends 44*a* or 44*b* of the scoop member 41. As shown in FIG. 33 for example, to prevent discharge of debris and/or excavation material from the bottom screen deck 54*a* via the forward end 44*a* of the scoop member 41, disposed rearwardly of the inclined lip 80 at the forward end 44*a* of the scoop member 41 is a heavy duty, flexible curtain 79 having a width that extends transversely over the entire length of the distance that separates the two opposing inner walls of the side panels 42*a*, 42*b*. As shown in FIG. 33 for example, the top edge of the curtain 79 can be attached (desirably as by threaded bolts and nuts) to the rigid end piece 63*d* of the screen skeleton 63 that underlies and supports the top screen deck 54*b* at the forward end 44*a* of the scoop member 41. Even so attached, the draping length of the curtain 79 is long enough so that the free end of the curtain 79 rests along the surface of the bottom screen deck 54*a* even as a section of the curtain 79 rests against the inclined lip 80 at the forward end 44*a* of the scoop member 41. In this way, if debris and/or excavation material resting on the bottom screen deck 54*a* should move toward the forward end 44*a* of the scoop member 41, such debris and/or excavation material will become blocked from moving past the curtain 79 at the forward end 44*a* of the scoop member 41. The material forming the curtain 79 desirably is heavy duty rubber, but also could be formed of steel or of urethane or any combination of these materials.

While at least one presently preferred embodiment of the invention has been described using specific terms, such description is for illustrative purposes only, and it is to be understood that changes and variations may be made without departing from the spirit or scope of the following claims. This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An excavating bucket apparatus that is pivotally mountable on an articulating arm of a mobile vehicle and configurable for controlled, powered operation, the bucket apparatus comprising:

a. a scoop member including a frame carrying a first side panel and a second side panel spaced apart and opposed to the first side panel, the scoop member defining a top configured for pivotal connection to the articulating arm of the mobile vehicle, the scoop member defining a forward end and a backward end disposed opposite the forward end, each of the forward end and the backward end extending transversely between the side panels at each of the respective opposite ends of the side panels, the scoop member defining a bottom disposed generally opposite the top; and b. a screening mechanism carried by the frame and disposed generally at the bottom of the scoop member, the screening mechanism defining a bottom deck and a top deck disposed between the bottom deck and the top of the scoop member, the top deck being configured to block passage of material larger than a first predetermined size, the bottom deck being configured to block passage of material larger than a second predetermined size, wherein the first predetermined size is larger than the second predetermined size.

2. The bucket apparatus of claim 1, further comprising at least one a heavy duty, curtain having a width that extends transversely between the pair of opposed side panels, the curtain having a top edge attached to one of the ends of the scoop member, the curtain having a bottom edge opposite the top edge, the draping length of the curtain being measured between the top and bottom edges and being long enough so that the bottom edge of the curtain rests along the surface of the screening media of the bottom deck of the screening mechanism.

3. The bucket apparatus of claim 1, further comprising an inclined lip disposed near a first end of the bottom deck, the inclined lip extending transversely between and connected to the pair of opposed side panels, the inclined lip being oriented at an obtuse angle upwardly toward the top deck.

4. The bucket apparatus of claim 3, further comprising a lip extension plate adjustably connected to the inclined lip and defining a free edge thereof, wherein the backward end of the scoop member is defined in part by a rear wall having a lower free edge, and wherein a discharge opening is defined as a gap between the free edge of the lip extension plate and the lower free edge of the rear wall of the scoop member and wherein the size of the gap of the discharge opening is adjustable according to the position of the lip extension plate adjustably connected to the inclined lip.

5. The bucket apparatus of claim 1, further comprising:

a. a vibratory mechanism connected to the screening mechanism and configured for shaking the screening mechanism relative to the frame;

b. a forward protection fence disposed at the forward end of the scoop member;

c. a backward protection fence disposed at the backward end of the scoop member;

d. each protection fence being configured and disposed so as to protect the underside of the screening mechanism when the bucket apparatus is digging into a pile of debris and/or excavation material;

e. a first support rod that extends transversely between the side panels of the scoop member, with one end of the first support rod connected to one side panel and the opposite end of the first support rod connected to the other side panel, the first support rod being disposed near the bottom of the scoop member and between the forward end of the scoop member and the middle of the bottom of the scoop member; and f. a second support rod that extends transversely between the side panels of the scoop member, with one end of the second support rod connected to one side panel and the opposite end of the second support rod connected to the other side panel, the second support rod being disposed near the bottom of the scoop member and between the backward end of the scoop member and the middle of the bottom of the scoop member;

g. at least a first hinge pivotably connecting a first end of the forward protection fence to the first support rod; and h. at least a second hinge pivotably connecting a first end of the backward protection fence to the second support rod.

6. The bucket apparatus of claim 5, wherein each of the forward protection fence and the backward protection has a second end disposed generally opposite the first end and connected to the scoop member by a plurality of bolts, each bolt defining a head and wherein each head of each of the plurality of bolts is disposed beneath the surface of a surround that is configured to protect the head of the bolt from damage that otherwise might occur when the bucket apparatus is digging into a pile of debris and/or excavation material.

7. The bucket apparatus of claim 1, further comprising:

a. a first rubber side panel mounted to the inwardly facing surface of the first side panel of the scoop member, the first rubber side panel being disposed between the inwardly facing surface of the first side panel of the scoop member and the screening mechanism and being configured and disposed to prevent spillage of material between the first side panel of the scoop member and the screening mechanism;

b. a second rubber side panel mounted to the inwardly facing surface of the second side panel of the scoop member, the second rubber side panel being disposed between the inwardly facing surface of the second side panel of the scoop member and the screening mechanism and being configured and disposed to prevent spillage of material between the second side panel of the scoop member and the screening mechanism; and c. wherein each of the first and second rubber side panel defines a leading edge disposed toward the forward end of the scoop member and wherein each of the first and second rubber side panel defines a trailing edge disposed toward the backward end of the scoop member.

8. The bucket apparatus of claim 7, further comprising:

a. a first leading protector connected to the first side panel of the scoop member and configured and disposed to receive and enclose the leading edge of the first rubber side panel;

b. a first trailing protector connected to the first side panel of the scoop member and configured and disposed to receive and enclose the trailing edge of the first rubber side panel;

c. a second leading protector connected to the second side panel of the scoop member and configured and disposed to receive and enclose the leading edge of the second rubber side panel; and d. a second trailing protector connected to the second side panel of the scoop member and configured and disposed to receive and enclose the trailing edge of the second rubber side panel.

9. An apparatus for separating material at a site for demolition and/or construction, the apparatus comprising:

a. a mobile vehicle having an articulating arm;

b. an engine carried by the mobile vehicle and connected to power movement of the articulating arm; and c. an excavating bucket apparatus that is pivotally mounted to the articulating arm and configurable for controlled, powered operation, the excavating bucket apparatus including:

i. a scoop member including a frame carrying a pair of spaced apart and opposed side panels, the scoop member defining a top configured for pivotal connection to the articulating arm of the mobile vehicle, the scoop member defining opposed ends extending transversely between the side panels at each of the respective opposite ends of the side panels, the scoop member defining a bottom disposed generally opposite the top; and ii. a screening mechanism carried by the frame and disposed generally at the bottom of the scoop member, the screening mechanism defining a bottom deck and a top deck disposed between the bottom deck and the top of the scoop member, the top deck being configured to block passage of material larger than a first predetermined size, the bottom deck being configured to block passage of material larger than a second predetermined size, wherein the first predetermined size is larger than the second predetermined size.

* * * * *